US008062007B2

(12) United States Patent
Ikushima et al.

(10) Patent No.: US 8,062,007 B2
(45) Date of Patent: Nov. 22, 2011

(54) FLUID TRANSPORTING DEVICE USING CONDUCTIVE POLYMER

(75) Inventors: Kimiya Ikushima, Osaka (JP); Kazuo Yokoyama, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/675,843

(22) PCT Filed: Jul. 6, 2009

(86) PCT No.: PCT/JP2009/003128

§ 371 (c)(1),
(2), (4) Date: Mar. 1, 2010

(87) PCT Pub. No.: WO2010/004721

PCT Pub. Date: Jan. 14, 2010

(65) Prior Publication Data

US 2010/0260623 A1 Oct. 14, 2010

(30) Foreign Application Priority Data

Jul. 8, 2008 (JP) ..... 2008-177992

(51) Int. Cl.
*F04B 17/00* (2006.01)

(52) U.S. Cl. ..... 417/413.1; 417/44.2; 417/395

(58) Field of Classification Search ..... 417/44.2, 417/48, 395, 411, 412, 413.1, 413.2, 413.3, 417/54, 55

See application file for complete search history.

(56) References Cited

U.S. PATENT DOCUMENTS 6,007,309 A * 12/1999 Hartley ..... 417/322
6,685,442 B2 * 2/2004 Chinn et al. ..... 417/321
6,767,190 B2 * 7/2004 Cabuz et al. ..... 417/53
7,125,407 B2 * 10/2006 Edwards et al. ..... 606/41
7,169,314 B2 * 1/2007 Unger et al. ..... 216/22
7,169,822 B2 * 1/2007 Oguro et al. ..... 521/27
7,494,459 B2 * 2/2009 Anstadt et al. ..... 600/17
7,494,555 B2 * 2/2009 Unger et al. ..... 156/60
7,651,475 B2 * 1/2010 Angel et al. ..... 604/65
2004/0108479 A1 * 6/2004 Garnier et al. ..... 251/129.01

(Continued)

FOREIGN PATENT DOCUMENTS

JP 62-36266 3/1987

(Continued)

OTHER PUBLICATIONS

JP 2005207406 A machine translation ;Aug. 2005,Nakayama et al.*

(Continued)

*Primary Examiner* — Charles Freay
*Assistant Examiner* — Amene Bayou
(74) *Attorney, Agent, or Firm* — Wenderoth, Lind & Ponack, L.L.P.

(57) ABSTRACT

A fluid transporting device is provided with a pump chamber that has a pump function for sucking and discharging a fluid, and is filled therein with the fluid, a casing unit which forms one portion of a wall surface of the pump chamber, a diaphragm which is formed by a conductive polymer film that is subjected to electrochemomechanical expansion and contraction, and forms one portion of the wall surface of the pump chamber, an electrolyte chamber that contains an electrolyte therein, with one portion of the electrolyte being made in contact with the diaphragm, a power supply that applies a voltage to the diaphragm, and a pressure maintaining unit that maintains a pressure to be applied to the diaphragm.

6 Claims, 43 Drawing Sheets

U.S. PATENT DOCUMENTS

2006/0076540 A1 * 4/2006 Zama et al. ..... 252/500

FOREIGN PATENT DOCUMENTS

| | | | |
|---|---|---|---|
| JP | 3-185282 | | 8/1991 |
| JP | 9-291886 | | 11/1997 |
| JP | 2001-193653 | | 7/2001 |
| JP | 2001-221163 | | 8/2001 |
| JP | 2005-207406 | | 8/2005 |
| JP | 2005207406 | A * | 8/2005 |
| JP | 2005-269842 | | 9/2005 |
| WO | 2005/042974 | | 5/2005 |
| WO | 2005/120728 | | 12/2005 |
| WO | WO 2007085434 | A1 * | 8/2007 |

OTHER PUBLICATIONS

International Search Report issued Aug. 18, 2009 in International (PCT) Application No. PCT/JP2009/003128.

International Preliminary Report on Patentability (translation) and Written Opinion of the International Searching Authority (translation) issued Mar. 10, 2011 in corresponding International (PCT) Application No. PCT/JP2009/003128.

* cited by examiner

VOLUMES OF RESPECTIVE PORTIONS IN CASING UNIT 102

VOLUMES OF RESPECTIVE PORTIONS IN CASING UNIT 102

FLUID TRANSPORTING DEVICE USING CONDUCTIVE POLYMER

TECHNICAL FIELD

The present invention relates to a fluid transporting device that is used for a supply device for a fuel such as, in particular, methanol or the like in a fuel battery, or a water-cooling circulator or the like for cooling electronic apparatuses including CPU's, and is desirably utilized as a fluid transporting device using a conducive polymer that is capable of sucking and discharging a fluid.

DESCRIPTION OF THE RELATED ART

A pump, which is a device for transporting a fluid such as water, has been developed so as to transport a cooling liquid for a heat generating element, such as a CPU, to transport blood to a blood inspecting chip, to apply a fine amount of medicine to the human body, to provide a Lab on a chip that can downsize chemical experiments or chemical operations so as to be integrated, or to supply a fuel such as methanol to a fuel battery. In these applications, small-size, light-weight, low-voltage and noiseless devices are required. In order to meet these demands, for example, a pump using a conductive polymer film has been proposed (for example, see JP-A No. 2005-207406). In general, an actuator using a conductive polymer film is characterized by features, such as light weight, a low voltage and noiseless operations.

FIGS. 22A to 22C show a pump structure of a diaphragm system proposed in JP-A No. 2005-207406.

The pump shown in FIG. 22A is provided with diaphragms 403 and 404 respectively made of conductive polymer films, which are placed inside of a casing unit 402. The diaphragm 403 is defined as the first diaphragm, and the diaphragm 404 is defined as the second diaphragm. The casing unit 402 has a cylindrical shape, with an inner space. The first and second diaphragms 403 and 404 are respectively prepared as disc-shaped conductive polymer films, and have their respective peripheral portions secured to the casing unit 402 as securing portions 430 and 431. Moreover, the first and second diaphragms 403 and 404 are mutually connected to each other by a connecting member 406 at their respective center portions. In this manner, the first and second diaphragms 403 and 404 are installed, with tensions being applied in respective film face directions, so as to respectively form cone shapes. In this structure, a ring-shaped space portion 409, surrounded by the first and second diaphragms 403 and 404 and the casing unit 402, is defined as an electrolyte chamber. The electrolyte chamber 409 is filled with an electrolyte. The first and second diaphragms 403 and 404 are connected to a power supply 410*c* through respective lead lines 410*a* and 410*b*. By applying voltages having mutually reversed phases to the first and second diaphragms 403 and 404 respectively, the respective conductive polymer films of the first and second diaphragms 403 and 404 are subjected to expanding and contracting movements. Now, a first space portion 407 surrounded by the casing unit 402 and the first diaphragm 403 is referred to as a first pump chamber, and a second space portion 408 surrounded by the casing unit 402 and the second diaphragm 404 is referred to as a second pump chamber. In a state shown in FIG. 22A, the first diaphragm 403 is expanded, and the second diaphragm 404 is contracted. In this state, a liquid outside the first pump chamber 407 is sucked to the inside of the first pump chamber 407 from a first inlet 411*a* provided with a first inlet valve 412, and a liquid inside the second pump chamber 408 is discharged outside the second pump chamber 408 from a second outlet 413*b* provided with a second outlet valve 424. Moreover, in contrast, in a state where the first diaphragm 403 is contracted and the second diaphragm 404 is expanded, a liquid outside the second pump chamber 408 is sucked to the inside of the second pump chamber 408 from a second inlet 411*b* provided with a second inlet valve 423, a liquid inside the first pump chamber 407 is discharged outside the first pump chamber 407 from a first outlet 413*a* provided with a first outlet valve 422. By continuously carrying out the switching between these two states, the increase and reduction of the volume of each of the first pump chamber 407 and the second pump chamber 408 are repeated so that the corresponding suction and discharge of the fluid to the respective pump chambers are repeated. With this arrangement, the pump functions are carried out. In a state in which the first and second diaphragms 403 and 404 are slackened, since a force of electrochemomechanical expansion or contraction of the conductive polymer film is not transmitted to the fluid inside the pump chamber, and released, with the result that the operating efficiency of the pump is lowered. Therefore, it is necessary to keep the first diaphragm 403 and the second diaphragm 404 in the expanded state respectively without being slackened; however, in the pump of FIG. 22A, by making the pressure of the electrolyte inside the electrolyte chamber 409 smaller than the pressure of each of the fluids in the first pump chamber and the second pump chamber, the first diaphragm 403 and the second diaphragm 404 can be kept in an expanded state without being slackened respectively.

Moreover, a pump shown in FIG. 22B, which has substantially the same structure as that of the pump of FIG. 22A, is different therefrom in that no connecting member 406 is installed. In the present structure, the first and second diaphragms 403 and 404 exert forces to each other through an electrolyte filled in the space portion 409. With this arrangement, the same operations as those of FIG. 22A can be carried out. In the pump of FIG. 22B, by making the pressure of the electrolyte inside the electrolyte chamber 409 greater than the pressure of each of the fluid inside the first pump chamber and the fluid inside the second pump chamber, or smaller than the pressure thereof, the first diaphragm 403 and the second diaphragm 404 can be kept in an expanded state without being slackened respectively.

Moreover, in the pump of FIG. 22C, only one diaphragm 403 made of a conductive polymer film is formed inside the casing unit 402. The casing unit 402 has a cylindrical shape, with an inner space formed therein. The diaphragm 403 is a disc-shaped conductive polymer film, and has its peripheral portion secured to the casing unit 402 at a securing portion 430. Furthermore, the diaphragm 403 is connected to the casing unit 402 by a connecting member 451. The diaphragm 403 is disposed with a tension being applied in the film face direction, and formed into a cone shape. In FIG. 22C, a space portion 409, located below the diaphragm 403 and surrounded by the diaphragm 403 and the casing unit 402, is defined as an electrolyte chamber. The space portion 409 is filled with an electrolyte solution. An electrode 450 is disposed on the bottom face of the casing unit 402 opposed to the diaphragm 403. The diaphragm 403 and the electrode 450 are respectively connected to a power supply 410*c* through lead lines 410*a* and 410*b*. A space portion 407 surrounded by the diaphragm 403 and the casing unit 402 is defined as a pump chamber. By applying voltages having mutually reversed phases to the diaphragm 403 and the electrode 450, the conductive polymer film of the diaphragm 403 is subjected to expanding and contracting movements. In a state shown in FIG. 22C, the diaphragm 403 is kept in an expanded state. In this state, a liquid outside the pump chamber 407 is sucked to the inside of the pump chamber 407 from an inlet 411 provided with an inlet valve 412. In contrast, in a state where the diaphragm 403 is contracted, a liquid inside the pump chamber 407 is discharged outside of the pump chamber 407 from the outlet 413 provided with an outlet valve 422. By continuously carrying out the switching between these states, the increase and reduction of the volume of the pump chamber 407 are repeated so that the corresponding suction and discharge of the fluid are repeated. With this arrangement, the pump functions are carried out.

SUMMARY OF INVENTION

A pump using a conductive polymer film, typically represented by the pump of JP-A No. 2005-207406, raises a problem in that, during pump operations, the tension of a diaphragm is changed greatly, resulting in a reduction in the pump operation efficiency. In this case, the change in tension of the diaphragm includes two types of changes. The first change is a tension change of the diaphragm caused by periodic electrochemomechanical expansion and contraction of a conductive polymer film during pump operations. The second change is a tension change caused when the conductive polymer film is subjected to expansion and contraction by reasons other than the periodic electrochemomechanical expansion and contraction. The following description will discuss these points in succession.

First, the following description will discuss a change in tension of a diaphragm caused by periodic electrochemomechanical expansion and contraction of a conductive polymer film during pump operations, and the subsequent reduction in the pump operation efficiency due to the change.

In general, the amount of expansion and contraction of a conductive polymer film is substantially in proportional to the quantity of incoming and outgoing charge to and from the conductive polymer film. In this case, there is a relationship in which, when a certain quantity of charge is allowed to flow into a first diaphragm 403, the same quantity of charge is allowed to flow out of a second diaphragm 404. At this time, the first diaphragm 403 is expanded, while the second diaphragm 404 is contracted, and for the reason as described above, the amount of expansion of the first diaphragm 403 and the amount of contraction of the second diaphragm 404 are made substantially equal to each other. That is, the amount of change in the area of the first diaphragm 403 and the amount of change in the area of the second diaphragm 404 have reversed signs, with the absolute values thereof being substantially equal to each other. Therefore, the total area of the first diaphragm 403 and the second diaphragm 404 is kept substantially constant. In contrast, in a case where a certain quantity of charge is allowed to flow out of the first diaphragm 403, while the corresponding charge is allowed to flow into the second diaphragm 404, the same relationship holds. As described above, upon actuation of the pump of FIG. 22B, the total area of the first diaphragm 403 and the second diaphragm 404 are kept substantially constant.

During pump operations shown in FIG. 22B, on the assumption that the first diaphragm 403 is in an expanded state without being slackened, the relationship between the area of the first diaphragm 403 and the volume of the first pump chamber 407 is generally represented by a non-linear relationship. That is, in general, a graph that shows the relationship between the area of the first diaphragm 403 and the volume of the first pump chamber 407 forms an upward convex shape or a downward convex shape. With respect to the graph that shows the relationship between the area of the first diaphragm 403 and the volume of the first pump chamber 407, FIG. 25A shows an example in which the shape corresponds to the upward convex shape. Moreover, with respect to the graph that shows the relationship between the area of the first diaphragm 403 and the volume of the first pump chamber 407, in contrast, FIG. 25B shows an example in which the shape corresponds to the downward convex shape. In this case, it is supposed that the area of the first diaphragm 403 is $S_1$, with the volume of the first pump chamber 407 at that time being $W_1$, and that the area of the second diaphragm 404 is $S_2$, with the volume of the second pump chamber 408 at that time being $W_2$, and when the area of the first diaphragm 403 and the area of the second diaphragm 404 become equal to each other, the respective areas are set to $S_0$, and the volume of the first pump chamber 407 and the volume of the second pump chamber 408 at that time are set to $W_0$.

In a case where the relationship of FIG. 25C holds, on the assumption that, during pump operations, the first diaphragm 403 and the second diaphragm 404 are in the expanded state without being slackened, the relationship between the area of the first diaphragm 403 and the volume of the total portions of the first pump chamber 407 and the second pump chamber 408 ($W_1+W_2$) is indicated by FIG. 25C. Moreover, in a case where the relationship of FIG. 25B holds, on the assumption that, during pump operations, the first diaphragm 403 and the second diaphragm 404 are in the expanded state without being slackened, the relationship between the area of the first diaphragm 403 and the volume of the total portions of the first pump chamber 407 and the second pump chamber 408 ($W_1+W_2$) is indicated by FIG. 25D. In this case, when the area of the first diaphragm 403 and the area of the second diaphragm 404 become equal to each other, the respective values are set to $S_0$. Moreover, as described above, during pump operations, since the amount of change in the area of the first diaphragm 403 and the amount of change in the area of the second diaphragm 404 have reversed signs, with the absolute values thereof being substantially equal to each other, it is supposed that the total amount of the area of the first diaphragm 403 and the area of the second diaphragm 404 is maintained constant. At this time, supposing that the relationship, $S_2-S_0=S_0-S_1$, holds, when the area of the first diaphragm 403 is $S_1$, the area of the second diaphragm 404 becomes $S_2$, and, in contrast, when the area of the second diaphragm 404 is $S_1$, the area of the first diaphragm 403 becomes $S_2$. As shown in FIG. 25D, the relationship between the area of the first diaphragm 403 and the total volume of the first pump chamber 407 and the second pump chamber 408 forms a graph having a laterally symmetrical shape with "a straight line indicating the relationship (area of the first diaphragm)=$S_0$)" serving as a symmetrical axis. Moreover, the total value ($W_1+W_2$) of the first pump chamber 407 and the second pump chamber 408 takes a maximum value or a minimum value when the area of the first diaphragm 403=$S_0$. In FIG. 25C, it takes the maximum value when the area of the first diaphragm 403=$S_0$, while in FIG. 25D, it takes the minimum value when the area of the first diaphragm 403=$S_0$. In either of the cases, in response to area changes of the first diaphragm 403 and the second diaphragm 404, the total value of the volume of the first pump chamber 407 and the volume of the second pump chamber 408 does not form a constant value, but changes.

Supposing that the first diaphragm 403 and the second diaphragm 404 are expanded without being slackened in a certain state, and that the first diaphragm 403 and the second diaphragm 404 are deformed in the expanded state without being slackened from that position, the total value ($W_1+W_2$) of the volume of the first pump chamber 407 and the volume of the second pump chamber 408 reduces or increases. Supposing that the volume inside the casing unit 402 is $W_t$, the volume of the electrolyte chamber 409 becomes a value $[W_t-(W_{1+}+W_2)]$ obtained by subtracting the total value $(W_1+W_2)$ of the first pump chamber 407 and the second pump chamber 408 from $W_t$. Consequently, in response to a reduction or increase of the total value $(W_1+W_2)$ of the first pump chamber 407 and the second pump chamber 408, the volume of the electrolyte chamber 409 increases or reduces. In a case where the volume of the electrolyte chamber 409 increases, since the electrolyte filled into the electrolyte chamber 409 is a non-compressive fluid, the pressure of the electrolyte solution reduces abruptly. The balance between the pressure of the fluid inside the first pump chamber and the pressure of the electrolyte is changed abruptly by this pressure change so that the first diaphragm 403 is pressed by a strong force in a direction from the first pump chamber 407 toward the electrolyte chamber 409. Moreover, the second diaphragm 404 is pressed by a strong force in a direction from the second pump chamber 408 toward the electrolyte chamber 409. For this reason, tensions of the first diaphragm 403 and the second diaphragm 404 become extremely large, with the result that the operations of the first diaphragm 403 and the second diaphragm 404 are disturbed. As a result, the amount of discharge and the amount of suction of the pump becomes a very small value to cause a reduction in the pump operation efficiency.

In contrast, in a case where the volume of the electrolyte chamber 409 reduces, the pressure of the electrolyte solution increases abruptly. As described above, in the pump of FIG. 22B, in order to keep the diaphragm in the expanded state without being slackened, it is necessary to keep the relationship that the pressure of the electrolyte is made smaller than that of the fluid inside the pump chamber. However, in a case where the pressure of the electrolyte abruptly increases in response to the volume reduction of the electrolyte chamber 409, this relationship is no longer maintained to cause the diaphragm to slacken. FIG. 24B shows a state in which, in the pump shown in FIG. 22B, the diaphragms 403 and 404 of the conductive polymer films are slackened (become loose). Upon giving consideration to the tensions of the diaphragms 403 and 404, the tensions in the slackened states of the diaphragms 403 and 404 become smaller than those in the expanded states without being slackened of the diaphragms 403 and 404. That is, in the pump of FIG. 22B, the pressure of the electrolyte is abruptly changed in response to the volume change of the electrolyte chamber 409. As a result, such a state is generated in which the diaphragms 403 and 404 are slackened, or the tensions become too large to disturb the operations. In the pump of FIG. 22A also, during operations thereof, a volume change occurs in the electrolyte chamber 409 to cause the subsequent abrupt change in the pressure of the electrolyte. As a result, such a state is generated in which the diaphragms 403 and 404 are slackened, or the tensions become too large to disturb the operations. Additionally, in FIGS. 25C and 25D, in a case where the area of the first diaphragm 403 is $S_0$, a change in the total volume of the first pump chamber 407 and the second pump chamber 408 is small, and within this limited range, it is possible to always operate the diaphragm in the expanded state without being slackened; however, such a range is small, and the amount of discharge and amount of suction of the pump is limited to a small value. As a result, the pump operation efficiency becomes lower.

Moreover, in the pump shown in FIG. 22C, in order to allow the space 407 to cause an increase and a reduction in the volume, the volume of the space portion 409 needs to reduce and increase. In this case, the space portion 409 is filled with an electrolyte, and since the electrolyte is a non-compressive fluid, the volume of the space portion 409 is kept substantially constant. Consequently, since a change in the volume of the space 407 is limited to a very small range, the amount of a discharge and suction of the liquid in this pump is set to a very small value. Now suppose that upon actuation of the pump shown in FIG. 22C, the diaphragm 403 is kept in a non-slackened state. At this time, in an operating state in which the diaphragm 403 is expanded so that the liquid is sucked into the pump chamber 407, the volume of the electrolyte chamber 409 reduces. However, since the electrolyte filled into the electrolyte chamber 409 is a non-compressive fluid, the pressure of the electrolyte increases abruptly. As a result, the diaphragm 403 is pushed by a strong force in a direction from the electrolyte chamber 409 toward the pump chamber 407 so that the tension of the diaphragm 403 becomes a very large value. Consequently, the operation of the diaphragm 403 is disturbed. Moreover, in contrast, in an operating state in which the diaphragm 403 is contracted so that the volume of the pump chamber 407 is reduced to cause the liquid to be discharged from the pump chamber 407, the volume of the electrolyte chamber 409 increases. However, since the electrolyte filled into the electrolyte chamber 409 is a non-compressive fluid, the pressure of the electrolyte reduces abruptly. As a result, the diaphragm 403 is pushed by a strong force in a direction from the pump chamber 407 toward the electrolyte chamber 409 so that the tension of the diaphragm 403 becomes a very large value. Consequently, the operation of the diaphragm 403 is disturbed.

In summary, in the conventional pump, during pump operations, such a state occurs in which the tension of the diaphragm becomes small with the result that the diaphragm is slackened, or such a state occurs in which the tension of the diaphragm becomes very large to disturb operations of the diaphragm. FIGS. 24A to 24C show states in which, in the pump shown in FIGS. 22A to 22C, the diaphragm of the conductive polymer film is slackened (becomes loose). In this state, even when the diaphragm of the conductive polymer film is expanded, a force is released to escape, with the result that the force is not efficiently transmitted to the liquid in the pump chamber to cause an abrupt reduction in the efficiency in the suction and discharge of the liquid. Moreover, in the state in which the tension of the diaphragm becomes very large to disturb operations of the diaphragm also, the amount of discharge and amount of suction become very small values to cause an abrupt reduction in the pump efficiency.

The following description will discuss a change in tension that occurs upon expansion or contraction of the diaphragm of the conductive polymer film due to reasons other than the periodic electrochemomechanical expansion and contraction and a reduction in the pump operation efficiency caused by the change.

FIG. 23 is a view that shows a state in which, by setting a conductive polymer film having a rectangular shape in an electrolyte, an ac voltage is applied thereto, with a constant tension being applied thereto in a longitudinal direction, so as to be electrochemomechanically expanded and contracted, and schematically indicates a change in the strain of the conductive polymer film at this time. In this case, $L_0$ represents the length of the longer side of the conductive polymer film prior to the voltage application, $\Delta L$ represents a value obtained by subtracting $L_0$ from the length of the longer side of the conductive polymer film at each of points of time. The axis of ordinate in FIG. 23 represents a value corresponding to $\Delta L/L_0$ indicated by percentage (%). For example, these experiments are described in detail in the second chapter or the like of a book "Frontier of Soft Actuator Developments~For Achieving Artificial Muscle~(published in October, 2004, by N-T-S Co., Ltd.)". As shown in FIG. 23, upon carrying out operations by applying a periodic voltage to the conductive polymer film, even when the voltage returns to its original voltage, the strain in the conductive polymer film does not completely return to its original state to cause the strain to accumulate in a fixed direction. Moreover, even in a case where no voltage is applied, the conductive polymer film tends to have a deformation such as an expansion due to the suction of the electrolyte by the conductive polymer film. Furthermore, the conductive polymer film tends to have a non-reversible or reversible shape change, typically represented by creeping. At fixed portions of the diaphragm, a deformation or a deviation tends to occur. Additionally, in FIG. 22A, the fixed portions of the diaphragm are indicated by reference numerals 430 and 431. Moreover, the conductive polymer film tends to be expanded due to a temperature change. For example, upon a temperature increase, the conductive polymer film tends to be expanded by thermal expansion. In a case where the conductive polymer film has a thermally contracting characteristic, the conductive polymer film is expanded upon a temperature drop. Upon taking into consideration the state in which the conductive polymer film is expanded for these reasons, since the elastic modulus of the conductive polymer film is high, and since the expansion of the conductive polymer film caused by these reasons is not sucked by its elasticity, the conductive polymer film is brought into a slackened state. For the reasons described above, even when, upon manufacturing, a pump is designed so as to have an appropriate tension being applied to the conductive polymer film, the corresponding conductive polymer film is then slackened to cause a state in which a desired tension is no longer applied to the conductive polymer film. FIGS. 24A to 24C show states in which, in the pump shown in FIGS. 22A to 22C, the conductive polymer film is slackened (becomes loose). In these states, even when the conductive polymer film is expanded and contracted, the corresponding force is released to escape, and since the force is not efficiently transmitted to the fluid (for example, liquid) in the pump chamber, the efficiency of suction and discharge of the fluid is extremely lowered.

Moreover, on the contrary, the conductive polymer film tends to be contracted in response to a change in the temperature or the like. For example, when the temperature rises, the conductive polymer film tends to be thermally contracted. In a case where the conductive polymer film has a thermally contracting characteristic, the conductive polymer film is contracted upon a temperature drop. Moreover, the conductive polymer film sucks the electrolyte to have an increased thickness to cause a force expanding in a thickness direction, with the result that by a deformation due to this force, the conductive polymer film tends to be contracted in a face direction of the diaphragm face. Upon taking into consideration the state in which the conductive polymer film is contracted for these reasons, since the elastic modulus of the conductive polymer film is high, and since the contraction of the conductive polymer film caused by these reasons is not sucked by its elasticity, the tension of the conductive polymer film becomes very large, with the result that pump operations are disturbed.

In summary, in the conventional pump, a change in tension occurs when the conductive polymer film is contracted due to reasons other than the periodic electrochemomechanical expansion and contraction, resulting in a reduction in the efficiency of pump operations. In particular, in a case where the tension has become a value smaller than a predetermined value, the diaphragm is brought into a slackened state. FIGS. 24A to 24C show states in which, in the pump shown in FIGS. 22A to 22C, the conductive polymer film is slackened (becomes loose). In these states, even when the conductive polymer film is expanded and contracted, the corresponding force is released to escape, and since the force is not efficiently transmitted to the fluid in the pump chamber, the efficiency of the suction and discharge of the fluid is extremely lowered.

For this reason, the objective of the present invention is to provide a fluid transporting device using a conductive polymer, which can improve the efficiency of the suction and discharge of the fluid by maintaining a pressure to be applied to a diaphragm within an appropriate range, the diaphragm having pump functions that carries out suction and discharge of a fluid by using a conductive polymer film, and including a conductive polymer film.

In order to achieve the above-mentioned objective, the present invention has the following arrangements:

According to a first aspect of the present invention, there is provided a fluid transporting device, which uses a conductive polymer, and sucks and discharges a fluid, comprising:

a pump chamber in which the fluid is filled;

a casing unit that has the pump chamber formed therein, and forms one portion of a wall surface of the pump chamber;

a diaphragm, supported inside the casing unit, one portion or an entire portion of which is formed by a conductive polymer film that is subjected to electrochemomechanical expansion and contraction, and which forms the wall surface of the pump chamber together with the casing unit;

an opening portion that is formed on the casing unit, and used for carrying out discharging and sucking operations of the fluid in the pump chamber;

an electrolyte chamber that is surrounded by the casing unit and the diaphragm and contains an electrolyte therein, with one portion of the electrolyte being made in contact with the diaphragm;

a power supply that applies a voltage to the conductive polymer film;

a wiring portion that electrically connects the conductive polymer film to the power supply; and a pressure maintaining unit that maintains a pressure to be applied to the diaphragm by the electrolyte inside the electrolyte chamber and the fluid inside the pump chamber within a predetermined range.

The fluid transporting device using a conductive polymer of the present invention is provided with a function (pressure-maintaining function) by which, when a diaphragm is deformed, the pressure of an electrolyte is maintained within a predetermined range so that the pressure to be exerted on the diaphragm is maintained within an appropriate range. Since this state is always maintained during operations of the fluid transporting device, work that is exerted upon expansion and contraction of a conductive polymer film is efficiently used for the discharge and suction of the fluid in the pump chamber. That is, supposing that a rate of work to be used for carrying out sucking and discharging operations in the pump chamber relative to electric energy applied from a power supply is referred to as "work efficiency", the work efficiency of the fluid transporting device is improved by the pressure-maintaining function, in comparison with that of a conventional pump.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE INVENTION

Figure 1:
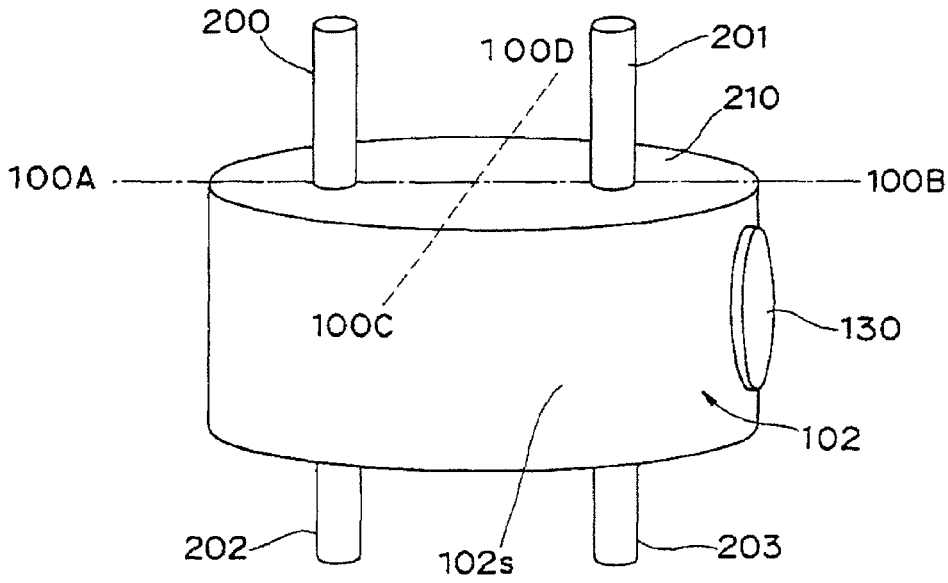
FIG. 1 is a perspective view that shows a fluid transporting device using a conductive polymer in accordance with the first embodiment of the present invention.

Referring to the Figures, the following description will discuss embodiments in accordance with the present invention.

Prior to detailed explanations of the embodiments of the present invention by reference to the drawings, the following description will discuss various aspects of the present invention.

According to a first aspect of the present invention, there is provided a fluid transporting device, which uses a conductive polymer, and sucks and discharges a fluid, comprising:

a pump chamber in which the fluid is filled;

a casing unit that has the pump chamber formed therein, and forms one portion of a wall surface of the pump chamber;

a diaphragm, supported inside the casing unit, one portion or an entire portion of which is formed by a conductive polymer film that is subjected to electrochemomechanical expansion and contraction, and which forms the wall surface of the pump chamber together with the casing unit;

an opening portion that is formed on the casing unit, and used for carrying out discharging and sucking operations of the fluid in the pump chamber;

an electrolyte chamber that is surrounded by the casing unit and the diaphragm and contains an electrolyte therein, with one portion of the electrolyte being made in contact with the diaphragm;

a power supply that applies a voltage to the conductive polymer film;

a wiring portion that electrically connects the conductive polymer film to the power supply; and a pressure maintaining unit that maintains a pressure to be applied to the diaphragm by the electrolyte inside the electrolyte chamber and the fluid inside the pump chamber within a predetermined range.

According to a second aspect of the present invention, there is provided the fluid transporting device that uses a conductive polymer according to the first aspect, wherein the pressure maintaining unit has an elastic portion, and by using an elastic force of the elastic portion, an interface between the electrolyte and a portion other than the electrolyte is deformed so that the pressure to be exerted on the diaphragm is maintained within the predetermined range.

According to a third aspect of the present invention, there is provided the fluid transporting device that uses a conductive polymer according to the second aspect, wherein the elastic portion of the pressure maintaining unit includes an elastic member capable of expanding and contracting that is formed on one portion of the wall surface of the electrolyte chamber, and a spring portion that connects the elastic member to the casing unit, and by allowing an elastic force of the elastic member or an elastic force of the spring portion to exert as the elastic force of the elastic portion, a force to try to deform the elastic member in a direction from an inside of the electrolyte chamber toward an outside thereof is generated so that by the generated force, a pressure of the electrolyte is maintained at a value smaller than a pressure of the fluid in the pump chamber, with the diaphragm being maintained in a convex shape protruding in a direction from the pump chamber toward the electrolyte chamber by a tension of the diaphragm generated by a difference between the pressure of the electrolyte and the pressure of the fluid in the pump chamber.

According to a fourth aspect of the present invention, there is provided the fluid transporting device that uses a conductive polymer according to the second aspect, wherein the elastic portion of the pressure maintaining unit is formed by an elastic member capable of expanding and contracting that is formed on one portion of the wall surface of the electrolyte chamber, and by allowing an elastic force of the elastic member to exert as the elastic force of the elastic portion, a force to try to deform the elastic member in a direction from an inside of the electrolyte chamber toward an outside thereof is generated so that by the generated force, a pressure of the electrolyte is maintained at a value smaller than a pressure of the fluid in the pump chamber, with the diaphragm being maintained in a convex shape protruding in a direction from the pump chamber toward the electrolyte chamber by a tension of the diaphragm generated by a difference between the pressure of the electrolyte and the pressure of the fluid in the pump chamber.

According to a fifth aspect of the present invention, there is provided the fluid transporting device that uses a conductive polymer according to the second aspect, wherein the elastic portion of the pressure maintaining unit is formed by a spring portion, and by allowing an elastic force of the spring portion to exert as the elastic force of the elastic portion, a force to try to deform an interface between the electrolyte and a portion other than the electrolyte is generated so that by the generated force, a pressure of the electrolyte is maintained at a value smaller than a pressure of the fluid in the pump chamber, with the diaphragm being maintained in a convex shape protruding in a direction from the pump chamber toward the electrolyte chamber by a tension of the diaphragm generated by a difference between the pressure of the electrolyte and the pressure of the fluid in the pump chamber.

According to a sixth aspect of the present invention, there is provided the fluid transporting device that uses a conductive polymer according to the second aspect, wherein the elastic portion of the pressure maintaining unit comprises an elastic member capable of expanding and contracting that is formed on one portion of the wall surface of the electrolyte chamber, and a spring portion that connects the elastic member to the casing unit, and by allowing an elastic force of the elastic member or an elastic force of the spring portion to exert as the elastic force of the elastic portion, a force to try to deform the elastic member in a direction from an outside of the electrolyte chamber toward an inside thereof is generated so that by the generated force, a pressure of the electrolyte is maintained at a value greater than a pressure of the fluid in the pump chamber, with the diaphragm being maintained in a convex shape protruding in a direction from the electrolyte chamber toward the pump chamber by a tension of the diaphragm generated by a difference between the pressure of the electrolyte and the pressure of the fluid in the pump chamber.

According to a seventh aspect of the present invention, there is provided the fluid transporting device that uses a conductive polymer according to the second aspect, wherein the elastic portion of the pressure maintaining unit is formed by an elastic member capable of expanding and contracting that is formed on one portion of the wall surface of the electrolyte chamber, and by allowing an elastic force of the elastic member to exert as the elastic force of the elastic portion, a force to try to deform the elastic member in a direction from an outside of the electrolyte chamber toward an inside thereof is generated so that by the generated force, a pressure of the electrolyte is maintained at a value greater than a pressure of the fluid in the pump chamber, with the diaphragm being maintained in a convex shape protruding in a direction from the electrolyte chamber toward the pump chamber by a tension of the diaphragm generated by a difference between the pressure of the electrolyte and the pressure of the fluid in the pump chamber.

According to an eighth aspect of the present invention, there is provided the fluid transporting device that uses a conductive polymer according to the second aspect, wherein the elastic portion of the pressure maintaining unit is formed by a spring portion, and by allowing an elastic force of the spring portion to exert as the elastic force of the elastic portion, a force to try to deform an interface between the electrolyte and a portion other than the electrolyte is generated so that by the generated force, a pressure of the electrolyte is maintained at a value greater than a pressure of the fluid in the pump chamber, with the diaphragm being maintained in a convex shape protruding in a direction from the electrolyte chamber toward the pump chamber by a tension of the diaphragm generated by a difference between the pressure of the electrolyte and the pressure of the fluid in the pump chamber.

According to a ninth aspect of the present invention, there is provided the fluid transporting device that uses a conductive polymer according to the second aspect, wherein the elastic portion of the pressure-maintaining unit is located in the electrolyte in the electrolyte chamber, and is formed by a bubble portion containing a gas inside thereof, and the bubble portion has a volume that is set to 10% or more of an amount of discharge of the fluid transporting device obtained by one cycle of expansion and contraction of the diaphragm.

According to a 10th aspect of the present invention, there is provided the fluid transporting device that uses a conductive polymer according to the ninth aspect, wherein the bubble portion has a volume that is set to 20% or less of a volume of the electrolyte chamber.

Referring to the Figures, the following description will discuss embodiments; however, the present invention is not intended to be limited by these.

First Embodiment

FIG. 1 is a perspective view that shows a fluid transporting device using a conductive polymer in accordance with a first embodiment of the present invention.

The fluid transporting device of FIG. 1 is provided with a casing unit 102, an elastic film portion 130 serving as one example of an elastic portion, and respective fluid tube portions 200, 201, 202 and 203.

Figure 2:
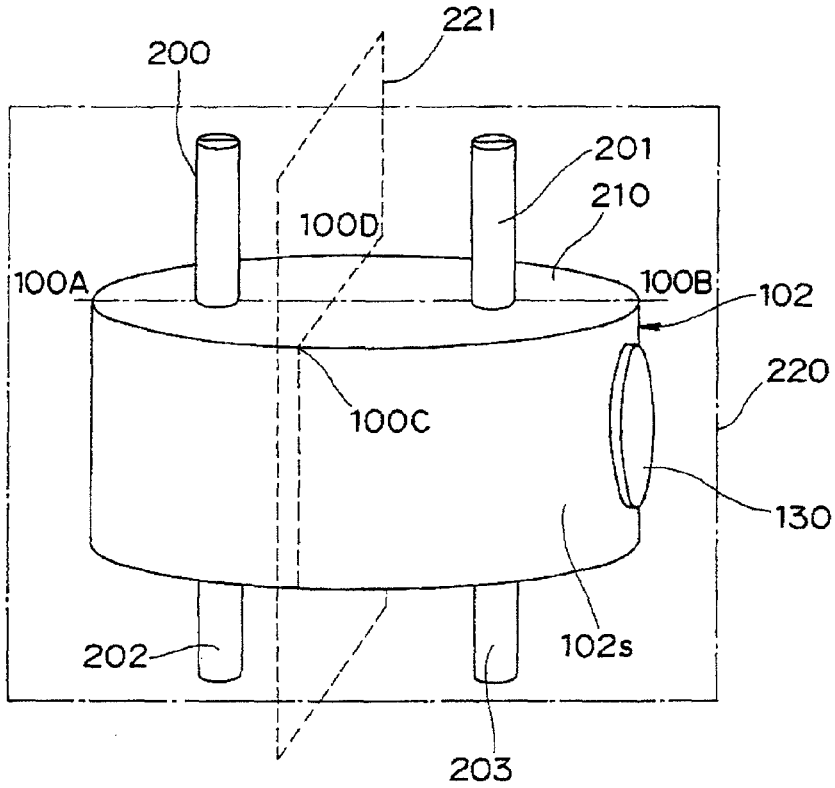
FIG. 2 is a block diagram of the fluid transporting device in accordance with the first embodiment of the present invention.

The casing unit 102 has a substantially cylindrical shape. Onto the upper and lower round planes 210 of the casing unit 102, the two fluid tube portions 200, 201 and the two fluid tube portions 202, 203 are respectively connected. A round elastic film portion 130 is attached to an opening edge on the outside of a through hole 102*h* of a side wall 102*s* of the casing unit 102. For convenience of explanation below, the upper round plane of the casing unit 102 is defined as an upper round plane 210. As shown in FIG. 1, a straight line 100A-100B is a straight line including one diameter of the upper round plane 210. Moreover, a straight line 100C-100D is a straight line including one diameter of the upper round plane 210, which is orthogonal to the straight line 100A-100B. A plane, which includes the straight line 100A-100B and is perpendicular to the upper round plane 210, is defined as a plane 220 (see FIG. 2). Moreover, a plane, which includes the straight line 100C-100D and is perpendicular to the upper round plane 210, is defined as a plane 221 (see FIG. 2).

Figure 3:
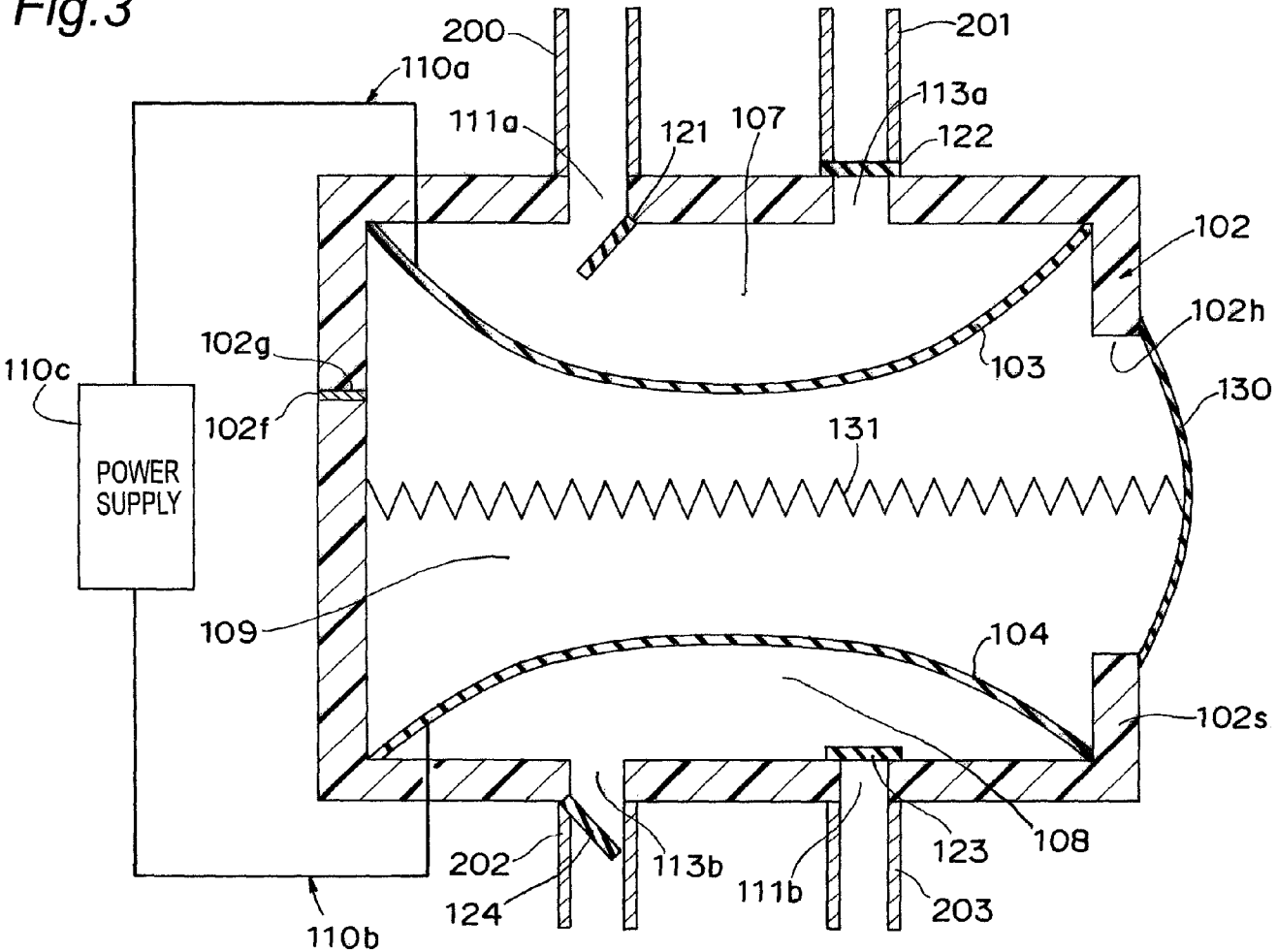
FIG. 3 is another block diagram of the fluid transporting device in accordance with the first embodiment of the present invention.

FIG. 3 is a cross-sectional view showing a cross section of the fluid transporting device of the first embodiment that is cut through the plane 220.

The fluid transporting device of FIG. 3 is configured by the casing unit 102, a first diaphragm 103, a second diaphragm 104, a first pump chamber 107, a second pump chamber 108, an electrolyte chamber 109, wiring portions 110*a* and 110*b*, a power supply 110*c*, first and second inlets 111*a* and 111*b*, first and second outlets 113*a* and 113*b*, first and second inlet valves 121 and 123, first and second outlet valves 122 and 124, a spring portion 131 serving as one example of an elastic portion, the elastic film portion 130 and the fluid tube portions 200, 201, 202 and 203. The spring portion 131 and the elastic film portion 130 function as a pressure maintaining unit (in particular, one example of an elastic portion of the pressure maintaining unit) as explained below.

The first diaphragm 103 is a disc-shaped conductive polymer film, and its peripheral portion is secured to the peripheral portion of an upper wall of the casing unit 102. The second diaphragm 104 is a disc-shaped conductive polymer film, and its peripheral portion is secured to the peripheral portion of a lower wall of the casing unit 102. In order to prevent the first diaphragm 103 and the second diaphragm 104 from conducting to each other through the casing unit 102, the casing unit 102 itself is made of an insulating member, or the first diaphragm 103 or the second diaphragm 104, or both of them are secured to the casing unit 102, with an insulating member interpolated therebetween. For convenience of explanation, the first diaphragm 103 and the second diaphragm 104 are referred to simply as "diaphragm" in the following description. The shapes or operations of the respective portions will be explained below in detail.

Figure 4:
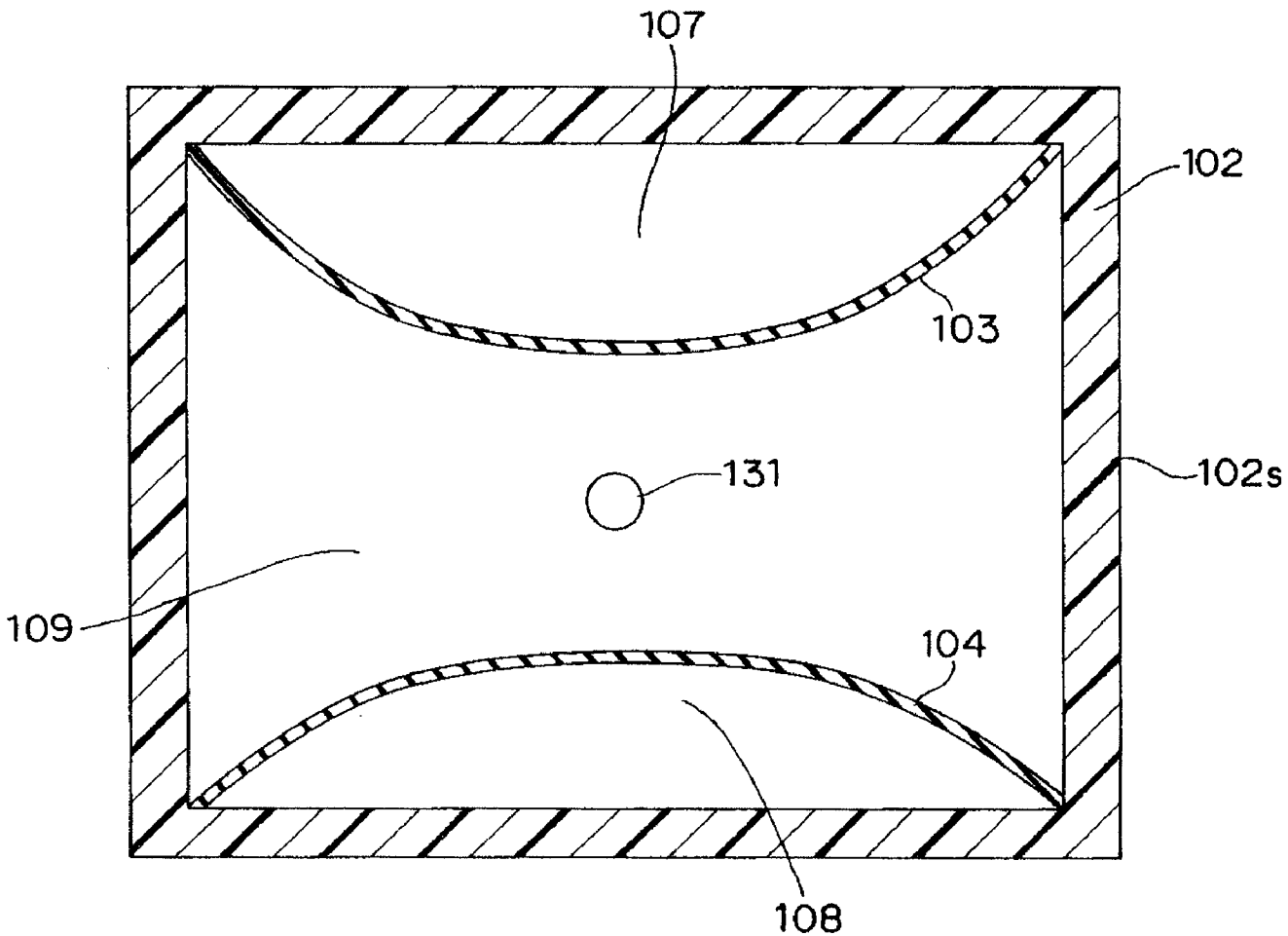
FIG. 4 is a cross-sectional view of the fluid transporting device in accordance with the first embodiment of the present invention.

FIG. 4 is a cross-sectional view showing a cross section of the fluid transporting device of the first embodiment that is cut through the plane 221. In FIG. 4, the shape of the spring portion 131 is briefly shown, and as one example of the structure of the spring portion 131, a coil spring having a spiral shape with its axis made coincident with a straight line in parallel with the straight line 100A-100B is proposed, as will be explained later.

In the first embodiment, the first pump chamber 107 is designed to be surrounded by the upper wall of the casing unit 102 and the first diaphragm 103, and filled with a fluid that is an object to be transported. On the upper wall of the casing unit 102 forming one portion of the first pump chamber 107, two openings, that is, a first inlet 111*a* that has a first inlet valve 121, with the fluid tube portion 200 being connected thereto, and a first outlet 113*a* that has a first outlet valve 122, with the fluid tube portion 201 being connected thereto, are formed. Moreover, the second pump chamber 108 is designed to be surrounded by the lower wall of the casing unit 102 and the second diaphragm 104, and filled with a fluid that is an object to be transported. The fluid in the first pump chamber 107 and the fluid in the second pump chamber 108 may be the same, or different from each other. On the lower wall of the casing unit 102 forming one portion of the second pump chamber 108, two openings, that is, a second inlet 111*b* that has a second inlet valve 123, with the fluid tube portion 203 being connected thereto, and a second outlet 113*b* that has a second outlet valve 124, with the fluid tube portion 202 being connected thereto, are formed. A ring-shaped space portion 109, surrounded by the first and second diaphragms 103, 104 and the casing unit 102, is defined as an electrolyte chamber. The spring portion 131 is disposed inside this electrolyte chamber 109.

As will be described later, sucking and discharging processes of the fluid are carried out through these openings formed in the first and second pump chambers 107, 108 so that operations of the pump as the fluid transporting device are carried out. In a state shown in FIG. 3, the first diaphragm 103 is expanded, and the second diaphragm 104 is contracted. In this state, a fluid, for example, a solution, located outside the first pump chamber 107, is sucked from the first inlet 111*a* provided with the opened first inlet valve 121 into the first pump chamber 107, and a fluid inside the second pump chamber 108 is discharged outside the second pump chamber 108 through the second outlet 113*b* provided with the opened second outlet valve 124. At this time, the first outlet 113*a* provided with the first outlet valve 122 is closed by the first outlet valve 122, and the second inlet 111*b* provided with the second inlet valve 123 is also closed by the second inlet valve 123. In contrast, in a state where the first diaphragm 103 is contracted and the second diaphragm 104 is expanded, a fluid, for example, a solution, located outside the second pump chamber 108, is sucked from the second inlet 111*b* provided with the opened second inlet valve 123 into the second pump chamber 108, and a fluid inside the first pump chamber 107 is discharged outside the first pump chamber 107 through the first outlet 113*a* provided with the opened first outlet valve 122. At this time, the second outlet 113*b* provided with the second outlet valve 124 is closed by the second outlet valve 124, and the first inlet 111*a* provided with the first inlet valve 121 is also closed by the first inlet valve 121. By carrying out the switching process between these two states continuously, volume increase and decrease of the first pump chamber 107 and the second pump chamber 108 are repeated so that corresponding suction and discharge of the fluids to the respective pump chambers 107 and 108 are repeated. With this arrangement, it is possible to achieve functions of the pumps as a fluid transporting device.

The casing unit 102 has a structure in which a cylindrical shape having, for example, a diameter in a range from 1 cm to 4 cm and a height in a range from 1 cm to 4 cm, with a space formed inside thereof, is provided with through holes formed in specific portions, such as openings, and a cylindrical inner space having a diameter from 0.8 to 3.8 cm and a height from 0.8 to 3.8 cm is formed inside the casing unit 102. In this case, a thickness of the casing unit 102 is preferably set to about 0.2 cm. From the viewpoint of making the tensions of the first and second diaphragms 103, 104 uniform with each other, the shapes of the upper face and the bottom face of the casing unit 102 are preferably formed into round shapes that are smaller than the round shapes of the discs of the first and second diaphragms 103, 104; however, the shapes may be formed into other shapes. The height of the casing unit 102 is preferably designed so that a distance of the two diaphragms 103 and 104 is set within a range explained below. In a case where, upon operating the two diaphragms 103 and 104, the two diaphragms 103 and 104 are made in contact with each other, they might be mutually short-circuited, failing to carry out a normal operation. Moreover, the operations of the first and second diaphragms 103, 104 are limited, with the result that the suction and discharge efficiencies of the pump tend to be lowered. From the above-mentioned points of view, in a case where the two diaphragms 103 and 104 are operated, a distance between the portions of the two diaphragms 103 and 104 that are closest to each other is desirably set to a certain predetermined value or more, so as to prevent the two diaphragms 103 and 104 from being made in contact with each other. In a case where the distance between the portions of the two diaphragms 103 and 104 that are closest to each other is too large, the effects of a voltage drop in the electrolyte located inside the electrolyte chamber 109 between the two diaphragms 103 and 104 become large, with the result that the power consumption becomes large. Moreover, in a case where the distance between the portions of the two diaphragms 103 and 104 that are closest to each other is too large, it becomes difficult to provide a fluid transporting device having a small size. From the above-mentioned reasons, the distance between the portions of the two diaphragms 103 and 104 that are closest to each other is desirably set to a certain value or less. Taking the above-mentioned points into consideration, the distance between the portions of the two diaphragms 103 and 104 that are closest to each other and the height of the casing unit 102 should be desirably designed.

Figure 5:
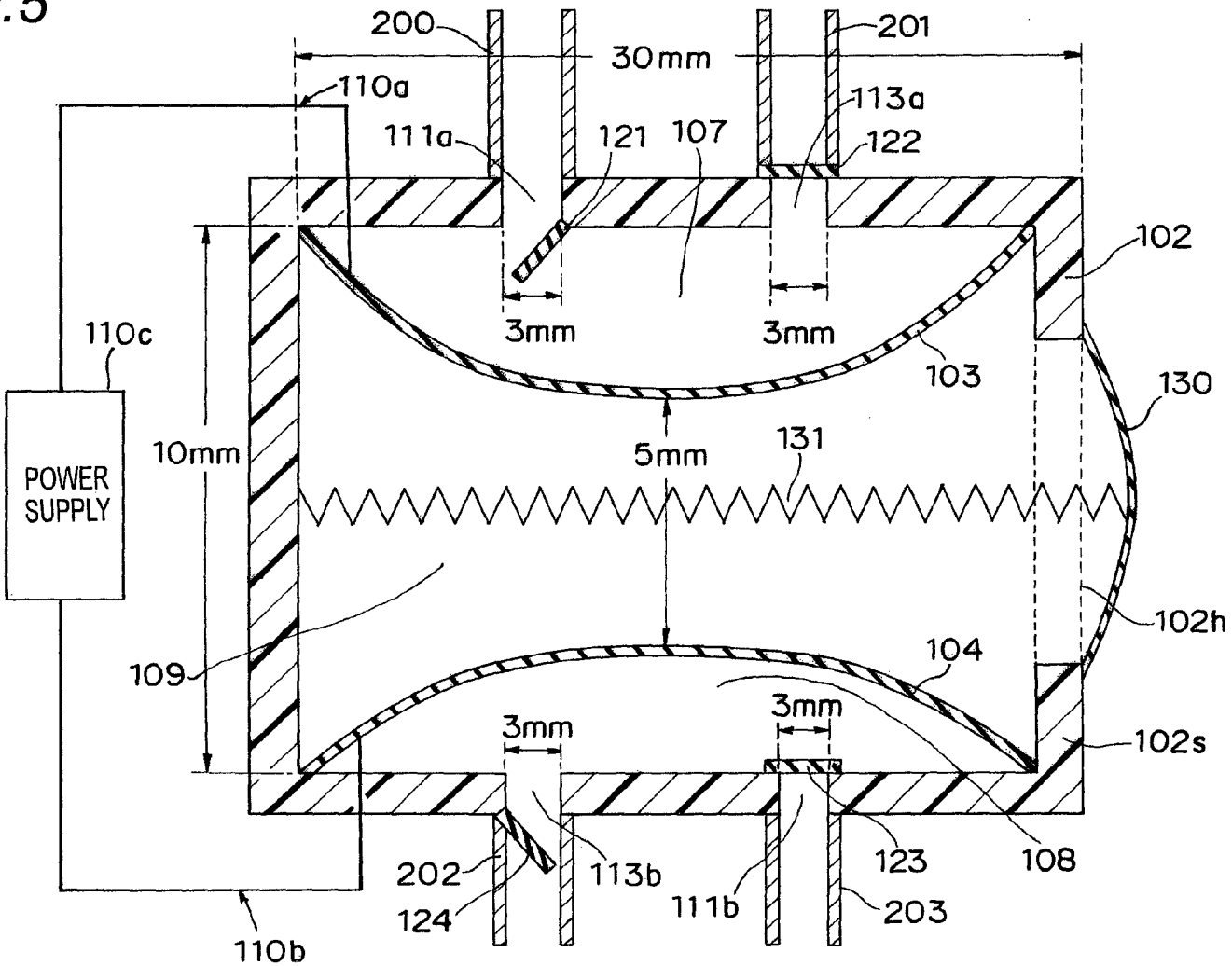
FIG. 5 is a view that shows examples of sizes of the respective portions of the fluid transporting device in accordance with the first embodiment of the present invention.

FIG. 5 is a view that shows a specific example of the size of each of the portions of the fluid transporting device of the first embodiment. The inner space of the casing unit 102 is divided into three spaces by the two diaphragms 103 and 104, thereby respectively forming the first pump chamber 107, the electrolyte chamber 109 and the second pump chamber 108. One portion or the entire portions of the diaphragms 103 and 104 are made by a polymer actuator material, and formed into a disc shape having, for example, a thickness of 5 μm to 30 μm and a diameter of 1 cm to 4.5 cm. In the first embodiment, as shown in FIGS. 3 and 5, the diaphragms 103 and 104 are used in a warped state with a convex shape so that in this state, the size of the diaphragms 103 and 104 is larger than the bottom face of the inner space of the casing unit 102. In FIG. 5, the diameter of each of the first inlet 111*a*, the second inlet 111*b*, the first outlet 113*a* and the second outlet 113*b* is set to 3 mm, the height of the casing unit 102 is 10 mm, and a distance from the outer face of the side wall 102*s* of the casing unit 102 on which the elastic film portion 130 is formed to the inner face of the side wall 102 that is opposed to the side wall 102 of the casing unit 102 (in other words, a total distance of a distance of the inner space of the casing unit 102 along a diameter direction of the bottom face in the inner space of the casing unit 102 and a thickness of the side wall 102*s* of the casing unit 102) is set to 30 mm.

The polymer actuator material forming the first and second diaphragms 103, 104, which is a material of a conductive polymer film capable of exerting electrochemomechanical expansion and contraction, and specific examples thereof include: polypyrrole and polypyrrole derivatives, polyaniline and polyaniline derivatives, polythiophene and polythiophene derivatives, and (co)polymers made from at least one kind or two kinds selected from these. In particular, as the polymer actuator material, polypyrrole, polythiophene, poly N-methylpyrrole, poly 3-methylthiophene, poly methoxythiophene, poly (3,4-ethylene dioxythiophene) and (co) polymers made from at least one kind or a plurality of kinds of these are preferably used. Moreover, a conductive polymer film, including these materials, is preferably used, with negative ions (anions), such as phosphoric acid hexafluoride ions ($PF_6^-$), p-phenol sulfonate ions (PPS), dodecyl benzene sulfonate ions (DBS), or polystyrene sulfonate ions (PSS) being doped therewith. In such a doped state, the conductive polymer film is allowed to have a conductive property and exert a function as a polymer actuator. These conductive polymer films may be prepared through processes in which, after having been synthesized by a chemical polymerization or an electrolytic polymerization, the resulting matter is subjected to a molding process, if necessary.

The following description will discuss a thickness of the diaphragms 103 and 104 formed by the polymer actuator material. In a case where the diaphragm formed by the polymer actuator material is thick, it is possible to obtain a large force by the work caused by the electrochemomechanical expansion and contraction of the polymer actuator. In contrast, in a case where the diaphragm formed by the polymer actuator is thin, since incoming and outgoing movements of ions to and from the polymer actuator are exerted quickly, it is possible to provide a high-speed pumping operation. By taking these points into consideration, the thickness of the diaphragm formed by the polymer actuator is desirably designed. From the above-mentioned viewpoints, for example, the respective thicknesses of the diaphragms 103 and 104 are preferably set in a range from 0.1 to 1000 μm, in particular, more preferably, from 1 μm to 100 μm.

Moreover, in a case where the area of the diaphragm formed by the polymer actuator is made larger, it becomes possible to increase the amount of work caused by the electrochemomechanical expansion and contraction of the polymer actuator. Furthermore, in a case where the area of the diaphragm formed by the polymer actuator is made smaller, since the volume of the casing unit to be required can be made smaller, the fluid transporting device can be made to have a small size. By taking these points into consideration, the area of the diaphragm formed by the polymer actuator is desirably designed. From the above-mentioned viewpoints, for example, the respective areas of the diaphragms 103 and 104 are preferably set in a range from 0.01 $cm^2$ to 1000 $cm^2$, in particular, from 0.1 $cm^2$ to 100 $cm^2$.

The electrolyte chamber 109 is filled with an electrolyte. In this case, the electrolyte is defined as a liquid-state substance having an electrolytic property, and prepared as a solution having an electric conductivity, made by dissolving, for example, an ionic substance in a polar solvent, such as water, or a solution including ions (ionic solution). Examples of the electrolyte include: $NaPF_6$, $TBAPF_6$, HCl, or a solution prepared by dissolving an electrolyte such as NaCl in water or an organic solvent, such as propylene carbonate, or an ionic solution, such as $BMIPF_6$.

One end of each of the wiring portions 110*a* and 110*b* is connected to each of the diaphragms 103 and 104. The other end of each of the wiring portions 110*a* and 110*b* is connected to a power supply 110*c*. A fluid that is subjected to sucking and discharging operations by the pump serving as the fluid transporting device is loaded into the first pump chamber 107 and the second pump chamber 108. As the fluid that is subjected to sucking and discharging operations, for example, water is proposed. The casing unit 102 is formed by using a material having resistance to an electrolyte, and examples thereof include a material containing a polycarbonate resin or an acrylic resin, or a material formed by carrying out a surface curing treatment on such a material.

The first inlet 111*a* and the second inlet 111*b* have the first inlet valve 121 and the second inlet valve 123, and are designed so that fluids are allowed to respectively flow from the outside of the pump chambers 107 and 108 toward the pump chambers 107 and 108 only in a sucking direction. The first outlet 113*a* and the second outlet 113*b* have the first outlet valve 122 and the second outlet valve 124, and are designed so that fluids are allowed to respectively flow from the pump chambers 107 and 108 toward the outside of the pump chambers 107 and 108 only in a discharging direction. The shapes of the respective inlets and outlets are designed by taking into consideration a pressure or a flow rate, and a viscosity of the fluid that are required for sucking or discharging the fluid.

The voltage of the power supply 110*c* is allowed to change, for example, within ±1.5V as a sine wave or a rectangular wave. Thus, between the diaphragms 103 and 104, a voltage that periodically changes is applied. Upon application of a positive voltage to one of the diaphragms 103 or 104, the conductive polymer film that forms the diaphragm 103 or 104 is oxidized. Accordingly, changes occur in which positive ions (cations) are released from the conductive polymer film of one of the diaphragms 103 or 104, or in which negative ions (anions) are introduced into the conductive polymer film of one of the diaphragms 103 or 104. With this arrangement, a deformation, such as contraction or expansion (swelling), occurs in the conductive polymer film of one of the diaphragms 103 or 104. In contrast, upon application of a negative voltage to one of the diaphragms 103 or 104, the conductive polymer film forming the diaphragm 103 or 104 is reduced. As a result, changes occur in which positive ions (cations) are introduced into the conductive polymer film of one of the diaphragms 103 or 104, or in which negative ions are released from the conductive polymer film of one of the diaphragms 103 or 104. With this arrangement, a change such as expansion (swelling) or contraction occurs in the conductive polymer film of one of the diaphragms 103 or 104.

FIGS. 6A, 6B, 6C and 6D are views that show operations of a pump when a periodic sine wave voltage is applied thereto by the power supply 110*c*. Suppose that the amplitude of the sine wave voltage is V. These FIGS. 6A to 6D show examples in which deformations due to the expansion and contraction of the respective conductive polymer films of the diaphragms 103 and 104 are exerted mainly by outgoing and incoming movements of negative ions. Additionally, in FIGS. 6A to 6D, for easiness of understanding, the size of a negative ion 99 is shown in an enlarged manner relative to the diaphragms 103 and 104.

Figure 6A:
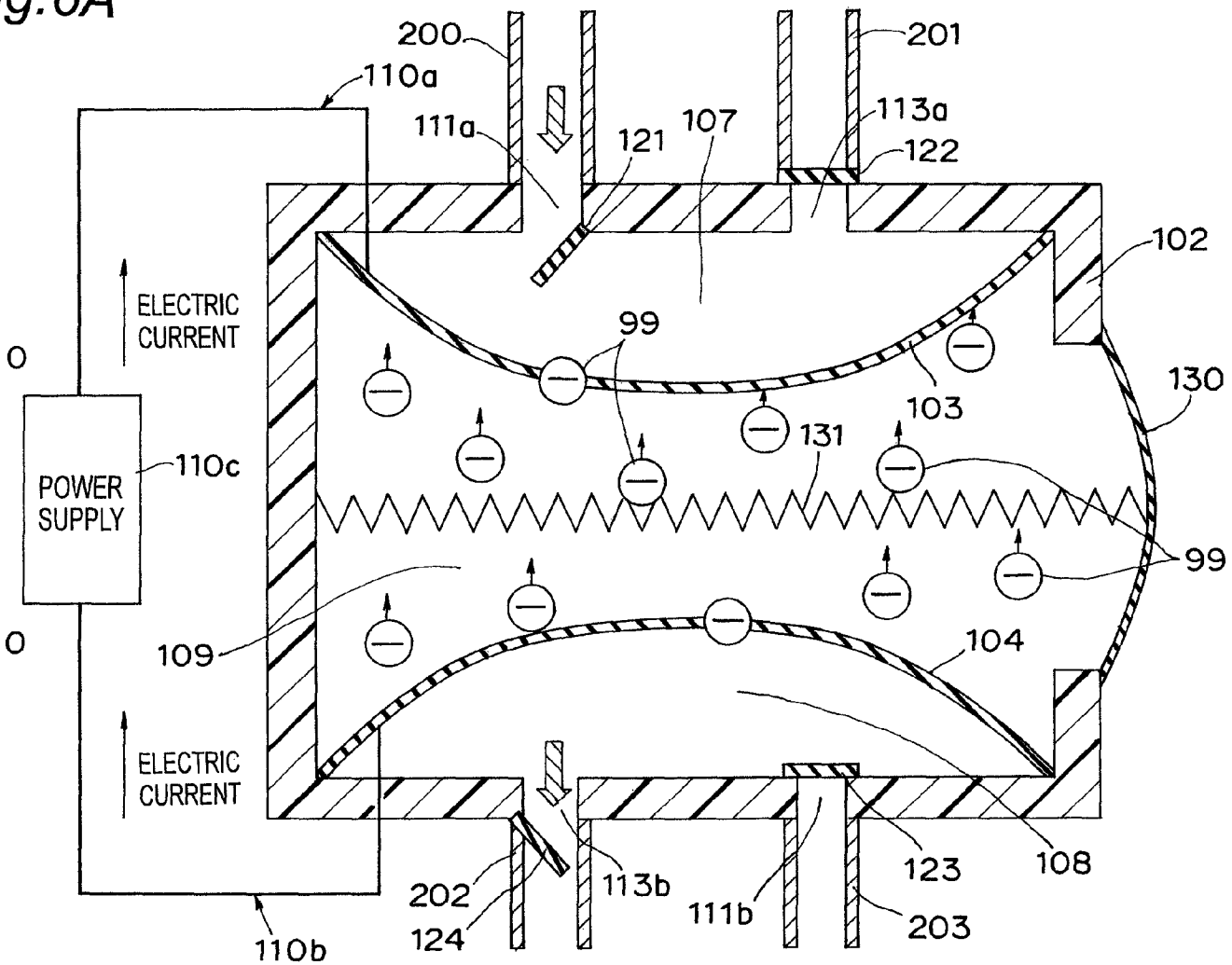
FIG. 6A is an operation diagram that shows operations of a pump upon application of a periodic sine-wave voltage by a power supply in the fluid transporting device in accordance with the first embodiment of the present invention.

In FIG. 6A, both of the voltages of the first diaphragm 103 and the second diaphragm 104 are 0. That is, the first diaphragm 103 and the second diaphragm 104 have equal electric potentials.

Figure 6B:
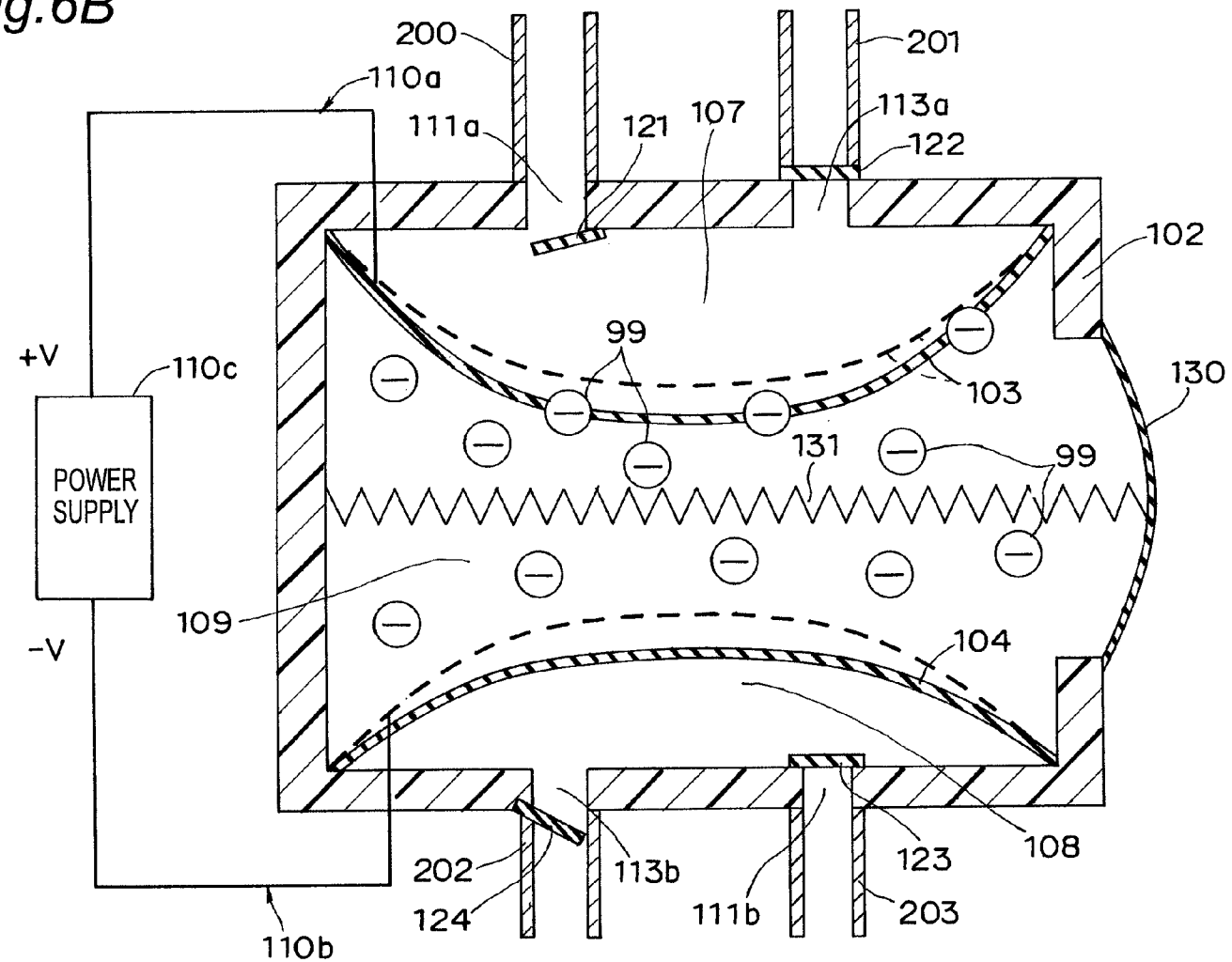
FIG. 6B is another operation diagram that shows operations of a pump upon application of a periodic sine-wave voltage by a power supply in the fluid transporting device in accordance with the first embodiment of the present invention.

In FIG. 6B, a positive voltage (+V) is applied to the first diaphragm 103 from the power supply 110*c*, and a negative voltage (−V) is applied to the second diaphragm 104 from the power supply 110*c*.

Figure 6C:
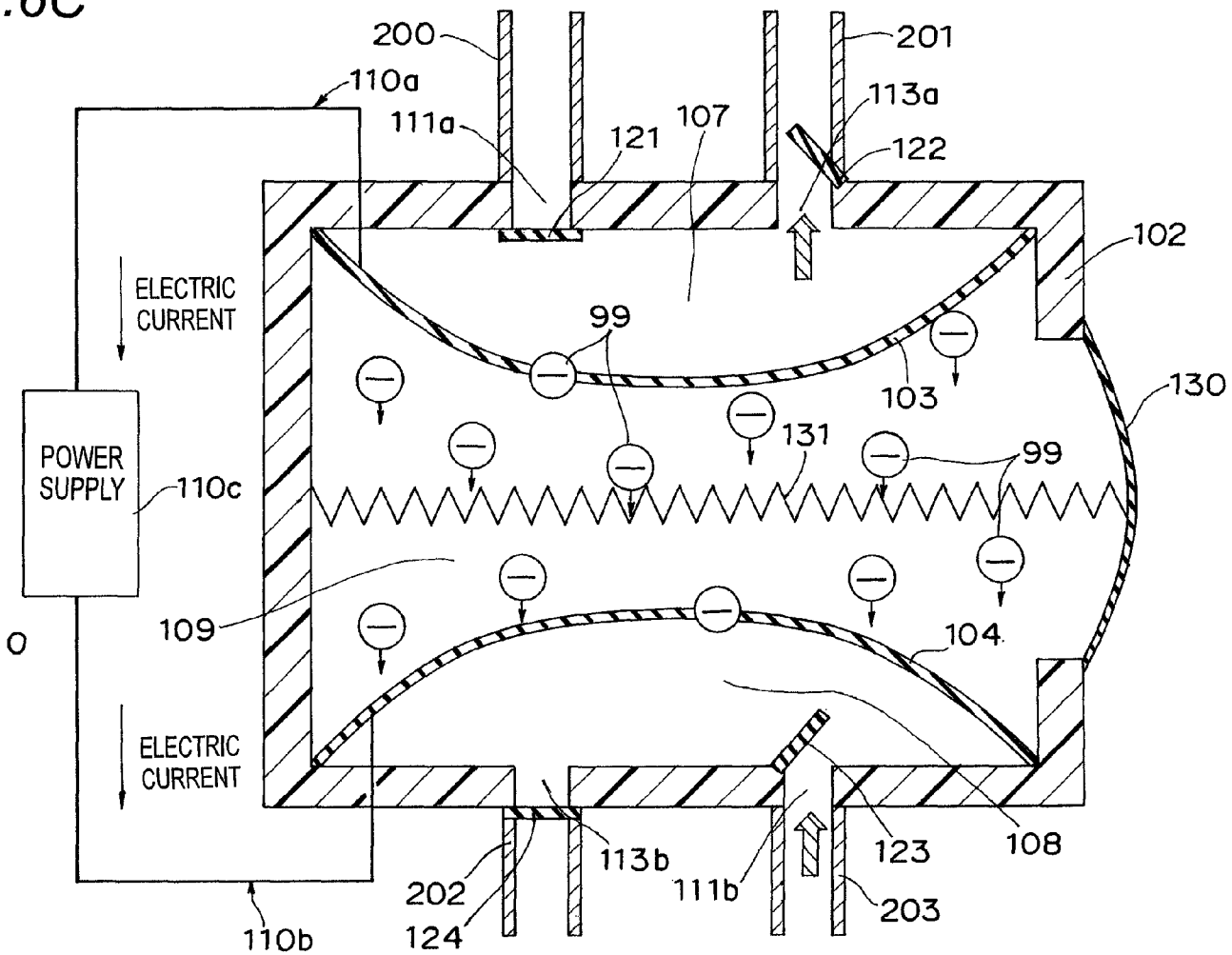
FIG. 6C is still another operation diagram that shows operations of a pump upon application of a periodic sine-wave voltage by a power supply in the fluid transporting device in accordance with the first embodiment of the present invention.

In FIG. 6C, both of the voltages of the first diaphragm 103 and the second diaphragm 104 are 0. That is, the first diaphragm 103 and the second diaphragm 104 have equal electric potentials.

Figure 6D:
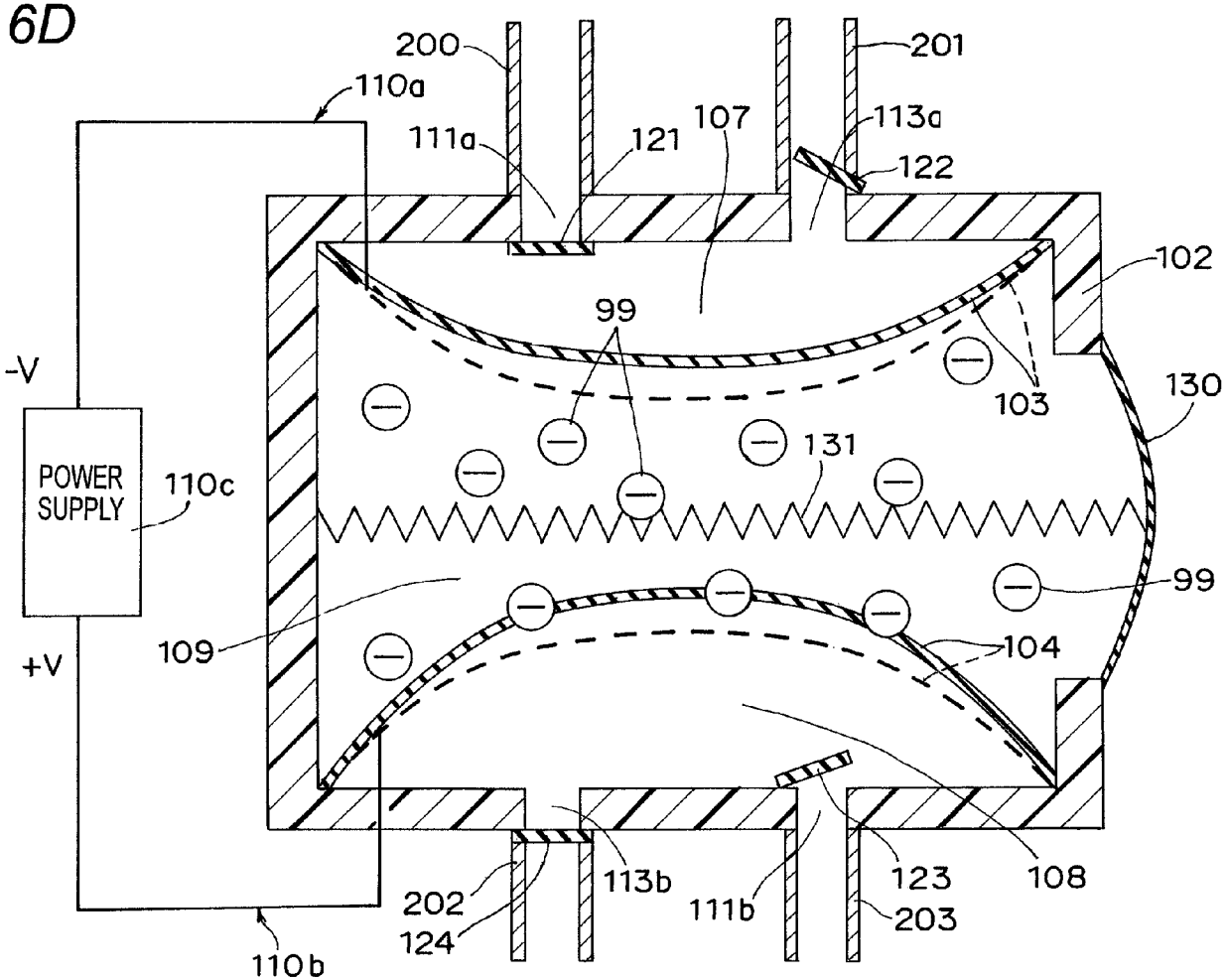
FIG. 6D is the other operation diagram that shows operations of a pump upon application of a periodic sine-wave voltage by a power supply in the fluid transporting device in accordance with the first embodiment of the present invention.

In FIG. 6D, a negative voltage (−V) is applied to the first diaphragm 103 from the power supply 110*c*, and a positive voltage (+V) is applied to the second diaphragm 104 from the power supply 110*c*.

Now, suppose that states are periodically changed as indicated by FIGS. 6A→6B→6C→6D→6A→6B→6C→6D→ . . . .

In FIG. 6A, the first diaphragm 103 and the second diaphragm 104 have the equal electric potentials, and negative ions 99 contained in the electrolyte inside the electrolyte chamber 109 are distributed substantially uniformly inside the electrolyte. However, since the electric potential of the first diaphragm 103 is increasing, with the result that the oxidizing process of the conductive polymer film forming the first diaphragm 103 progresses. That is, for example, supposing that the electric potential V(t) of the first diaphragm 103 at time t is represented by $V\times\sin(\omega t)$, and that this state is turned into a state shown in FIG. 6A at time 0, it is found that the electric potential is increasing in the state shown in FIG. 6A, because in the state of FIG. 6A, the electric potential of the first diaphragm 103 is 0, with a derived function of V(t) being set to $V\omega$ at time 0. Accordingly, negative ions (anions) 99 contained in the electrolyte are attracted to the first diaphragm 103, and some of the negative ions (anions) 99 are introduced into the first diaphragm 103. As a result, the first diaphragm 103 is expanded. Since, along with the expansion of the first diaphragm 103, the volume of the first pump chamber 107 increases, the first inlet valve 121 is opened, with the result that the fluid is allowed to flow into the first pump chamber 107 from the outside of the first pump chamber 107 through the first inlet 111*a*. Moreover, since the electric potential of the first diaphragm 103 is increasing, with the electric potential of the second diaphragm 104 being simultaneously degreased, the reducing process of the conductive polymer film forming the second diaphragm 104 progresses. Accordingly, the negative ions (anions) 99 are leaked into the electrolyte from the conductive polymer film forming the second diaphragm 104. As a result, the second diaphragm 104 is contracted. Since, along with the contraction of the second diaphragm 104, the volume of the second pump chamber 108 decreases, the second outlet valve 124 is opened, with the result that the fluid inside the second pump chamber 108 is allowed to flow outside the second pump chamber 108 through the second outlet 113*b*. Additionally, the structure of the fluid transporting device is designed to function as a capacitance, when viewed from the power supply 110*c*. In the state shown in FIG. 6A, since the electric potential of the first diaphragm 103 relative to the second diaphragm 104 is increasing, an electric current is allowed to flow from the outside to the first diaphragm 103 in the above-mentioned capacitance in such a direction as to store positive charge.

Additionally, movements of the elastic film portion 130 and the spring portion 131 will be described later in detail.

Next, in FIG. 6B, a positive voltage (+V) is applied to the first diaphragm 103 from the power supply 110*c*, and a negative voltage (−V) is applied to the second diaphragm 104 from the power supply 110*c*. In this state, the conductive polymer film forming the first diaphragm 103 is oxidized so that accordingly, negative ions (anions) 99 contained in the electrolyte are attracted to the first diaphragm 103. Moreover, some of the negative ions (anions) 99 are introduced into the conductive polymer film forming the first diaphragm 103. As a result, the first diaphragm 103 is expanded. In FIG. 6B, for comparison, the position of the first diaphragm 103 in FIG. 6A is indicated by a dotted line.

As an example for explanation, supposing that the electric potential V(t) of the first diaphragm 103 at time t is represented by $V\times\sin(\omega t)$, that this state is turned into a state shown in FIG. 6A at time 0, and that the resulting state is further turned into a state shown in FIG. 6B at time $\pi/(2\omega t)$. In this case, in the state of FIG. 6B, the electric potential of the first diaphragm 103 corresponds to a maximum value V so that accordingly, the first diaphragm 103 has been brought to the most expanded state. Moreover, since the derived function of V(t) is 0 at time $\pi/(2\omega t)$, there is no change in electric potential in the state of FIG. 6B, and the velocity of the first diaphragm 103 consequently becomes zero, setting the flow rates of the suction and discharge of the fluid to and from the pump to 0. In this case, however, for simplicity of explanation, it is supposed that, by ignoring the viscosity and the like of the ionic solution or the fluid, the expansion and contraction of the diaphragm 103 are carried out in synchronism with the change in voltage, with the discharge and suction of the fluid being carried out in synchronism with the deforming velocity of the diaphragm 103.

Moreover, the conductive polymer film forming the diaphragm 104 has been reduced, with the result that negative ions (anions) 99 have been released into the electrolyte from the conductive polymer film forming the second diaphragm 104. As a result, the second diaphragm 104 has been contracted. In FIG. 6B, for comparison, the position of the second diaphragm 104 in FIG. 6A is indicated by a dotted line. In this case, however, since the change in electric potential is substantially 0, changes in the shapes of the first and second diaphragms 103, 104 or the distribution of negative ions 99 are substantially 0, and the incoming and outgoing fluids to and from the first pump chamber 107 and the second pump chamber 108 are also set to substantially 0. Moreover, the first diaphragm 103 is kept in the most expanded state, and the second diaphragm 104 is kept in the most contracted state.

Upon consideration of the respective amounts of expansion of the first and second diaphragms 103, 104 from the state of FIG. 6A, in the state shown in FIG. 6B, the amount of expansion of the first diaphragm 103 has a positive value, with the value forming the maximum value within a cycle, while the amount of expansion of the second diaphragm 104 has a negative value, with the value forming the minimum value within the cycle. Moreover, the electric current flowing from the power supply 110*c* is set to substantially 0. In this state, the flow of the fluid is also set to substantially 0.

In FIG. 6C, the first diaphragm 103 and the second diaphragm 104 have an equal electric potential, and negative ions 99 contained in the electrolyte are distributed substantially uniformly inside the electrolyte. However, since the electric potential of the second diaphragm 104 is increasing, with the result that the oxidizing process of the conductive polymer film forming the second diaphragm 104 progresses. Accordingly, negative ions (anions) 99 contained in the electrolyte are attracted to the second diaphragm 104, and some of the negative ions (anions) 99 are introduced into the second diaphragm 104. As a result, the second diaphragm 104 is expanded. Since, along with the expansion of the second diaphragm 104, the volume of the second pump chamber 108 increases, the second inlet valve 123 is opened, with the result that the fluid is allowed to flow into the second pump chamber 108 from the outside of the second pump chamber 108 through the second inlet 111*b*. Moreover, since the electric potential of the first diaphragm 103 is decreasing, the reducing process of the conductive polymer film forming the first diaphragm 103 progresses. Accordingly, the negative ions (anions) 99 are leaked into the electrolyte from the conductive polymer film forming the first diaphragm 103. As a result, the first diaphragm 103 is contracted. Since, along with the contraction of the first diaphragm 103, the volume of the first pump chamber 107 decreases, the first outlet valve 122 is opened, with the result that the fluid inside the first pump chamber 107 is allowed to flow outside the first pump chamber 107 through the first outlet 113*a*. Additionally, the structure of the fluid transporting device is designed to function as a capacitance, when viewed from the power supply 110*c*. In the state shown in FIG. 6C, since the electric potential of the second diaphragm 104 relative to the first diaphragm 103 is increasing, an electric current is allowed to flow from the outside to the first diaphragm 104 in the above-mentioned capacitance in such a direction as to store positive charge. Moreover, the positions of the first and second diaphragms 103, 104 in the state of FIG. 6C are substantially the same as those positions of the first and second diaphragms 103, 104 in FIG. 6A.

In FIG. 6D, a positive voltage (+V) is applied to the second diaphragm 104 from the power supply 110*c*, and a negative voltage (−V) is applied to the first diaphragm 103 from the power supply 110*c*. In this state, the conductive polymer film forming the second diaphragm 104 is oxidized so that accordingly, negative ions (anions) 99 contained in the electrolyte are attracted to the second diaphragm 104. Moreover, some of the negative ions (anions) 99 are introduced into the conductive polymer film forming the second diaphragm 104. As a result, the second diaphragm 104 is expanded. In FIG. 6D, for comparison, the positions of the first diaphragm 103 and second diaphragm 104 in FIG. 6A are indicated by dotted lines. Moreover, the conductive polymer film forming the diaphragm 103 has been reduced, with the result that negative ions (anions) 99 have been released into the electrolyte from the conductive polymer film forming the first diaphragm 103. As a result, the first diaphragm 103 has been contracted. In this case, however, since the change in electric potential is substantially 0, changes in the shapes of the first and second diaphragms 103, 104 or the distribution of negative ions 99 are substantially 0, and the incoming and outgoing fluids to and from the first pump chamber 107 and the second pump chamber 108 are also set to substantially 0. Moreover, the first diaphragm 103 is kept in the most contracted state, and the second diaphragm 104 is kept in the most expanded state.

Upon consideration of the respective amounts of expansion of the first and second diaphragms from the state of FIG. 6A, in the state shown in FIG. 6D, the amount of expansion of the first diaphragm 103 has a negative value, with the value forming the minimum value within a cycle, while the amount of expansion of the second diaphragm 104 has a positive value, with the value forming the maximum value within the cycle. Moreover, the electric current flowing from the power supply 110*c* is set to substantially 0. In this state, the flow of the fluid is also set to substantially 0.

By repeating the above-mentioned operations, the suction and discharge of the fluid are carried out. Additionally, with respect to the mechanism of deformations of the conductive polymer film, various reasons, such as a volume increase caused by insertion of ions, electrostatic repulsion between ions of the same kind and shape changes of molecules due to non-localization of n-electrons, are assumed; however, the detailed mechanism has not been clarified completely.

In the above-mentioned explanation, for convenience of explanation, it is supposed that the electric potentials of the first and second diaphragms 103, 104, the quantity of charge to be stored in the structure of the fluid transporting device and the amounts of expansion of the first and second diaphragms 103, 104 are allowed to change in the same phase; however, in actual operations, due to influences from the viscosity of the fluid, or resistance of the wiring portion and the power supply, or resistance of contact portions between the conductive polymer film and the wiring portion, or inner resistance of the conductive polymer film, or resistance due to charge movements, or impedance indicating ion diffusion into the conductive polymer film, or solution resistance, or the like, phase differences tend to occur among the electric potentials between the first and second diaphragms 103, 104, the quantity of charge to be stored in the structure of the fluid transporting device and the amounts of expansion of the first and second diaphragms 103, 104.

In the first embodiment, since the electrolyte chamber 109 is filled with an electrolyte, and since, in general, the electrolyte is a non-compressive fluid, the volume of the electrolyte chamber 109 is kept substantially constant during pump operations. For this reason, when one of the diaphragms 103 or 104 is contracted to make the swelling portion of the convex shape smaller, the other diaphragm 104 or 103 receives such a force as to make the swelling portion of its convex shape larger, in order to keep the volume of the electrolyte chamber 109 substantially constant. That is, the two sheets of first and second diaphragms 103, 104 carry out energy exchanges mutually as work exchanges through the electrolyte.

Next, the following description will discuss the structures of the elastic film portion 130 and the spring portion 131.

The elastic film portion 130 is secured in a manner so as to seal a round through hole 102*h* formed on a side face 102*s* of the casing unit 102, and is formed into a round film shape by using a material (elastic material) such as rubber or a synthetic resin (plastics) having elasticity. For example, silicone rubber or the like is proposed as the elastic material forming the elastic film portion 130.

The spring portion 131 has a shape in which, for example, a metal or synthetic resin material having elasticity is wound up into a helical shape, and has a function as a coil spring. Moreover, the spring portion 131 has its axis of the helical shape designed so as to be mounted on a straight line in parallel with a straight line 100A-100B shown in FIG. 1. The spring portion 131 is secured in such a manner that its two ends are made in contact with the elastic film portion 130 and the side wall 102*s* of the casing unit 102 that is opposed to the elastic film portion 130, in its contracted state from the normal state. The elastic film portion 130 receives an outward force relative to the casing unit 102 from the spring portion 131 so that it is deformed into a convex shape protruding outward. That is, as shown in FIG. 3 or the like, the elastic film portion 130 receives a rightward force from the spring portion 131, and is consequently deformed into a convex shape protruding rightward. Although the elastic film portion 130 has a shape close to one portion of a spherical surface in FIG. 1 or the like, it sometimes has another shape such as a shape similar to a cone in a case where, for example, the film thickness of the elastic film portion 130 is small.

In the initial state of the fluid transporting device, the fluid transporting device is designed so that the pressure of the electrolyte filled in the electrolyte chamber 109 is set to the following range. That is, on the assumption of a pressure to be applied to the first pump chamber 107 and the second pump chamber 108 during pump operations, the fluid transporting device is designed so that the pressure of the electrolyte in the initial state becomes smaller than the assumed pressure. With this arrangement, in a case where the assumed pressure is applied to the first pump chamber 107 and the second pump chamber 108, the first and second diaphragms 103, 104 are maintained in a state having a convex shape when viewed in the direction of the electrolyte chamber 109 as shown in FIG. 3. As the method for maintaining the pressure of the electrolyte filled inside the electrolyte chamber 109 within the above-mentioned range, for example, a method is proposed in which, upon assembling the respective portions of the fluid transporting device with an electrolyte filled therein, a small through hole 102*g* is preliminarily formed on the side wall 102*s* of the casing unit 102, and one portion of the electrolyte is drawn from the small through hole 102*g* by using a tool such as a syringe, and by sealing the small through hole 102*g* by using a sealing member 102*f* such as a rubber stopper, the pressure of the electrolyte is set to a predetermined pressure (that is, the pressure of the electrolyte in the initial state is made smaller than the pressure to be applied to the first pump chamber 107 and the second pump chamber 108 during pump operations). Moreover, another method is proposed in which, upon assembling the respective portions of the fluid transporting device with an electrolyte filled therein, a gap is formed in one portion between the casing unit 102 and the elastic film portion 130, and in this state, by pushing the elastic film portion 130 therein, one portion of the electrolyte is drawn, and the gap portion is then sealed, and by removing the pushing force of the elastic film portion 130, the elastic film portion 130 and the spring portion 131 are allowed to exert forces to try to return to their original shapes by their elastic forces so that the pressure of the electrolyte is reduced to set the pressure of the electrolyte to a predetermined pressure (that is, the pressure of the electrolyte in the initial state is made smaller than the pressure to be applied to the first pump chamber 107 and the second pump chamber 108 during pump operations). Additionally, an air hole may be formed so as to remove the inner air upon injecting an electrolyte into the electrolyte chamber 109, and after finishing the injection, the air hole may be sealed.

In the fluid transporting device using such diaphragms 103 and 104, when the diaphragms 103 and 104 are slackened, the force to be exerted when the conductive polymer film is contracted is not transmitted efficiently to the fluid in the pump chamber so that the force is released to escape. For this reason, it is important to maintain the diaphragms 103 and 104 in an expanded state without being slackened during pump operations. In the fluid transporting device in accordance with the first embodiment of the present invention, in a case where the pressure of the electrolyte is made smaller than the pressure of the fluid inside the first and second pump chambers 107, 108 in the initial state, it is possible to maintain the pressure of the electrolyte in a level smaller than the pressure of the fluid inside the first and second pump chambers 107, 108 during pump operations as well, by the functions of the elastic film portion 130 and the spring portion 131 which will be described later. With this arrangement, since, upon operation of the pump, forces are applied from the first and second pump units 107, 108 toward the electrolyte chamber 109 in the first and second diaphragms 103, 104, it is possible to maintain the first and second diaphragms 103, 104 in the expanded state without being slackened by using these forces. With this arrangement, since the forces of the electrochemomechanical expansion and contraction of the conductive polymer film can be transmitted to the fluid inside the first and second pump chambers 107, 108 efficiently, it is possible to maintain the efficiency of the discharge and suction of the fluid in a high level.

Next, the following description will discuss the operations of the elastic film portion 130 and the spring portion 131. As will be explained below in detail, the elastic film portion 130 and the spring portion 131 have functions so as to appropriately maintain tensions of the first and second diaphragms 103, 104. This structure makes it possible to improve the operation efficiency of the pumps.

As explained earlier, in the pump of the related art, the tension of the diaphragm is greatly changed due to the following two mechanisms to cause a problem in that the operation efficiency of the pump is lowered. In the pump of the related art, the first mechanism to cause a change in the tension of the diaphragm is derived from periodic electrochemomechanical expansion and contraction of the conductive polymer film that are exerted during pump operations. In the pump of the related art, the second mechanism to cause a change in the tension of the diaphragm is derived from reasons other than the periodic electrochemomechanical expansion and contraction of the conductive polymer film. In the first embodiment of the present invention, even in a case where the tensions of the first and second diaphragms 103, 104 are changed due to the periodic electrochemomechanical expansion and contraction of the conductive polymer film that are exerted during pump operations, or when the tensions of the first and second diaphragms 103, 104 are changed due to reasons other than this, it is possible to maintain the tensions of the diaphragms 103 and 104 appropriately.

First, the following description will explain functions of the elastic film portion 130 and the spring portion 131 by which, in a case where the conductive polymer film carries out periodic electrochemomechanical expansion and contraction during pump operations, the tensions of the first and second diaphragms 103, 104 can be appropriately maintained.

Figure 7:
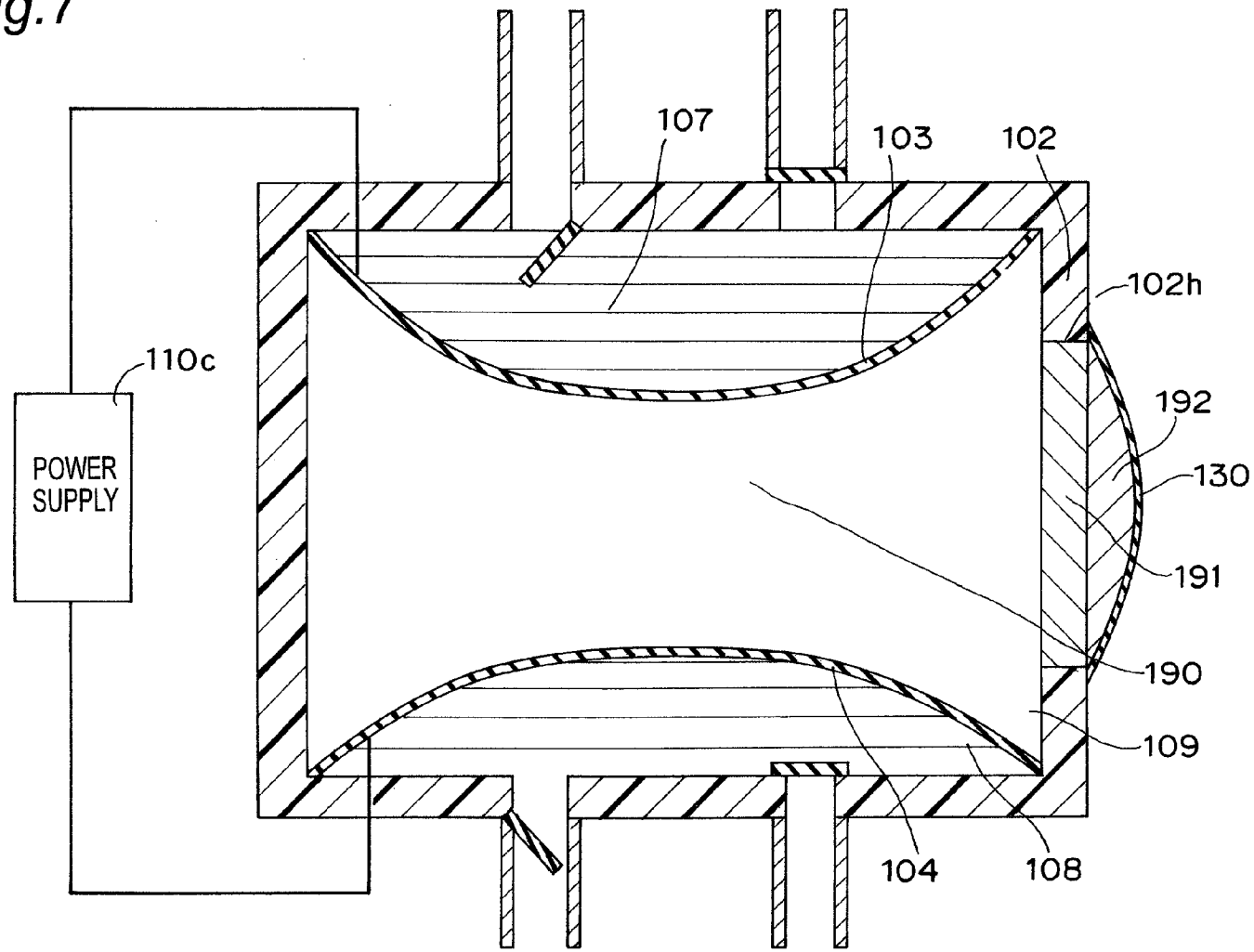
FIG. 7 is a block diagram of the fluid transporting device in accordance with the first embodiment of the present invention.

Now, attention is drawn to the inner space of the casing unit 102. The inner space of the casing unit 102 refers to a cylindrical space formed inside the casing unit 102. As shown in FIG. 7, in the inner space of the casing unit 102, it is defined that portions from which the portions of the first pump chamber 107 and the second pump chamber 108 are excluded are defined as an electrolyte chamber inner-casing unit portion 190. That is, the electrolyte chamber inner-casing unit portion 190 corresponds to a space portion sandwiched by the first and second diaphragms 103, 104 in the inner space of the casing unit 102. Moreover, a space portion, positioned at a portion of the through hole **102*h* of the side wall 102*s* of the casing unit 102 and indicated by reference numeral 191 in FIG. 7, is defined as an opening space portion 191. Moreover, a space portion, positioned outside the casing unit 102 corresponding to the portion of the through hole 102*h* and surrounded by the elastic film portion 130, is defined as an elastic film inner-side space portion 192. At this time, the volume of the electrolyte chamber 109 is defined as a sum of the volume of the electrolyte chamber inner-casing unit portion 190, the volume of the opening space portion 191 and the elastic film inner-side space portion 192**.

As described earlier, in a case where the first and second diaphragms 103, 104 become a slackened state during pump operations, even if the conductive polymer films of the first and second diaphragms 103, 104 are expanded and contracted, the resulting force is released to escape, and is not transmitted efficiently to the fluid, for example, a solution, in the pump chambers 107 and 108 so that the efficiency of the suction and discharge of the fluid is extremely lowered. That is, in order to improve the operation efficiency of the pumps, it is important to always maintain the diaphragms 103 and 104 in an expanded state without being slackened during operations.

Figure 25A:
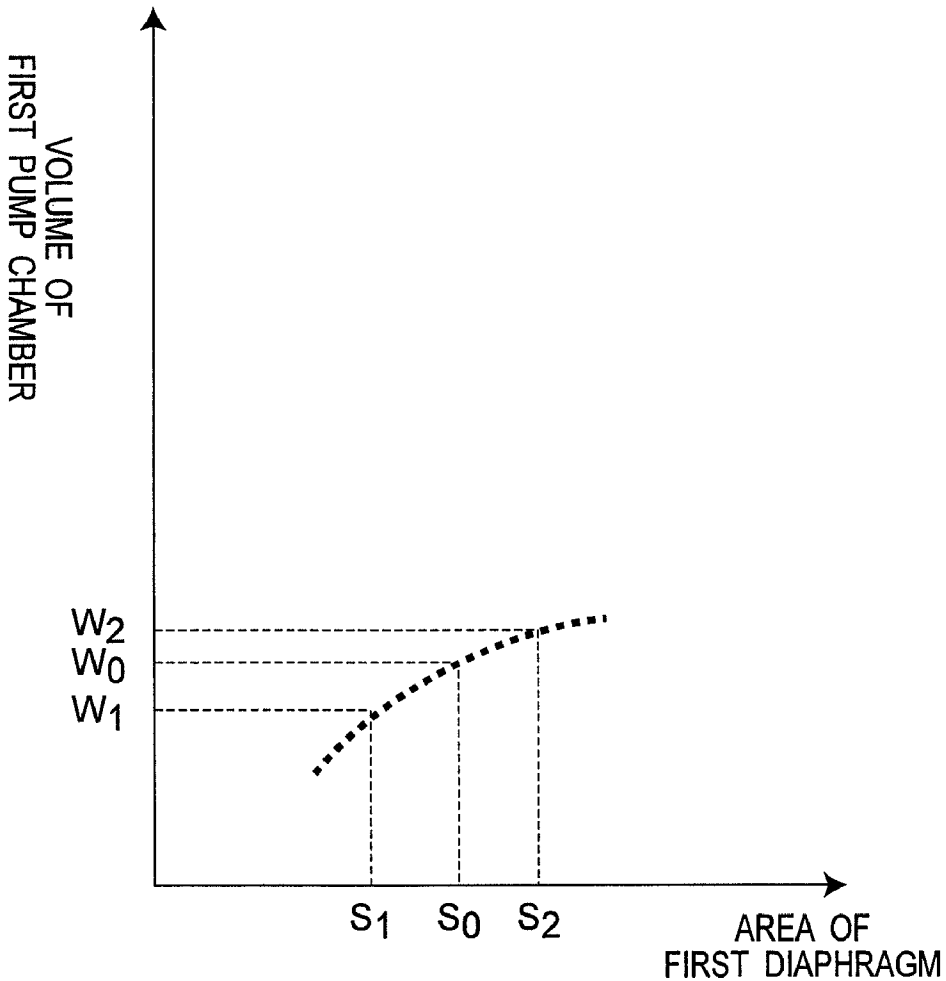
FIG. 25A is a view that shows a relationship between the area and volume of each of the portions of the pump.
Figure 25B:
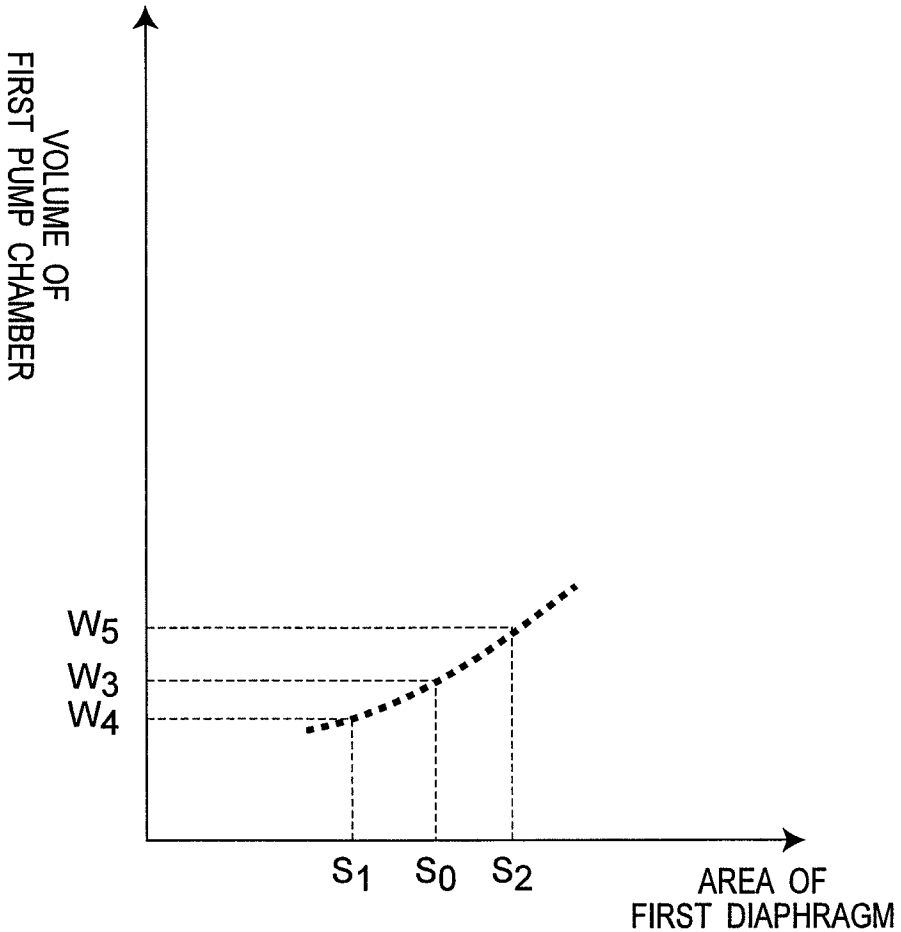
FIG. 25B is a view that shows a relationship between the area and volume of each of the portions of the pump.
Figure 25C:
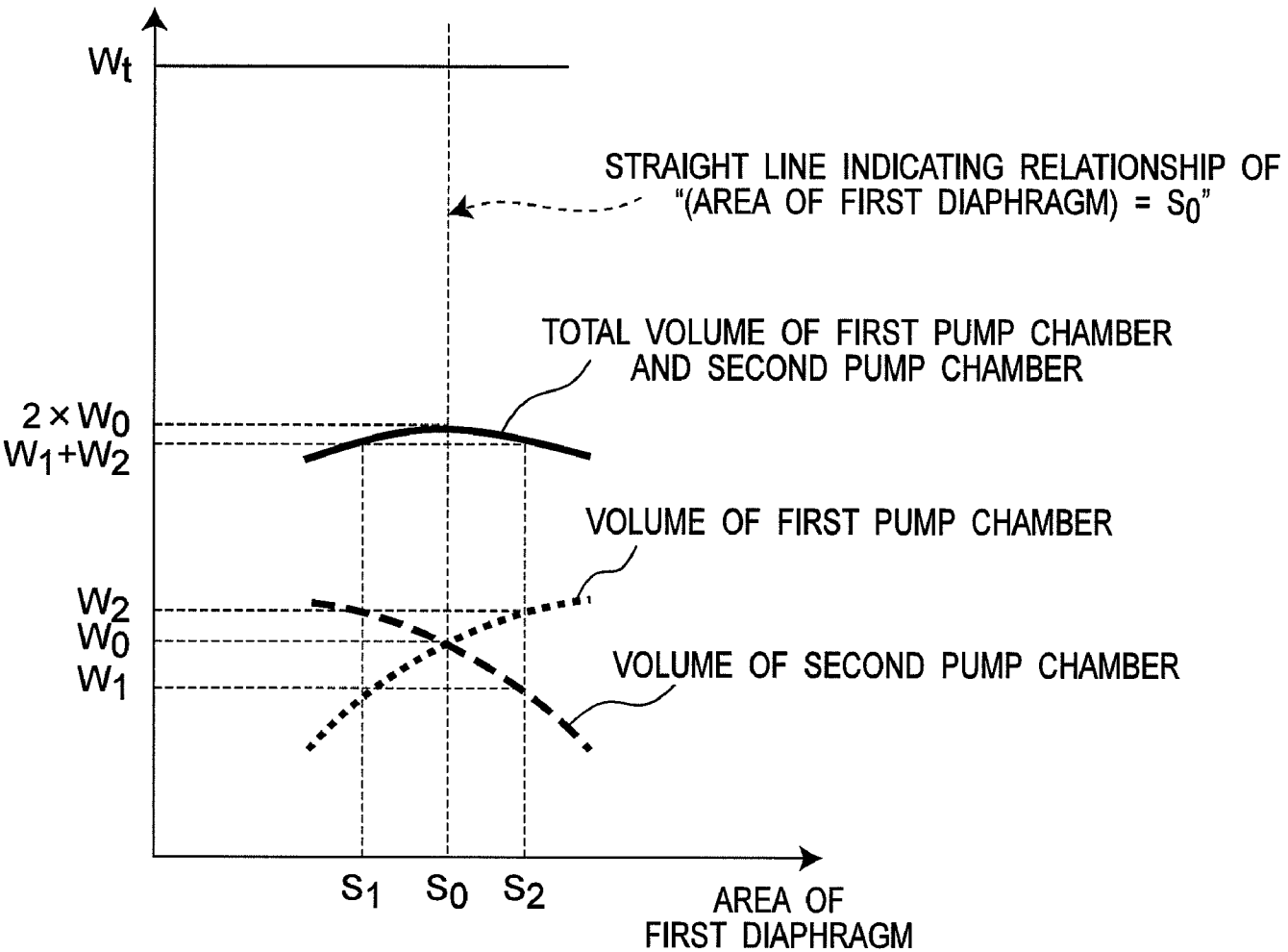
FIG. 25C is a view that shows a relationship between the area and volume of each of the portions of the pump.
Figure 25D:
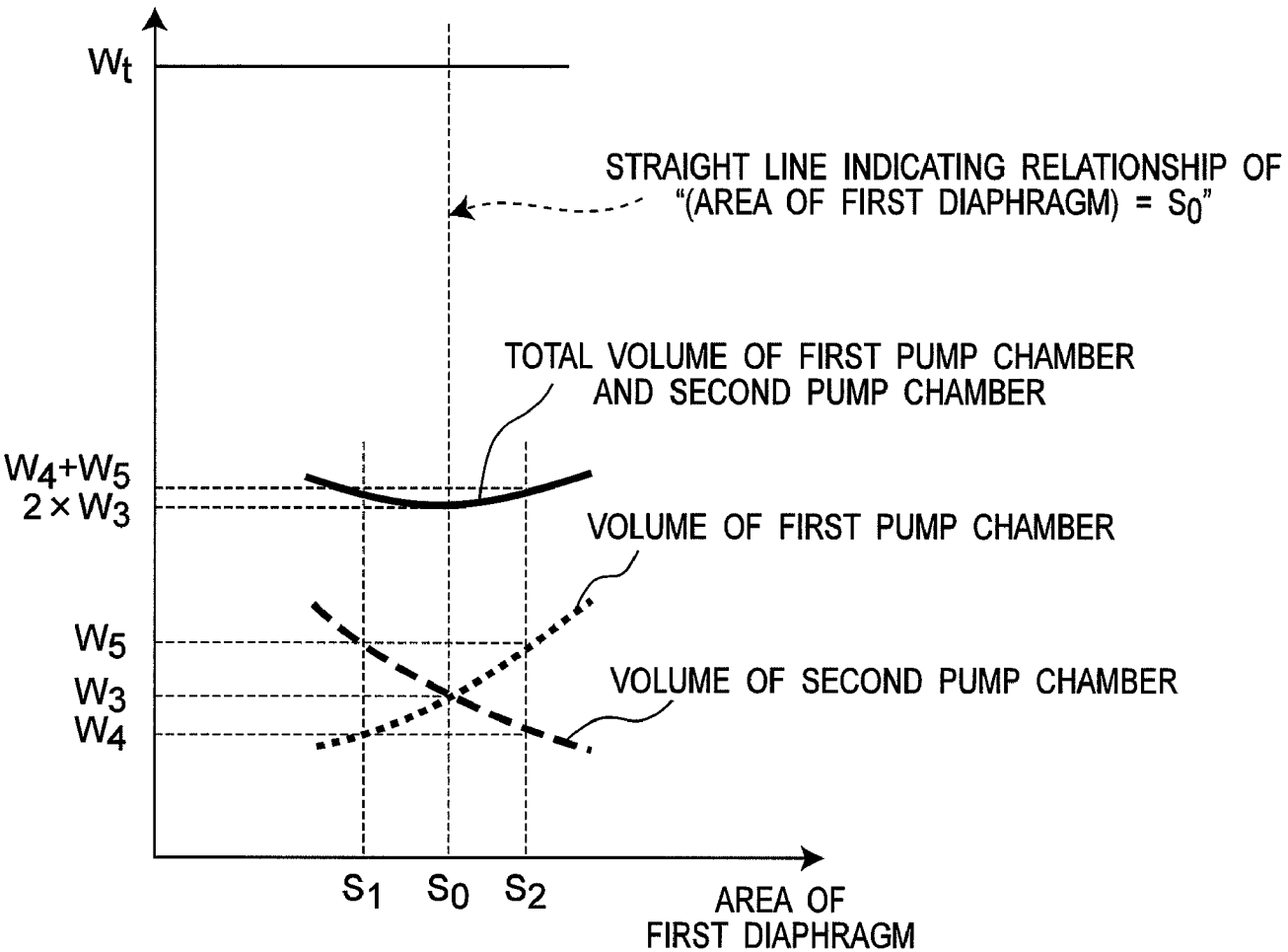
FIG. 25D is a view that shows a relationship between the area and volume of each of the portions of the pump.

In a case where the first and second diaphragms 103, 104 are always maintained in an expanded state without being slackened during operations, in the same manner as in the explanation already given by using FIGS. 25C and 25D, in the first embodiment also, the total value of the volume of the first pump chamber 107 and the volume of the second pump chamber 108 is represented by a laterally symmetrical shape, with its symmetrical axis being coincident with "a straight line indicating the relationship of (area of the first diaphragm 103)=$S_0$", with the result that it takes the maximum value or the minimum value at the area=$S_0$ of the first diaphragm 103. In this case, when the area of the first diaphragm 103 and the area of the second diaphragm 104 are made equal to each other, the corresponding value is defined as $S_0$. As can be clarified by these graphs, as the area of the first diaphragm 103 is changed, the total value of the volume of the first pump chamber 107 and the volume of the second pump chamber 108 is also changed. Supposing that the inner volume of the casing unit 102 is represented by $W_t$, the volume of the electrolyte chamber inner-casing unit portion 190 is represented by a value obtained by subtracting the total volume of the first pump chamber 107 and the second pump chamber 108 from $W_t$. Therefore, depending on the change in the total volume of the first pump chamber 107 and the second pump chamber 108, the volume of the electrolyte chamber inner-casing unit portion 190 is also changed. Accordingly, the shape of the elastic film portion 130 is changed in such a manner that the volume of the electrolyte chamber 109 is maintained substantially constant. In a case where the volume of the electrolyte chamber inner-casing unit portion 190 is increased, since the pressure of the electrolyte is reduced accordingly, the balances between the elastic force of the elastic film portion 130 and the elastic force of the spring portion 131 in the elastic film portion 130, as well as between the pressure of the electrolyte and the pressure of the external atmosphere of the casing unit 102, are changed. As a result, the swelled convex shape of the elastic film portion 130 becomes smaller, resulting in a reduction in the volume of the elastic film inner-side space portion 192. Consequently, the volume of the electrolyte chamber 109 is maintained substantially constant. In contrast, in a case where the volume of the electrolyte chamber inner-casing unit portion 190 is decreased, since the pressure of the electrolyte increases accordingly, the balances between the elastic force of the elastic film portion 130 and the elastic force of the spring portion 131 in the elastic film portion 130, as well as between the pressure of the electrolyte and the pressure of the external atmosphere, are changed. As a result, the swelled convex shape of the elastic film portion 130 becomes larger, resulting in an increase in the volume of the elastic film inner-side space portion 192. Consequently, the volume of the electrolyte chamber 109 is maintained substantially constant. As a result of these operations, the volume of the electrolyte chamber 109 filled inside the electrolyte chamber 109 is made substantially constant, and the pressure of the electrolyte is also maintained substantially constant.

In the fluid transporting device in accordance with the first embodiment of the present invention, when the pressure of the electrolyte is set to an appropriate value smaller than the pressure of the fluid inside the first and second pump chambers 107, 108 in its initial state, the pressure of the electrolyte can also be maintained within a certain constant range by the operations of the elastic film portion 130 and the spring portion 131. In this case, when "the pressure of the electrolyte is set to an appropriate value smaller than the pressure of the fluid inside the first and second pump chambers 107, 108 in its initial state" as described above, in the case of 0.101 MPa (1 atm) in the pressure of the fluid in the initial state, the pressure of the electrolyte in the initial state (initial pressure of the electrolyte) is preferably set in a range from about 0.091 MPa to 0.101 MPa (0.9 atm to 0.999 atm). In particular, the pressure thereof is more preferably set in a range from about 0.100 MPa to 0.101 MPa (0.99 atm to 0.999 atm). This is because, in a case where the initial pressure of the electrolyte is smaller than the above-mentioned range, a problem arises in that the movement of the diaphragm is disturbed since the pressure difference between the fluid and the electrolyte becomes too large. Moreover, in a case where the initial pressure of the electrolyte is larger than the above-mentioned range, a problem tends to arise in that the diaphragm is slackened during pump operations to cause a reduction in the efficiency of the pump operations. Furthermore, the above-mentioned expression, "the pressure of the electrolyte is also maintained in a certain constant range", indicates that the appropriate pressure of the electrolyte during pump operations is maintained, for example, in a range from about 0.051 MPa to 0.101 MPa (0.5 atm to 0.999 atm). This is because, in a case where the pressure of the electrolyte during pump operations is smaller than the above-mentioned range, a problem arises in that the movement of the diaphragm is disturbed since the pressure difference between the fluid and the electrolyte becomes too large. Moreover, in a case where the pressure of the electrolyte is larger than the above-mentioned range, a problem tends to arise in that the diaphragm is slackened to cause a reduction in the efficiency of the pump operations since the pressure difference between the fluid and the electrolyte becomes too small. As described earlier, since the pressure of the electrolyte is also maintained within a certain range by operating the elastic film portion 130 and the spring portion 131, the pressure of the electrolyte can be always maintained to a level smaller than the pressure of the fluid inside the first and second pump chambers 107, 108. As a result, since a force within a predetermined range is applied to the first and second diaphragms 103, 104 from the first and second pump chambers 107, 108 toward the electrolytic chamber 109, the first and second diaphragms 103, 104 are maintained in an expanded state by this force without being slackened so that the tensions of the first and second diaphragms 103, 104 are maintained at appropriate values. In this case, the appropriate values of the tensions of the first and second diaphragms 103, 104 are, for example, set in a range from 0.101 MPa to 10.1 MPa (about 1 atm to about 100 atom). In a case where the tensions of the diaphragms 103 and 104 are larger than the above-mentioned range, a problem tends to arise in that the movements of the diaphragms 103 and 104 are disturbed. Moreover, in a case where the tensions of the diaphragms 103 and 104 are smaller than the above-mentioned range, a problem tends to arise in that the diaphragms 103 and 104 are slackened to cause a reduction in the efficiency of the pump operations. In this manner, since the tensions of the first and second diaphragms 103, 104 can be maintained at appropriate values so that, during pump operations, each of the first and second diaphragms 103, 104 is deformed into a convex shape when viewed in the direction of the electrolyte chamber 109, with a stress (tension) in an extending direction being applied to the first and second diaphragms 103, 104 within a predetermined range; thus, a pressure to be exerted on each of the first and second diaphragms 103, 104 is maintained within a predetermined range (constant range), by the electrolyte within the electrolyte chamber 109 and the fluids inside the first pump and second pump 107, 108. In this case, the range of the pressure to be exerted on the first and second diaphragms 103, 104 during pump operations, by a difference between the pressure of the electrolyte solution inside the electrolyte chamber 109 and the pressure of the fluid inside the first and second pump chambers 107, 108, is preferably set, for example, in a range from 0.0101 MPa to 0.000101 MPa (0.1 atm to 0.001 atm). This is because, in a case where the pressure to be applied to the diaphragms 103 and 104 due to the difference between the pressure of the electrolyte and the pressure of the fluid is greater than the above-mentioned range, a problem arises in that the movements of the diaphragms 103 and 104 are disturbed. Moreover, this is also because, in a case where the pressure to be applied to the diaphragms 103 and 104 due to the difference between the pressure of the electrolyte and the pressure of the fluid is smaller than the above-mentioned range, a problem tends to arise in that the diaphragms 103 and 104 are slackened to case a reduction in the efficiency of the pump operations.

Since the state in which the pressure to be exerted on the diaphragms 103 and 104 is maintained within a predetermined range (constant range) is always kept during pump operations, work to be exerted upon expansion and contraction of the conductive polymer films of the first and second diaphragms 103, 104 is effectively used for the discharge and suction of the fluid of the first and second pumps 107, 108. That is, it becomes possible to enhance the work efficiency of the pump operations. In this case, the pump work efficiency is defined as a rate of work to be used by the pump to carry out sucking and discharging operations of the fluid relative to electric energy applied to the pump.

The following description will discuss a function by which, upon occurrence of a change in the tension to be applied to the first and second diaphragms 103, 104 due to a reason other than periodic electrochemomechanical expansion and contraction of the conductive polymer films of the first and second diaphragms 103, 104, the tension of the first and second diaphragms 103, 104 is appropriately maintained by the elastic film portion 130 and the spring portion 131.

In general, in the diaphragm-type pump using the conductive polymer film, upon carrying out an operation by applying a periodic voltage to the conductive polymer film, the following disadvantage occurs:

(i) a strain is accumulated in a fixed direction; or (ii) a deformation occurs due to suction of the electrolyte by the conductive polymer film; or (iii) a non-reversible or reversible shape change, typically represented by a creep, occurs in the conductive polymer film; or (iv) a deformation, a deviation or the like occurs in the fixed portion of the conductive polymer film. For this reason, the area, shape or layout of the diaphragm tends to change. In this case, in a pump shown in the related art, even in a case where, upon manufacturing the pump, the conductive polymer film is placed with a tension being applied thereto, there sometimes arises a problem in that it is not possible to apply a desired tension (stress in the extending direction) to the diaphragms.

In the first embodiment, however, such a change in tension as to fail to apply a desired tension to the diaphragm can be sucked by the deformations of the elastic film portion 130 and the spring portion 131 so that the tension to be applied to the diaphragm can be maintained within a constant range.

Figure 8:
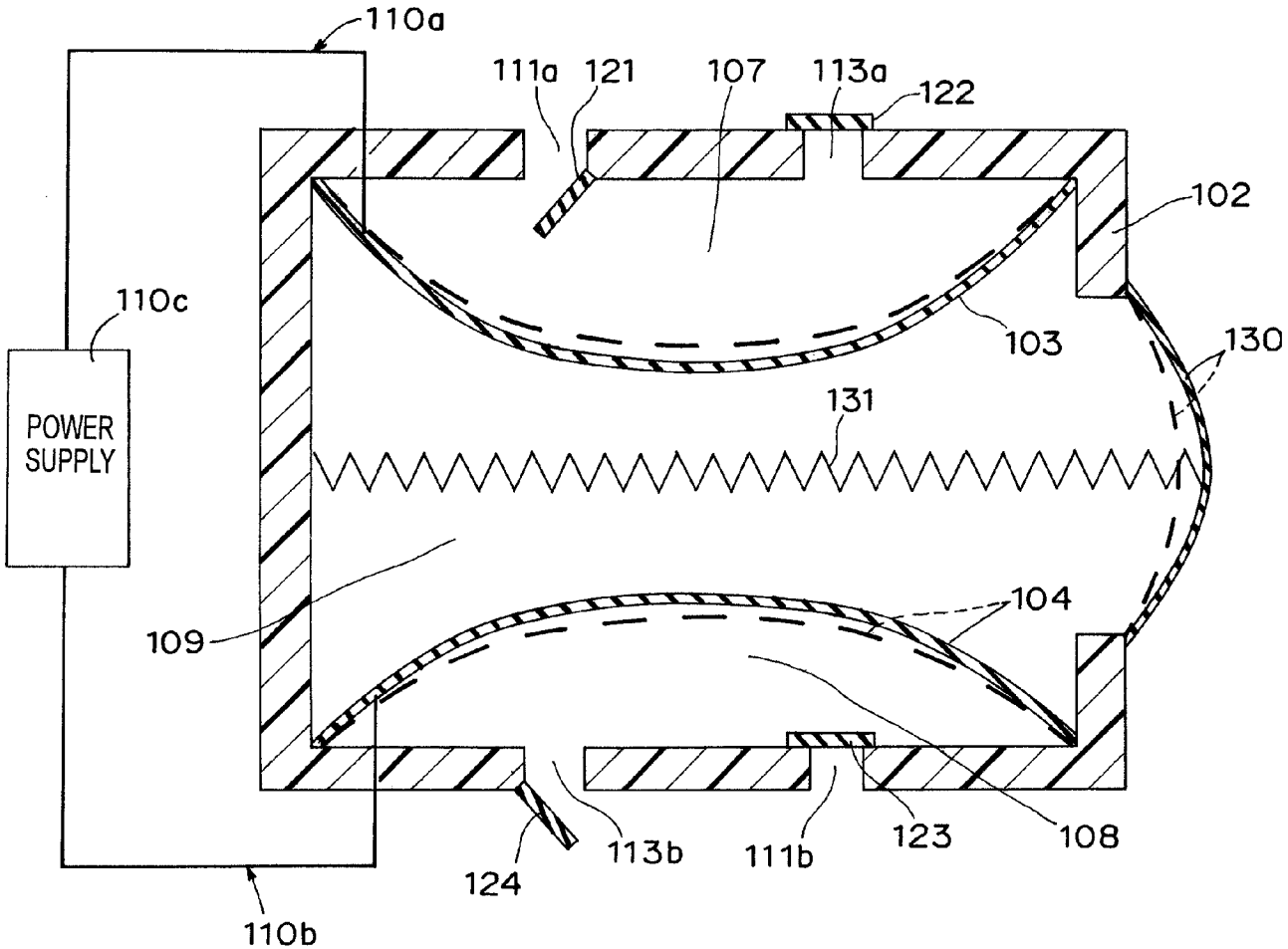
FIG. 8 is a view that shows an example of a state in which, upon occurrence of a change in tension to be applied to a diaphragm, the pressure to be applied to the diaphragm is maintained in the fluid transporting device in accordance with the first embodiment of the present invention.
Figure 9:
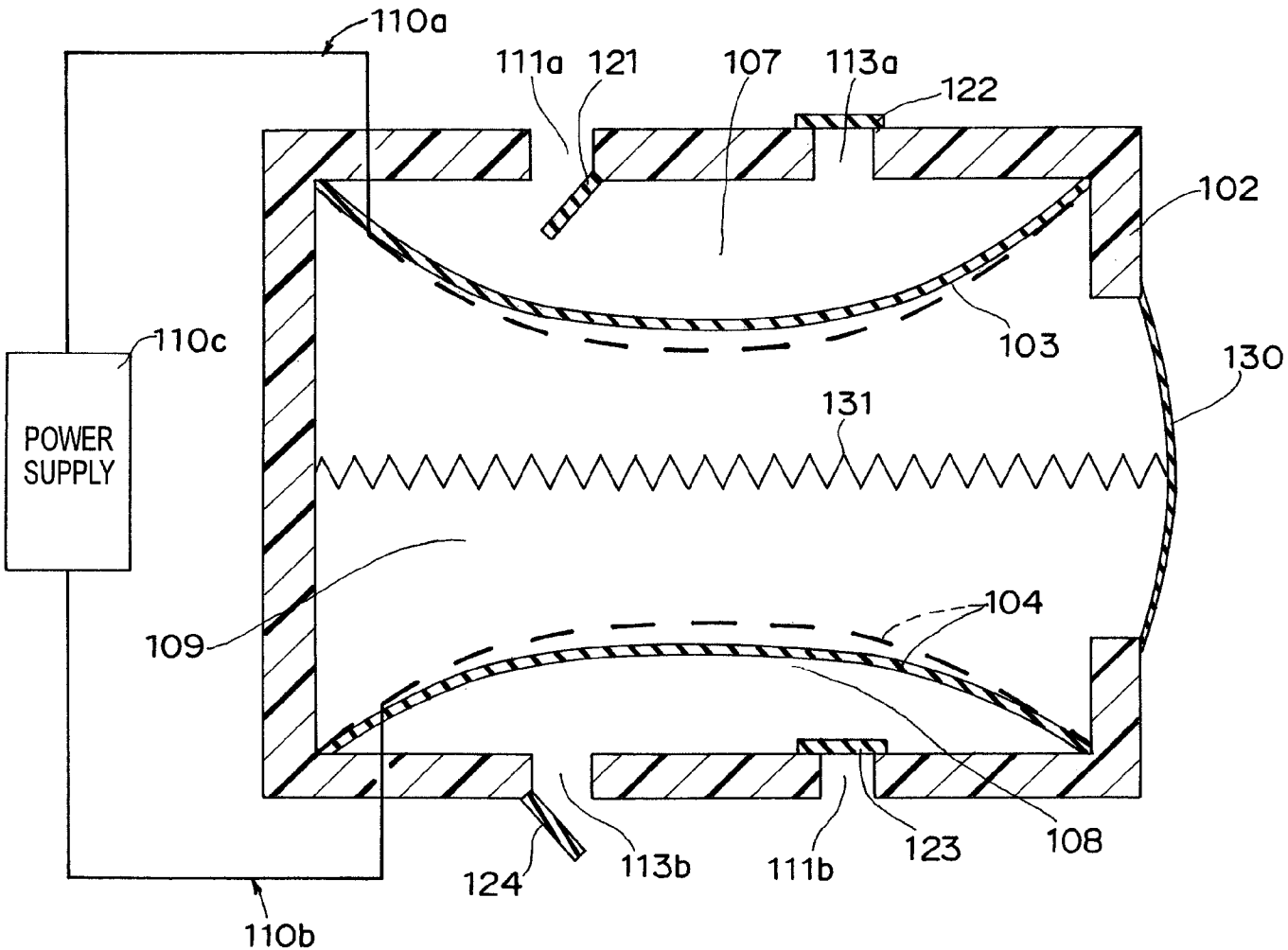
FIG. 9 is a view that shows another example of a state in which, upon occurrence of a change in tension to be applied to a diaphragm, the pressure to be applied to the diaphragm is maintained in the fluid transporting device in accordance with the first embodiment of the present invention.

These arrangements will be described in detail below. Each of FIGS. 8 and 9 shows a state in which, upon occurrence of a change in tension to be applied to the first and second diaphragms 103, 104 in the first embodiment, the pressure to be applied to the first and second diaphragms 103, 104 is maintained within a predetermined range. FIG. 8 shows a state in which, when the change in tension occurs so that the first and second diaphragms 103, 104 are expanded due to any of the above-mentioned reasons, the pressures to be applied to the first and second diaphragms 103, 104 can be maintained within predetermined ranges. In FIG. 8, dotted lines indicate positions of the first and second diaphragms 103, 104 in the state shown in FIG. 3. In FIG. 8, the first and second diaphragms 103, 104 are deformed in an expanding direction, in comparison with those of FIG. 3, and due to this state, the volume of the electrolyte chamber 109 is temporarily reduced so that the pressure of the electrolyte increases. Accordingly, the balances between the elastic force of the elastic film portion 130 and the elastic force of the spring portion 131 in the elastic film portion 130, as well as between the pressure of the electrolyte and the pressure of the external atmosphere, are no longer maintained. As a result, by the elastic force of the elastic film portion 130 and the spring portion 131, the spring portion 131 is expanded, with the result that the swelled convex shape of the elastic film portion 130 is deformed in a manner so as to grow larger outward of the casing unit 102. In accordance with this movement, one portion of the electrolyte inside the electrolyte chamber 109 inside the casing unit 102 is sucked and drawn in the direction of the elastic film portion 130 (that is, sucked out into the elastic film inner-side space portion 192 through the opening space portion 191) so that the volume of the electrolyte chamber 109 is returned substantially to the initial state. Consequently, the pressure of the electrolyte is returned substantially to the initial state.

In contrast, FIG. 9 shows a state in which, even upon shrinkage of the first and second diaphragms 103, 104 due to a reason other than the periodic electrochemomechanical expansion and contraction, the pressure to the first and second diaphragms 103, 104 is maintained within a predetermined range. In FIG. 9, dotted lines indicate positions of the first and second diaphragms 103, 104 in the state shown in FIG. 3. In this case, the spring portion 131 is contracted by the elastic force of the elastic film portion 130 and the spring portion 131 in such a manner that the swelled convex shape of the elastic film portion 130 is deformed to be made smaller. Thus, the pressure of the electrolyte is maintained substantially at the value of the initial state.

By the functions as described above, in the fluid transporting device in accordance with the first embodiment of the present invention, by setting the pressure of the electrolyte in the initial state to an appropriate value smaller than the pressure of the fluid inside the pump chamber, even in a case where the first and second diaphragms 103, 104 are expanded or contracted due to a reason other than periodic electrochemomechanical expansion and contraction of the conductive polymer films of the first and second diaphragms 103, 104, the pressure of the electrolyte can also be maintained within a certain constant range, by the operations of the elastic film portion 130 and the spring portion 131. As a result, it is possible to maintain the pressure of the electrolyte at an appropriate value smaller than the pressure of the fluid inside the first and second pump chambers 107, 108. Consequently, since a force within a certain constant range is applied to the first and second diaphragms 103, 104 from the first and second pump chambers 107, 108 toward the electrolyte chamber 109, the first and second diaphragms 103, 104 are maintained in an expanded state without being slackened so that the tensions of the first and second diaphragms 103, 104 are maintained at appropriate values. For this reason, during pump operations, each of the first and second diaphragms 103, 104 is deformed into a convex shape when viewed in the direction of the electrolyte chamber 109, with a stress (tension) in the extending direction being applied to the first and second diaphragms 103, 104 within a predetermined range; thus, a pressure to be exerted on each of the first and second diaphragms 103, 104 is maintained within a predetermined range (fixed range), by the electrolyte within the electrolyte chamber 109 and the fluids inside the first pump and second pump 107 and 108. Since this state is always kept during pump operations, work exerted by the expansion and contraction of the first and second diaphragms 103, 104 is efficiently used for the discharge and suction of the fluid of the first and second pump chambers 107, 108. That is, it is possible to increase the work efficiency in the pump operations. In this case, the work efficiency of the pump is defined as a rate of work to be used by the pump to carry out discharging and sucking operations of the fluid relative to electric energy applied to the pump.

In this manner, in the pump in accordance with the first embodiment of the present invention, during pump operations, with a stress (tension) in the extending direction of the first and second diaphragms 103, 104 being maintained within an appropriate range, the pressure to be exerted on each of the first and second diaphragms 103, 104 is maintained within a predetermined range, by the electrolyte within the electrolyte chamber 109 and the fluids inside the first pump and second pump 107 and 108; therefore, work exerted by the expansion and contraction of the first and second diaphragms 103, 104 is efficiently used for the discharge and suction of the fluid of the first and second pump chambers 107, 108.

Additionally, the above-mentioned explanation has discussed the structure in which valves are attached to the fluid transporting device; however, in a case where the discharge and suction of a fluid in a fixed amount are continuously carried out, another structure may be proposed in which one opening portion without a valve is formed in each of the first and second pump chambers 107, 108, and the suction and discharge may be repeatedly carried out respectively through the opening portions. In this case, in each of the pump chamber, one opening portion is compatibly allowed to function as the outlet and inlet.

The above-mentioned embodiments have exemplified a structure in which the respective diaphragms 103 and 104 are formed by a polymer actuator material; however, a laminated structure having another film superposed therewith may be used. For example, in order to minimize influences from a voltage drop in the polymer actuator material, a material having a higher conductive property may be formed on one portion or the entire portion of the surface of the polymer actuator material. In these cases, it is preferable to prepare the other material as a material having small rigidity or to form the other material into a shape to be easily deformed so as not to disturb operations of the polymer actuator material.

Moreover, one portion of each of the diaphragms 103 and 104 may be formed by using a material other than a polymer actuator material. In particular, in a case where one portion of each of the diaphragms 103 and 104 is formed as an elastic film, it is possible to apply the tension to the polymer actuator material more uniformly and consequently to obtain effects such as smooth operations of the pumps.

By adopting the above-mentioned structure, it is possible to provide a fluid transporting device having a flow rate in a range from about 10 to 100 ml/min and a maximum pressure for use in discharging the fluid in a range from about 1 to 10 kPa. However, not limited to the above-mentioned embodiments, in general, the shape and the size of the fluid transporting device can be designed depending on the flow rate and pressure that are required.

Figure 22A:
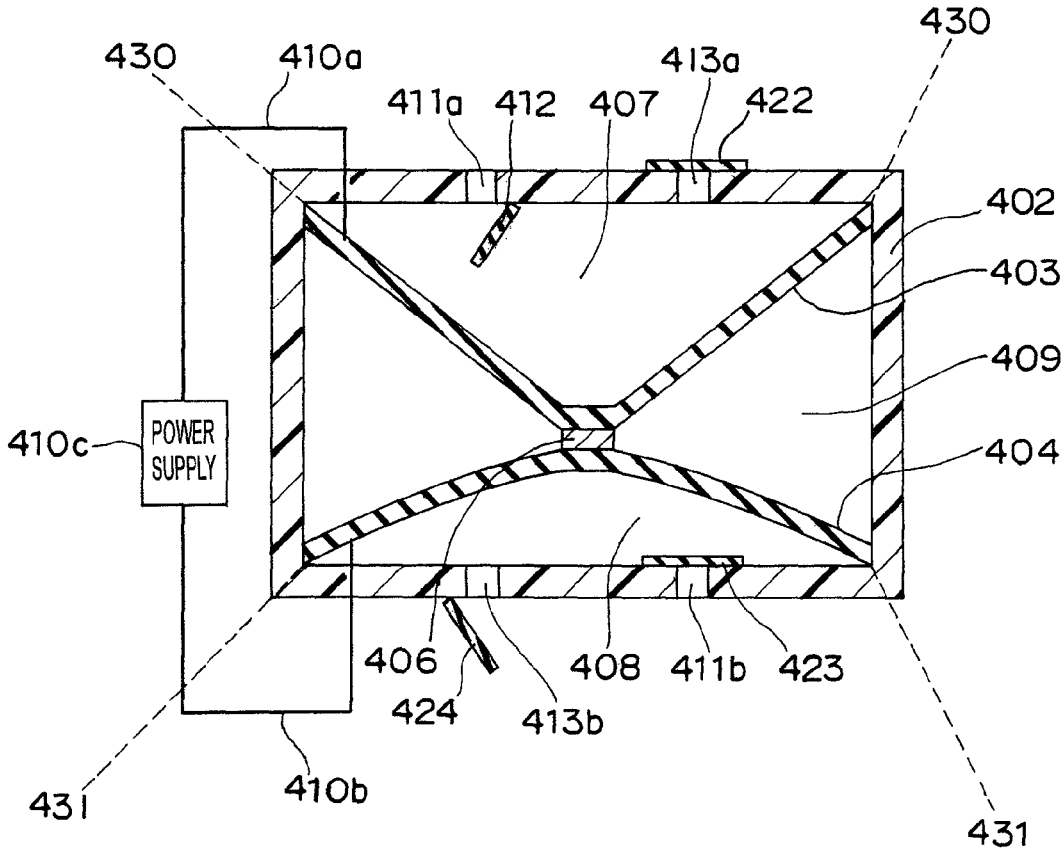
FIG. 22A is a view that shows a structure of a related art pump.

In the conventional structure shown in FIG. 22A, since the two diaphragms are mutually secured to one point in the center, wrinkles tend to easily occur on the two diaphragms. That is, in a case where there are deviations in the rigidity or shape of the films of the diaphragms, the tension is concentrated on a plurality of line segments that connect the securing point of the diaphragms to the peripheral portions, and surrounding portions thereof. For this reason, wrinkles occur on the diaphragms, with the result that work derived from electrochemomechanical expansion and contraction of the diaphragms is not effectively used for the suction and discharge of the pumps.

In contrast, the first embodiment has a structure in which no securing point is formed in the center portions of the first and second diaphragms 103, 104 so that, by the pressure difference between the first and second pumps 107, 108 and the electrolyte chamber 109, the first and second diaphragms 103, 104 are maintained in an expanded convex shape by an appropriate tension, without being slackened. With this arrangement, different from the related art, the first and second diaphragms 103, 104 of the first embodiment are free from concentration of the tension on a plurality of line segments that connect the securing point of the diaphragms to the peripheral portions, and surrounding portions thereof. As a result, the first and second diaphragms 103, 104 are prevented from occurrence of wrinkles so that work derived from electrochemomechanical expansion and contraction of the first and second diaphragms 103, 104 is effectively used for the discharge and suction of the first and second pump chambers 107, 108.

Figure 22B:
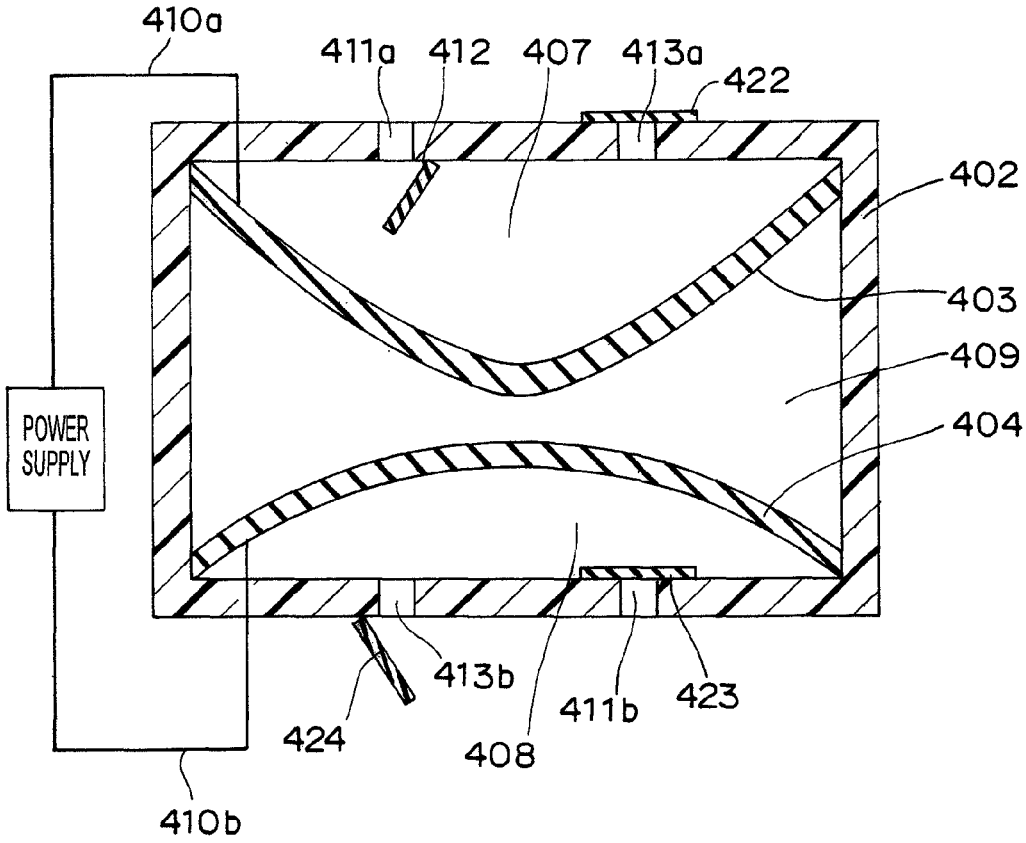
FIG. 22B is a view that shows another structure of a related art pump.
Figure 22C:
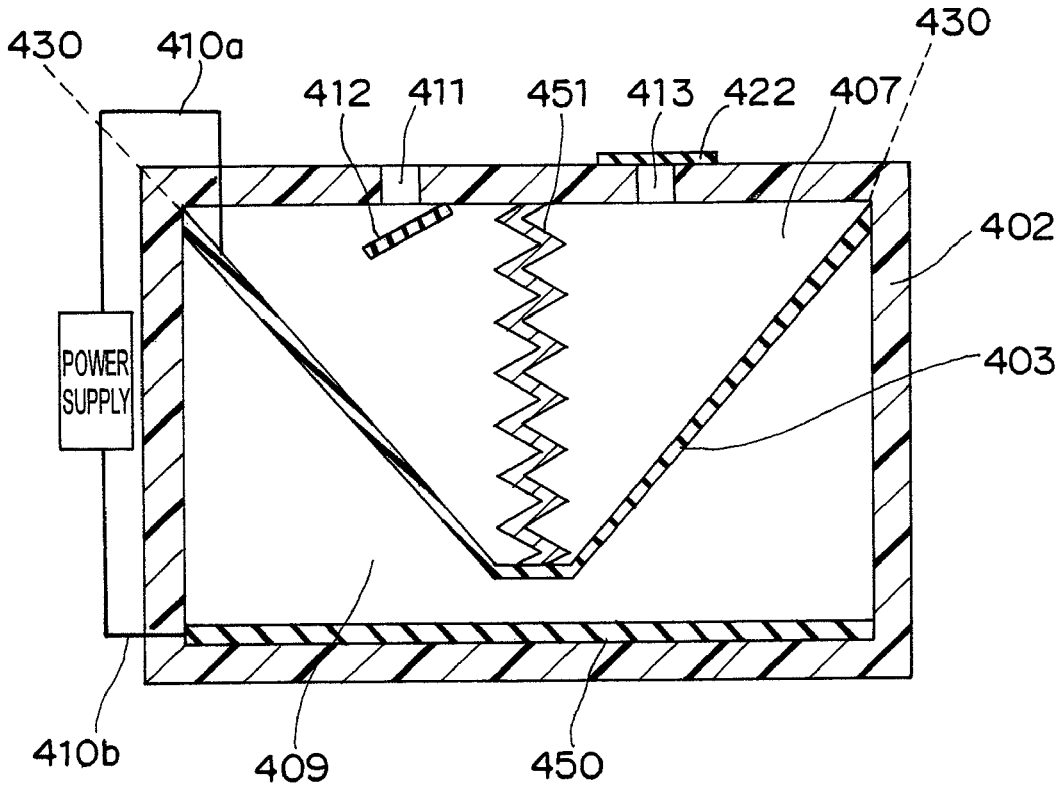
FIG. 22C is a view that shows the other structure of a related art pump.

Moreover, as described above, in comparison with the related art structure shown in FIG. 22B, the fluid transporting device of the first embodiment makes it possible to maintain the tensions of the first and second diaphragms 103, 104 at appropriate values, and consequently to improve the efficiency of the discharge and suction of the fluid.

In summary, the fluid transporting device of the first embodiment allows the elastic film portion 130 and the spring portion 131 to have a function (pressure maintaining function) for maintaining the pressure to be applied to the first and second diaphragms 103, 104 within an appropriate range. In the present specification, a unit having a function for maintaining the pressure to be applied to the first and second diaphragms 103, 104 in a predetermined range is referred to as a pressure maintaining unit. That is, in the first embodiment, the elastic film portion 130 and the spring portion 131 form the pressure maintaining unit. In a case where the first and second diaphragms 103, 104 are expanded to make the stress (tension) in the expanding direction of the diaphragms 103 and 104 smaller so that the first and second diaphragms 103, 104 become loose (slackened) (in other words, the pressure of the fluid inside the first and second pump chambers 107, 108 is made smaller below a predetermined range), since the elastic film portion 130 and the spring portion 131 are deformed in such a direction as to suck out the electrolyte inside the casing unit 102, the stress (tension) of the first and second diaphragms 103, 104 is maintained within a constant range (in other words, the pressure of the fluid in the first and second pump chambers 107, 108 is maintained within a predetermined range). Moreover, in a case where the first and second diaphragms 103, 104 are contracted to make the stress (tension) in the extending direction of the diaphragms 103 and 104 greater (in other words, the pressure of the fluid inside the first and second pump chambers 107, 108 is made greater beyond a predetermined range), since the elastic film portion 130 and the spring portion 131 are deformed in such a direction as to push the electrolyte inside the electrolyte chamber 109 of the casing unit 102 externally, the stress (tension) of the first and second diaphragms 103, 104 is maintained within a constant range (in other words, the pressure of the fluid in the first and second pump chambers 107, 108 is maintained within a predetermined range). That is, since the elastic film portion 130 serving as one portion of the wall surface of the electrolyte chamber 109 is deformed in response to a change in the stress (tension) derived from the deformation of the first and second diaphragms 103, 104, the stress (tension) of the first and second diaphragms 103, 104 is maintained within a constant range (in other words, the pressure of the fluid inside the first and second pump chambers 107, 108 is maintained within a predetermined range).

Moreover, the fluid transporting device of the first embodiment has a structure having no securing point in the center portion of the first and second diaphragms 107 and 108 so that, by the pressure difference between the first and second pump chambers 107, 108 and the electrolyte chamber 109, the first and second diaphragms 103, 104 are maintained in an expanded convex shape by an appropriate tension without being slackened; thus, the stress (tension) of the first and second diaphragms 103, 104 is maintained substantially at a uniform value over the entire surface (in other words, the pressure of the fluid in the first and second pump chambers 107, 108 is maintained within a predetermined range). Since this state is always kept during pump operations, work to be exerted upon expansion and contraction of the conductive polymer films is effectively used for the discharge and suction of the fluid of the first and second pumps 107 and 108.

As described above, in the fluid transporting device of the first embodiment, supposing that a rate of work to be used for discharging and sucking the fluid of the pump chambers 107 and 108 relative to applied electric energy from the power supply 110*c* is referred to as "work efficiency", the work efficiency of the pumps can be improved by the pressure maintaining function in comparison with the conventional pump.

The pressure maintaining unit, which serves as the unit having a function for maintaining the pressure to be applied to the first and second diaphragms 103, 104 within an appropriate range, keeps the volume of the electrolyte chamber 109 inside the electrolyte chamber at an appropriate value so that the pressure of the electrolyte is kept at an appropriate value, as described earlier. With this arrangement, it is possible to maintain the stress (tension) of the first and second diaphragms 103, 104 at an appropriate value (in other words, it is possible to maintain the pressure of the fluid inside the first and second pump chambers 107, 108 within a predetermined range). In particular, as described in the first embodiment, in a case where at least one portion of the wall surface of the electrolyte chamber 109 is formed as an elastic member (for example, elastic film portion) 130 so as to provide a structure in which the elastic member 130 is deformed in response to the pressure of the inside of the electrolyte chamber, the pressure inside the electrolyte chamber 109 and the stress (tension) of the first and second diaphragms 103, 104 can be automatically adjusted (in other words, the pressure of the inside of the electrolyte chamber 109 and the pressure of the fluid inside the first and second pump chambers 107, 108 can be respectively maintained at predetermined ranges).

Moreover, in the structure as shown in the first embodiment in which the two first and second diaphragms 103, 104 are allowed to expand and contract mutually in their reversed phases, since work exerted by the two first and second diaphragms 103, 104 can be used for the discharge and suction of the fluid, it is possible to make the amount of work of the discharge and suction greater.

Figure 10:
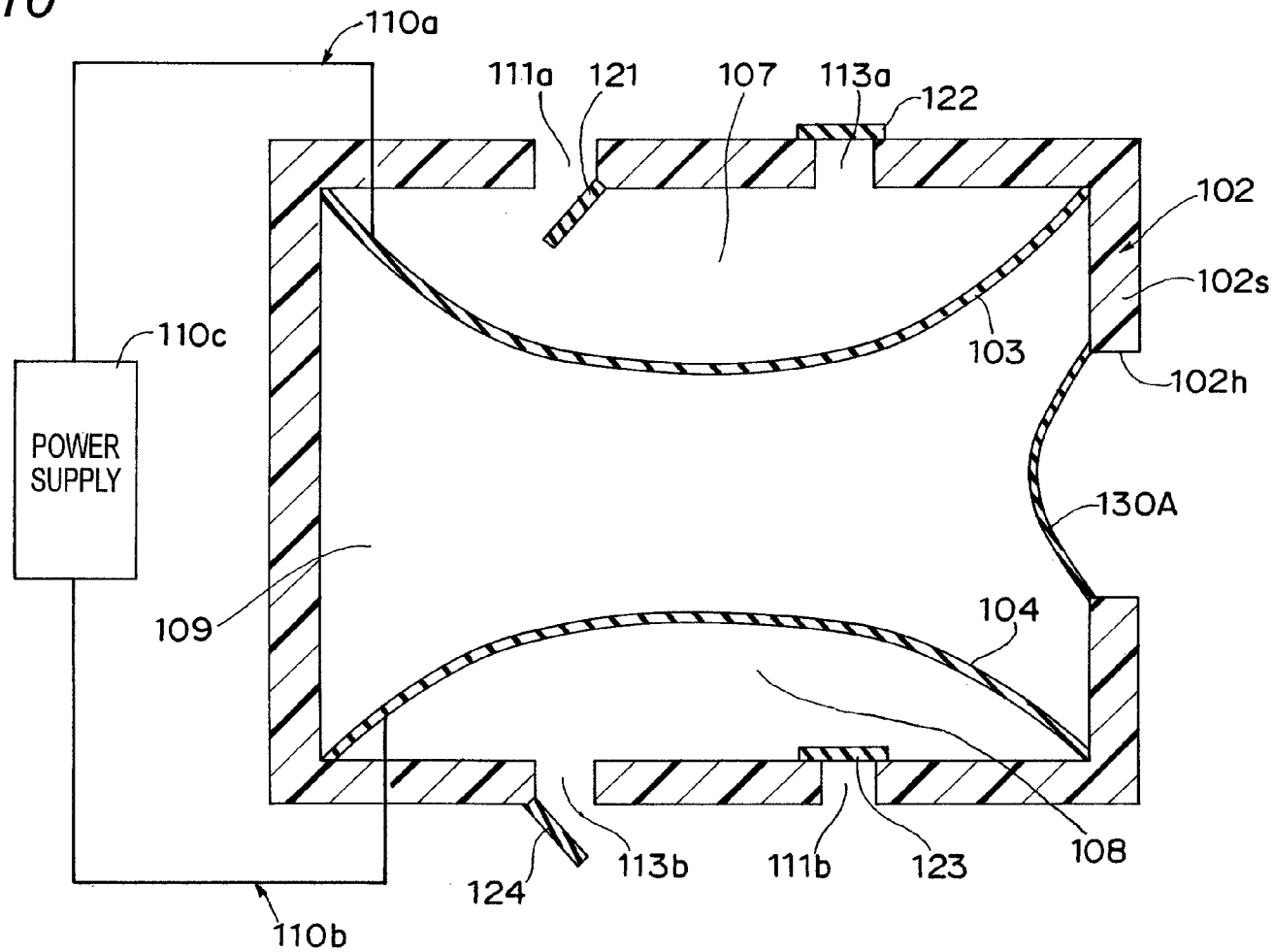
FIG. 10 is a cross-sectional view that shows a fluid transporting device in accordance with a first modified example of the first embodiment of the present invention.

FIG. 10 shows a first modified example of the first embodiment of the present invention. In FIG. 3 of the first embodiment, the round elastic film portion 130 is secured to the opening edge portion on the outside of the through hole 102*h* of the side wall 102*s* of the casing unit 102; however, in the first modified example, a round elastic film portion 130A is secured to the opening edge portion on the inside of the through hole 102*h* of the side wall 102*s* of the casing unit 102, with the elastic film portion 130A being formed into a convex shape toward the inside of the electrolyte chamber 109 (in other words, a concave shape toward the outside of the casing unit 102) so that the elastic film portion 130A is allowed to function as the pressure maintaining unit. In the first modified example, the pressure inside the electrolyte chamber 109 is kept lower than the external pressure of the casing unit 102 and the pressure of the fluid of the first and second pump chambers 107, 108. Since the swelled convex shape of the elastic film portion 130A is changed by its elasticity in response to a pressure change inside the electrolyte chamber 109, the volume and pressure of the electrolyte chamber 109 can be maintained at appropriate ranges, and as a result, the stress (tension) of the first and second diaphragms 103, 104 can be maintained at an appropriate value (in other words, the pressure of the fluid inside the first and second pump chambers 107, 108 can be maintained within a predetermined range). For example, in a case where the first and second diaphragms 103, 104 are expanded, the volume of the electrolyte chamber 109 becomes smaller to make the pressure of the electrolyte greater so that the swelled convex shape of the elastic film portion 130A becomes smaller. With this arrangement, the volume and pressure of the electrolyte chamber 109 are maintained within substantially constant ranges. As a result, the stress of the first and second diaphragms 103, 104 can be maintained within an appropriate range (in other words, the pressure of the fluid inside the first and second pump chambers 107, 108 can be maintained within a predetermined range).

Although it is omitted from FIGS. 1 to 10 for brief illustration, for example, an appropriate mechanical part may be installed so as to prevent the spring portion 131 from being buckled. In other words, in FIGS. 1 to 10, the illustration of such a mechanical part is omitted so as to explain essential portions of the present invention; however, in another embodiment also, for example, an appropriate mechanical part, such as a guide, may be installed so as to allow the respective portions to carry out smooth mechanical operations. The following description will discuss an example with such a guide as a second modified example of the first embodiment.

Figure 11A:
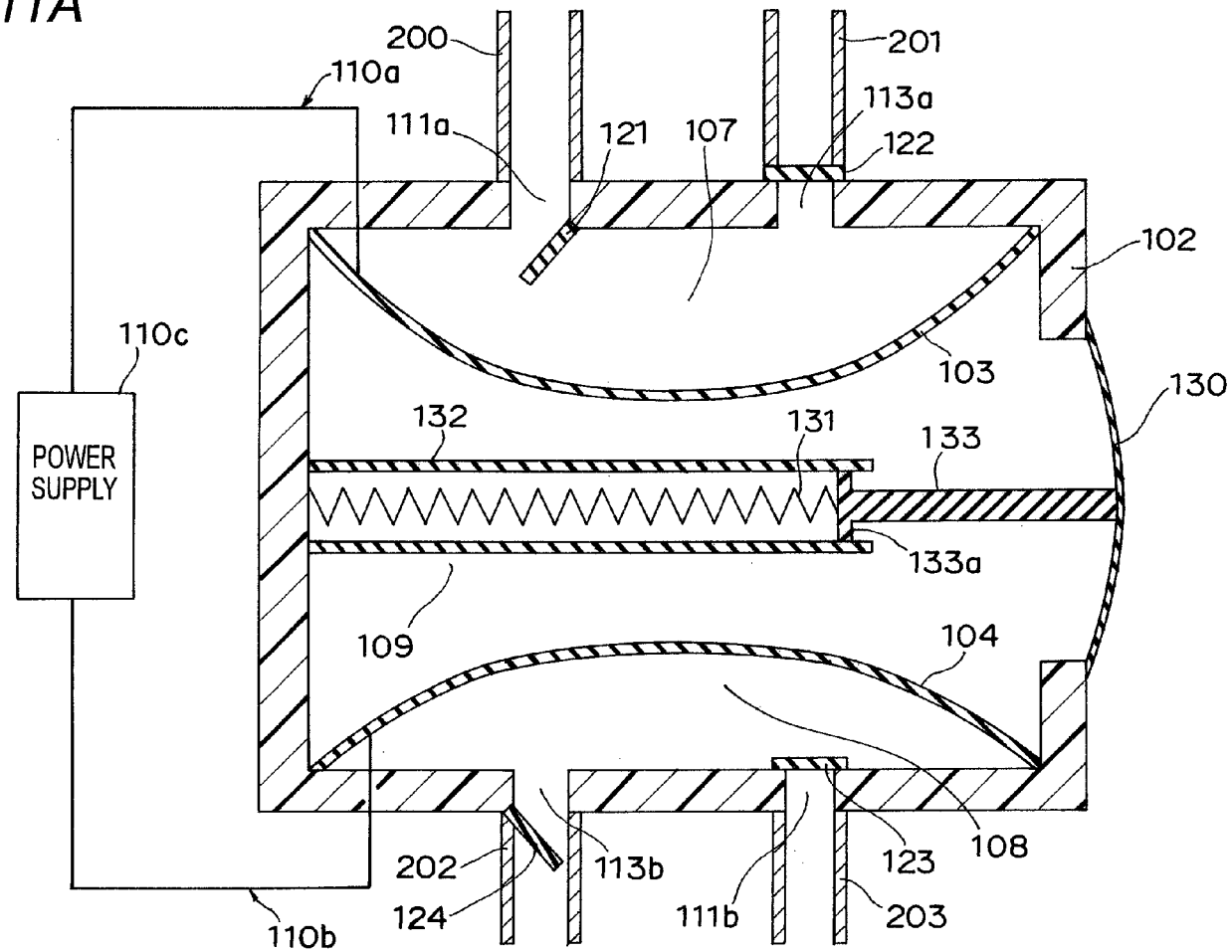
FIG. 11A is a cross-sectional view that shows a fluid transporting device in a state where a spring portion is expanded in a second modified example of the first embodiment of the present invention.
Figure 11B:
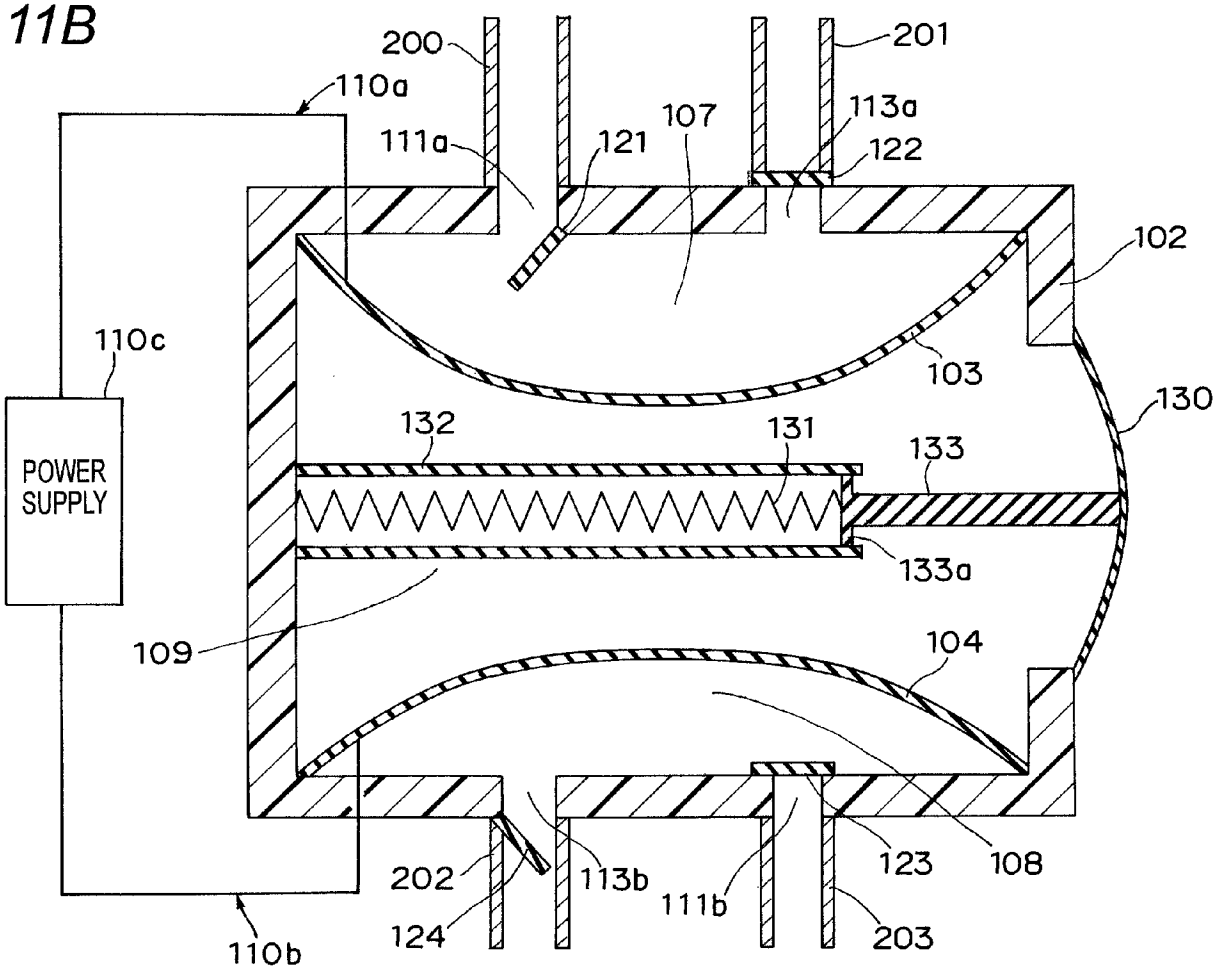
FIG. 11B is a cross-sectional view that shows a fluid transporting device in a state where a spring portion is contracted in the second modified example of the first embodiment of the present invention.
Figure 12:
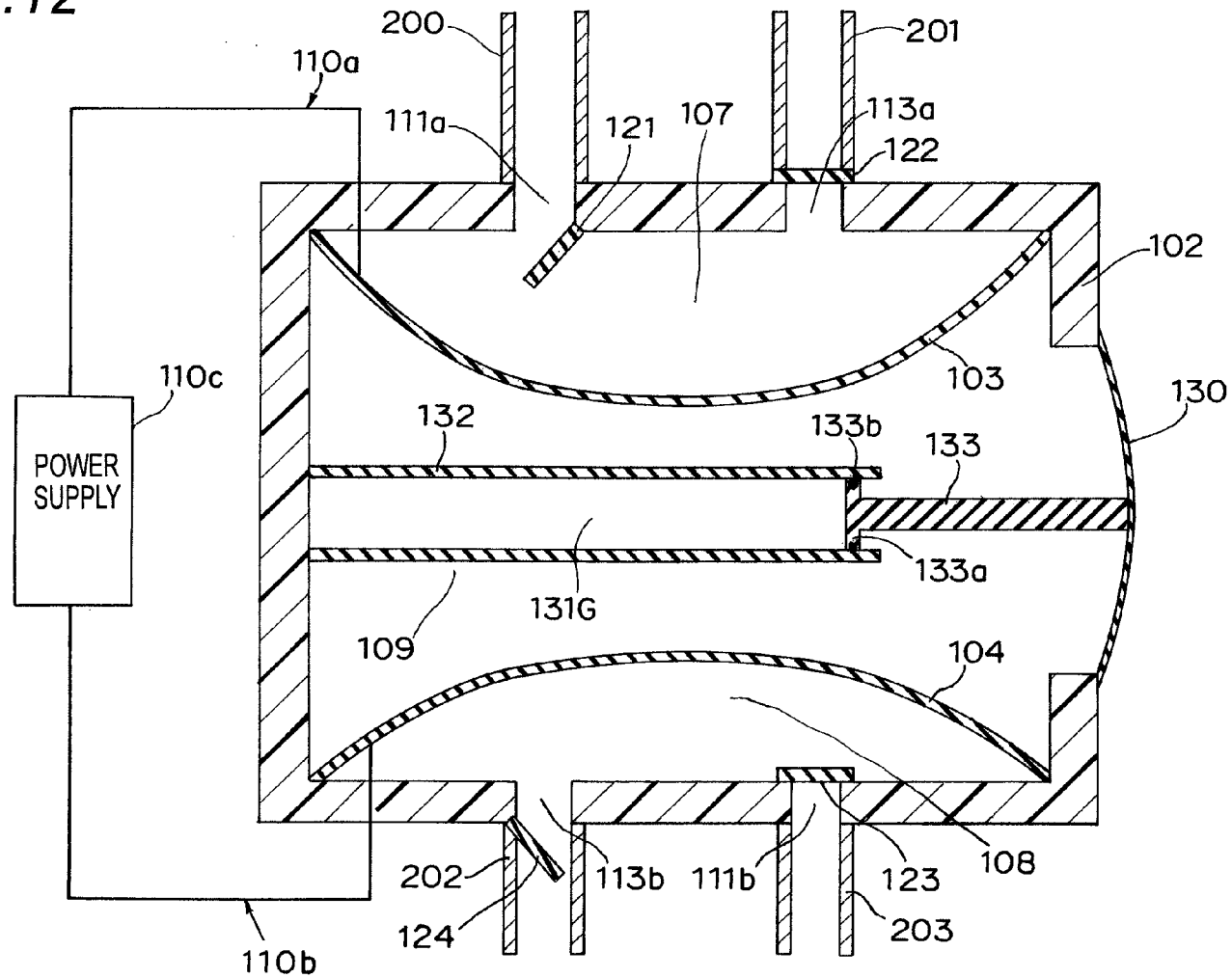
FIG. 12 is a cross-sectional view that shows a fluid transporting device in which a spring portion includes a gas in place of a coil spring, in the second modified example of the first embodiment of the present invention.

FIGS. 11A, 11B and FIG. 12 show a second modified example of the first embodiment. In this second modified example of the first embodiment, a connecting portion 133 prepared as a rod-shaped member is inserted between the spring portion 131 and the elastic film portion 130. The coupling portion 133 couples the spring portion 131 and the elastic film portion 130 to each other so as to transmit a force to each other. Moreover, a cylindrical guide portion 132 is formed on the periphery of the spring portion 131 so as to prevent the coil spring forming the spring portion 131 from being buckled. The tip portion 133*a* of the coupling portion 133 is formed into a piston shape, and the tip portion 133*a* is secured to one end of the spring portion 131, and allowed to move inside the guide portion 132 smoothly. A space that is surrounded by the guide portion 132 and the tip portion 133*a* of the coupling portion 133 may be air-tightly closed, or may have an electrolyte contained therein without being air-tightly closed.

Additionally, FIG. 11A shows a state in which the spring portion 131 is extended, and FIG. 11B shows a state in which the spring portion 131 is contracted.

Moreover, in the second modified example, in a case where the space surrounded by the guide portion 132 and the tip portion 133*a* of the coupling portion 133 is air-tightly closed by a sealing member 133*b*, such as an O-ring, so as to freely slide therein, the function of the spring portion 131 may be carried out by the elasticity of a gas 131G located inside the tightly-closed space. The gas 131G air-tightly closed inside the cylindrical guide portion 132 is allowed to function as another example of the elastic portion. FIG. 12 shows an example in which the gas 131G is used. In this example, instead of the coil spring, the elasticity of the gas 131G is utilized as the spring portion 131. Moreover, in a case where a frictional portion is placed between the guide portion 132 and the coupling portion 133, by using an ionic solution having a high lubricating property as the electrolyte, it is possible to obtain an effect for reducing the friction.

Figure 19:
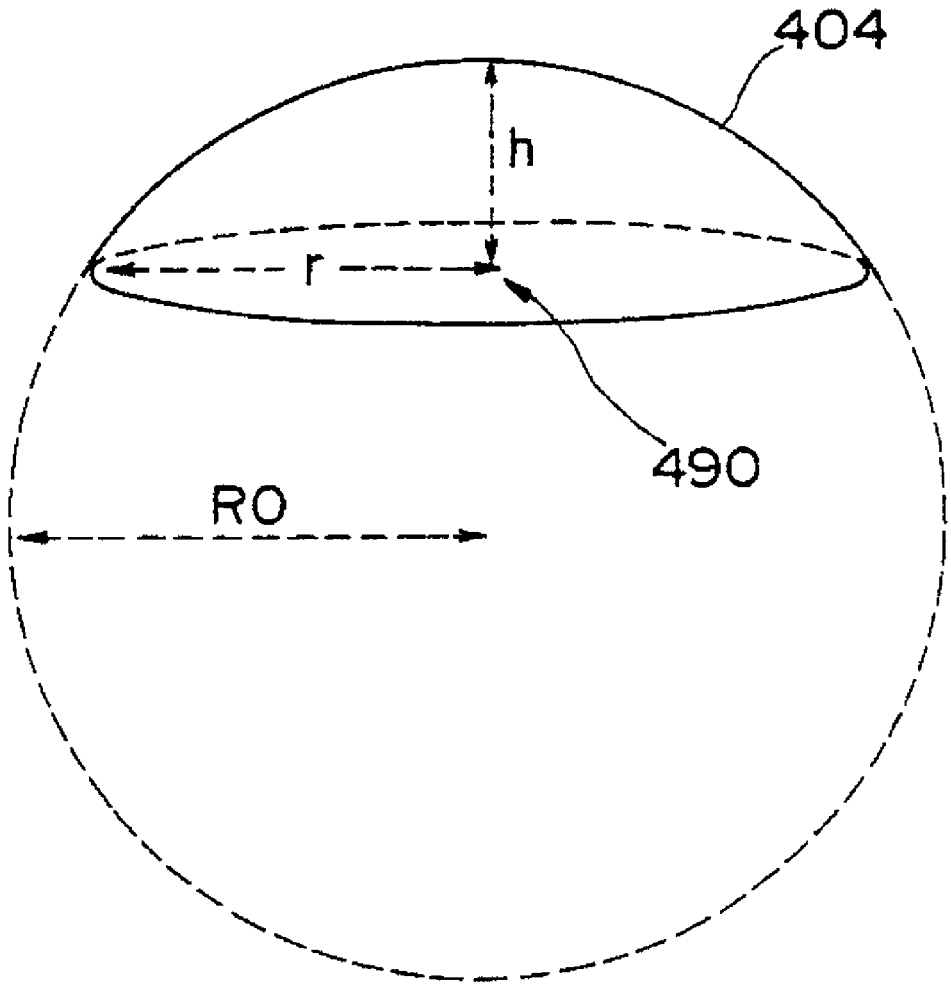
FIG. 19 is a view that explains a shape of a diaphragm of the fluid transporting device in accordance with the fourth embodiment of the present invention.

FIG. 19 shows a third modified example of the first embodiment in which instead of the coil spring, another spring is used as the spring portion 131. In this third modified example, instead of the coil spring of the spring portion 131, a plate spring 134 is used, with its one end (for example, the lower end) being secured to, for example, the lower side of the inner circumferential face of the through hole 102*h* of the side wall 102*s* of the casing unit 102. A contact portion 134*a* is secured to the other end (for example, the upper end) of the plate spring 134 so that the contact portion 134*a* is always made in contact with the elastic film portion 130 by the elastic force of the plate spring 134. In this manner, by using the plate spring 134, the pressure maintaining unit can be formed into a small size.

Moreover, in order to prevent an electrical short circuit between the first and second diaphragms 103, 104, the spring portion 131, or the guide portion 132, the coupling portion 133 and the plate spring 134 are preferably made from an insulating plastic material respectively. Furthermore, the spring portion 131, the guide portion 132, the coupling portion 133 and the plate spring 134 are respectively made from materials that are resistant to an electrolyte to be used.

Second Embodiment

Figure 13:
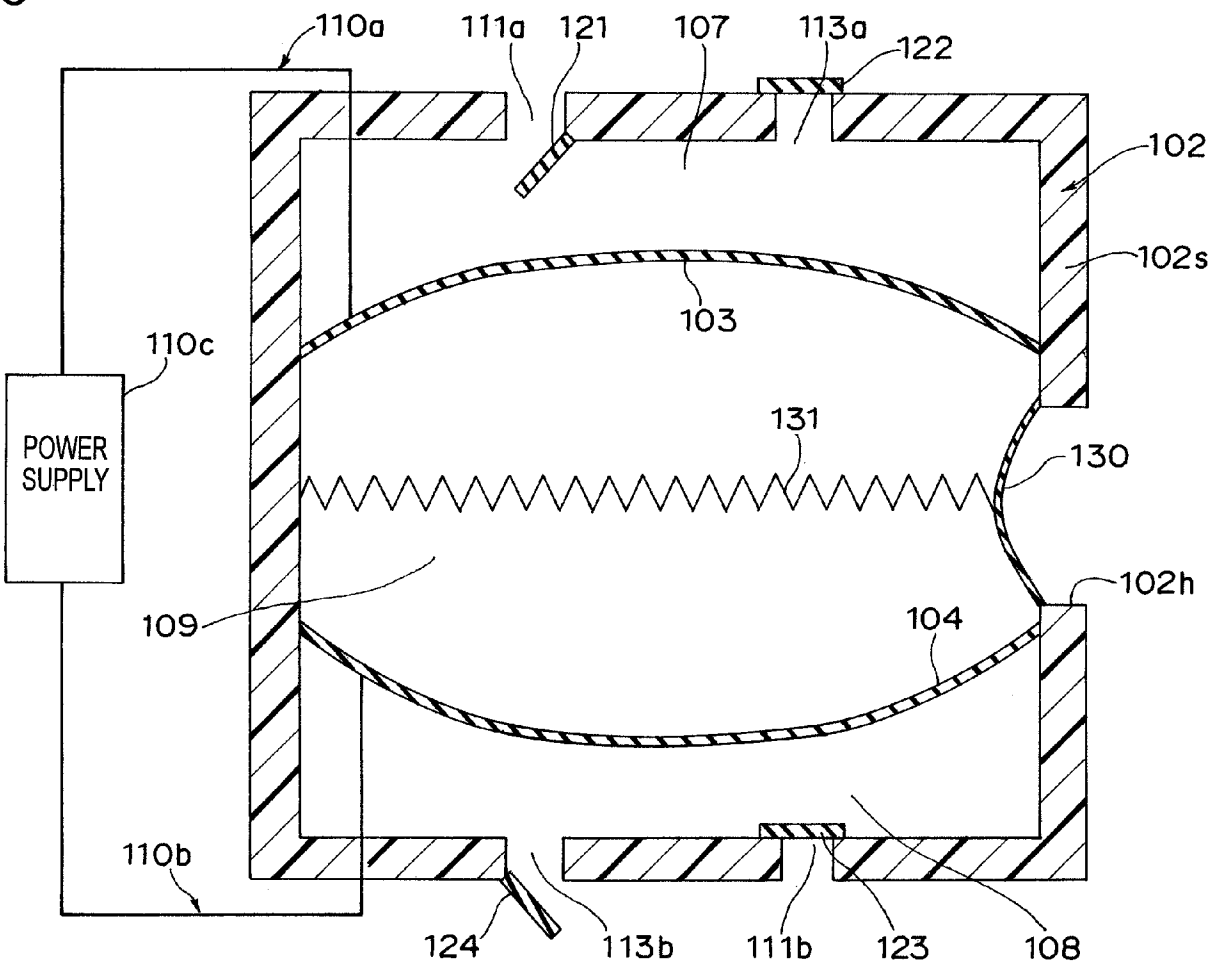
FIG. 13 is a block diagram that shows a fluid transporting device using a conductive polymer in accordance with a second embodiment of the present invention.

FIG. 13 is a cross-sectional view that shows a fluid transporting device using a conductive polymer in accordance with a second embodiment of the present invention.

The fluid transporting device of FIG. 13 is provided with a casing unit 102, a first diaphragm 103, a second diaphragm 104, a first pump chamber 107, a second pump chamber 108, an electrolyte chamber 109, wiring portions 110*a* and 110*b*, first and second inlets 111*a* and 111*b*, first and second outlets 113*a* and 113*b*, first and second inlet valves 121 and 123, first and second outlets 122 and 124, a spring portion 131 and an elastic film portion 130. The spring portion 131 and the elastic film portion 130 serve as a pressure maintaining unit as will be described later. Moreover, for convenience of explanation, the first diaphragm 103 and the second diaphragm 104 are hereinafter referred to simply as diaphragms.

In the second embodiment, two openings, that is, the first inlet 111*a* and the first outlet 113*a*, are formed in the first pump chamber 107. Moreover, two openings, that is, the second inlet 111*b* and the second outlet 113*b*, are formed in the second pump chamber 108. Absorbing and discharging processes are respectively carried out through these openings 111*a*, 113*a*, 111*b* and 113*b* formed in the first and second pump chambers 107, 108 so that pump operations are executed. The structures and functions of the respective portions are substantially the same as those of the first embodiment.

In the first embodiment, the first and second diaphragms 103, 104 are respectively formed into concave shapes when viewed from the electrolyte chamber 109 toward the first and second pump chambers 107, 108; however, in the second embodiment, the first and second diaphragms 103, 104 are respectively formed into swelling convex shapes when viewed from the electrolyte chamber 109 toward the first and second pump chambers 107, 108.

Moreover, in the first embodiment, the spring portion 131 is secured with a contracted shape from the normal shape; however, in the second embodiment, the spring portion 131 is secured with an extended shape from the normal shape.

Furthermore, in the first embodiment, for example, as shown in FIG. 3, the elastic film portion 130 receives a rightward force from the spring portion 131, and is deformed into a convex shape protruding rightward; however, in the second embodiment, for example, as shown in FIG. 13, the elastic film portion 130 receives a leftward force from the spring portion 131, and is deformed into a convex shape protruding leftward.

In the first embodiment, the fluid transporting device is designed so that during pump operations, the pressure of the electrolyte is made smaller than the pressure to be applied to the first pump chamber 107 and the second pump chamber 108; however, in the second embodiment, the fluid transporting device is designed so that the pressure of the electrolyte is made greater than the pressure to be applied to the first pump chamber 107 and the second pump chamber 108 during pump operations.

In the initial state of the fluid transporting device in the second embodiment, as the method for making the pressure of the electrolyte filled into the electrolyte chamber 109 greater than the pressure to be applied to the first pump chamber 107 and the second pump chamber 108 during pump operations, for example, a method is proposed in which, upon assembling the respective parts of the fluid transporting device with an electrolyte filled therein, a small through hole 102*g* is preliminarily formed on the side wall 102*s* of the casing unit 102, and after the electrolyte has been injected into the electrolyte chamber 109 from the through hole 102*g* by using a tool such as a syringe, the through hole 102*g* is then sealed by a sealing member 102*f* so that the pressure of the electrolyte is set to a predetermined pressure. Moreover, another method is proposed in which, after the respective parts of the fluid transporting device have been assembled, prior to filling it with the electrolyte, an outward drawing force is applied to the elastic film portion 130, and in this state, the inside of the electrolyte chamber 109 is filled with the electrolyte, and the electrolyte chamber 109 is then sealed, and the outward drawing force to the elastic film portion 130 is removed so that by utilizing the forces of the elastic film portion 130 and the spring portion 131 to try to return to their original shapes by their elasticity, the pressure of the electrolyte is increased, and the pressure of the electrolyte is set to a predetermined pressure, that is, the pressure of the electrolyte filled inside the electrolyte chamber 109 is made greater than the pressure to be applied to the pump chamber 107 and the second pump chamber 108 during pump operations. Additionally, upon injecting the electrolyte into the electrolyte chamber 109, an air hole used for externally driving inside air is preliminarily formed, and after the injection, the air hole may be sealed.

In the same manner as in the first embodiment, upon changing the voltage of the power supply 110*c* as a sine wave or a rectangular wave of, for example, ±1.5V, since the conductive polymer films respectively forming the first and second diaphragms 103, 104 are subjected to electrochemomechanical expansion and contraction so that fluids are respectively sucked through the first and second inlets 111*a* and 111*b*, and then respectively discharged from the first and second outlets 113*a* and 113*b* so that the pump operations are carried out.

In the second embodiment, since the electrolyte chamber 109 is filled with the electrolyte serving as a non-compressive fluid, during the pump operations, the volume of the electrolyte chamber 109 is maintained substantially constant. For this reason, in a case where one of the diaphragms 103 or 104 is contracted so that the swelled convex shape of one of the diaphragms 103 or 104, viewed from the electrolyte chamber 109 toward the first and second pump chambers 107, 108, becomes smaller, the other diaphragm 104 or 103 receives such a force as to make the swelled convex shape thereof larger, when viewed from the electrolyte chamber 109 toward the first and second pump chambers 107, 108, so as to maintain the volume of the electrolyte chamber 109 substantially constant. That is, the two sheets of the first and second diaphragms 103, 104 carry out energy exchanges mutually as work exchanges through the electrolyte.

Next, the following description will discuss the operations of the elastic film portion 130 and the spring portion 131. As will be explained below in detail, in the same manner as in the first embodiment, the elastic film portion 130 and the spring portion 131 have functions so as to appropriately maintain tensions of the first and second diaphragms 103, 104, while the first and second diaphragms 103, 104 are expanded and contracted.

First, the following description will discuss a function in which, when the first and second diaphragms 103, 104 are expanded and contracted by the electrochemomechanical expansion and contraction of the conductive polymer film during pump operations, the tensions of the first and second diaphragms 103, 104 are appropriately maintained by the elastic film portion 130 and the spring portion 131.

Now, attention is drawn to the inner space of the casing unit 102. The inner space of the casing unit 102 refers to a cylindrical space formed inside the casing unit 102. With respect to a space portion sandwiched by the first and second diaphragms 103, 104 in the inner space of the casing unit 102, when the pumps are operated, the volume of the inner space subtly changes during the operations. At this time, the shape of the elastic film portion 130 is changed so that the volume of the electrolyte chamber 109 is maintained substantially constant. In a case where the space portion sandwiched between the first and second diaphragms 103, 104 in the inner space of the casing unit 102 increases, the swelled convex shape of the elastic film portion 130 becomes larger so that the volume of the electrolyte chamber 109 is maintained substantially constant. In contrast, in a case where the space portion sandwiched between the first and second diaphragms 103, 104 in the inner space of the casing unit 102 decreases, the swelled convex shape of the elastic film portion 130 becomes smaller so that the volume of the electrolyte chamber 109 is maintained substantially constant. As a result, the volume of the electrolyte chamber 109 filled with the electrolyte is made substantially constant so that the pressure of the electrolyte is maintained substantially constant. Consequently, during the pump operations, each of the first and second diaphragms 103, 104 is kept in a deformed state into a convex shape viewed in each of the directions of the first pump chamber 107 and the second pump chamber 108, with a stress (tension) having a size within a constant range being applied to each of the first and second diaphragms 103, 104 in an expanding direction. Since this state is always maintained during pump operations, work exerted by the conductive polymer film in its expansion and contraction is efficiently used for the discharge and suction of the fluid by the first and second pump chambers 107, 108. In this case, it is supposed that the electrolyte chamber 109 corresponds to a space portion surrounded by the first and second diaphragms 130, 104, the wall surface of the casing unit 102, and the elastic film portion 130.

Since the electrolyte is substantially regarded as a non-compressive fluid, the pressure of the electrolyte greatly changes when the volume of the electrolyte chamber 109 changes, with the result that the tension of each of the first and second diaphragms 103, 104 cannot be maintained at an appropriate value. In the second embodiment, the elastic film portion 130 and the spring portion 131 are deformed due to their elasticity so that the inside volume of the electrolytic chamber 109 is maintained constant. With this arrangement, the volume of the electrolyte chamber 109 contained inside the electrolyte chamber 109 is maintained substantially constant, and the pressure of the electrolyte is also maintained within a constant range. As a result, it is possible to maintain the tensions of the first and second diaphragms 103, 104 at appropriate values, and consequently to enhance the work efficiency in the pump operations. In this case, the work efficiency of the pump is defined as a rate of work to be used by the pump to carry out sucking and discharging operations of the fluid relative to electric energy applied to the pump.

The following description will discuss a structure in which, even when there is a change in tension to be applied to the first and second diaphragms 103, 104 due to a reason other than periodic electrochemomechanical expansion and contraction of the conductive polymer films, the tension of the first and second diaphragms 103, 104 is appropriately maintained by the elastic film portion 130 and the spring portion 131.

As described earlier, in general, in the diaphragm-type pump using the conductive polymer film, upon carrying out an operation by applying a periodic voltage to the conductive polymer film, the area, shape or layout of the diaphragm tends to be changed due to the following reason: a strain is accumulated in a fixed direction; or a deformation occurs due to suction of the electrolyte by the conductive polymer film; or a non-reversible or reversible shape change, typically represented by a creep, occurs in the conductive polymer film; or a deformation, a deviation or the like occurs in the fixed portion of the conductive polymer film. In such a case, in a pump shown in the related art, even in a case where, upon manufacturing the fluid transporting device, the conductive polymer film is placed with a tension being applied thereto, there sometimes arises a problem in that it is not possible to apply a desired tension (stress in an extending direction) to the diaphragms.

In the second embodiment, since this change in tension can be sucked by the deformations of the elastic film portion 130 and the spring portion 131, the tension to be applied to the conductive polymer film can be maintained within a constant range.

Figure 14:
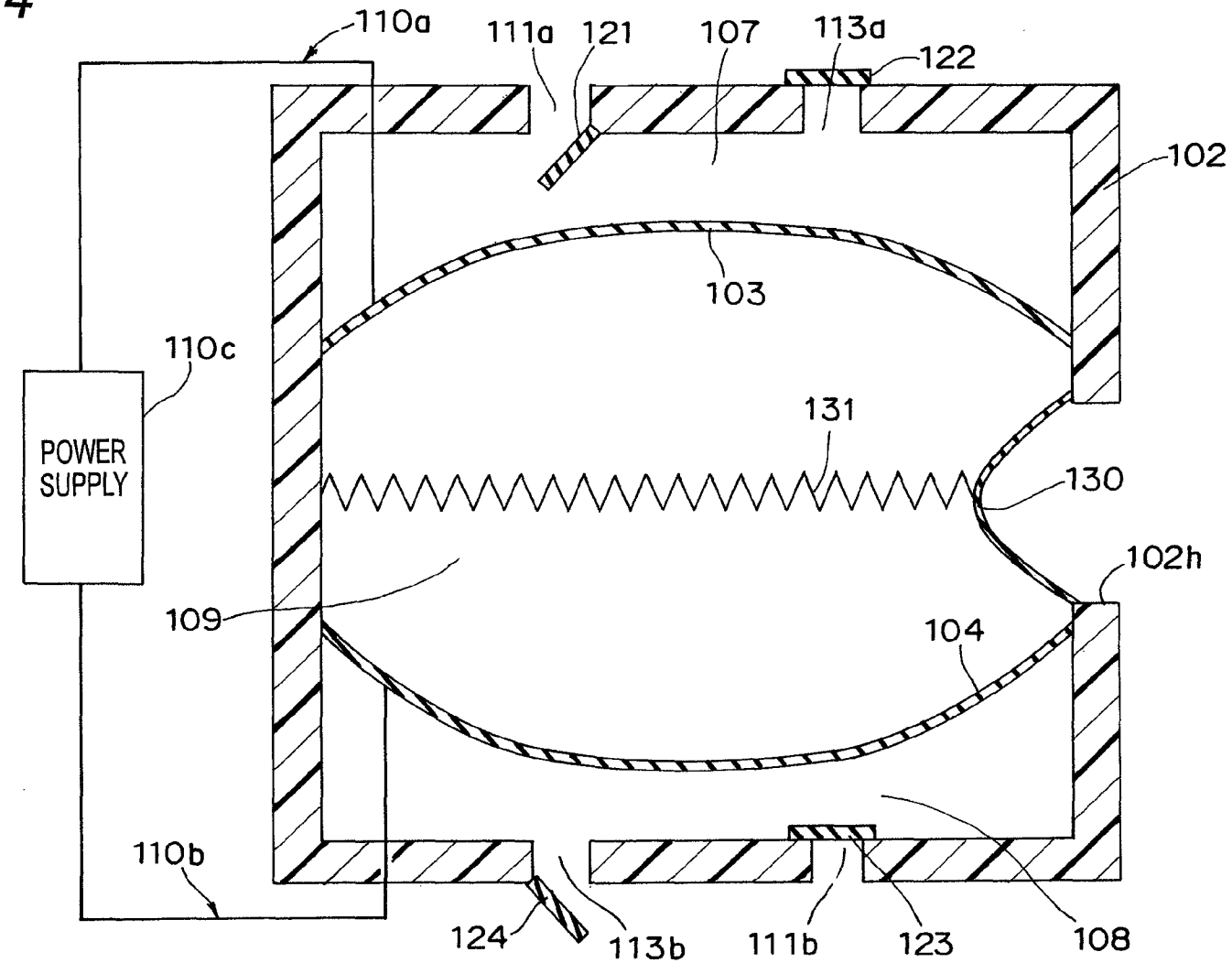
FIG. 14 is a view that shows a state in which the pressure to be applied to a diaphragm is maintained in the fluid transporting device in accordance with the second embodiment of the present invention.

FIG. 14 is a view that shows an example of a state in which, upon occurrence of a change in tension to be applied to the first and second diaphragms 103, 104, the pressure to be applied to the first and second diaphragms 103, 104 is maintained in the fluid transporting device in accordance with the second embodiment. More specifically, FIG. 14 shows a state in which, in a case where the first and second diaphragms 103, 104 are expanded due to any of the above-mentioned reasons, the pressure to be applied to the first and second diaphragms 103, 104 is maintained by the shape changes of the first and second diaphragms 103, 104, the elastic film portion 130 and the spring portion 131. In FIG. 14, the first and second diaphragms 103, 104 are deformed in expanding directions in comparison with those of FIG. 13; therefore, the volume of the electrolyte chamber 109 temporarily increases, with the pressure of the electrolyte solution being decreased, and the spring portion 131 is consequently contracted by the elasticity of the elastic film portion 130 and the spring portion 131 so that the elastic film portion 130 is deformed so as to make the swelled convex shape of the elastic film portion 130 larger relative to the inside of the electrolyte chamber 109, when viewed from the outside of the casing unit 102. As a result, the volume of the electrolyte chamber 109 is returned to substantially its initial state value. Consequently, the pressure of the electrolyte is returned to substantially its initial state value so that the first and second diaphragms 103, 104 are deformed into a convex shape, when viewed from the electrolyte chamber 109 toward the first pump chamber 107 and the second pump chamber 108, and maintained with a stress (tension) in the extending direction being applied to the first and second diaphragms 103, 104 within an appropriate range.

In contrast, in a case where the first and second diaphragms 103, 104 are contracted to any of the above-mentioned reasons, the spring portion 131 is expanded by the elasticity of the elastic film portion 130 and the spring portion 131 so that the elastic film portion 130 is deformed so as to make its swelled convex shape smaller relative to the inside of the electrolyte chamber 109 when viewed from the outside of the casing unit 102. With this arrangement, the pressure of the electrolyte is maintained substantially at an initial state value so that the first and second diaphragms 103, 104 are deformed into a convex shape when viewed in the direction of the first pump chamber 107 and the second pump chamber 108, with a stress (tension) in an extending direction being set to a size within an appropriate range.

In this manner, during pump operations, since the stress (tension) in the extending direction of the first and second diaphragms 103, 104 is always maintained within an appropriate range (in other words, the pressure inside the electrolyte chamber 109 and the pressure of the fluid inside the first and second pump chambers 107, 108 are respectively maintained within predetermined ranges), work exerted upon expansion and contraction of the conductive polymer film is effectively utilized for the discharge and suction of the fluid of the first and second pump chambers 107, 108.

In summary, in the same manner as in the first embodiment, the fluid transporting device of the second embodiment allows the elastic film portion 130 and the spring portion 131 to have a function (pressure maintaining function) for maintaining the pressure to be applied to the first and second diaphragms 103, 104 within an appropriate range. In the present specification, a unit having a function for maintaining the pressure to be given to the first and second diaphragms 103, 104 in an appropriate range is referred to as a pressure maintaining unit. That is, in the second embodiment, the elastic film portion 130 and the spring portion 131 form the pressure maintaining unit. For example, in a case where one of the first and second diaphragms 103, 104 is expanded, with the other diaphragm 104 or 103 being slackened in its stress (tension) in the expanding direction, the spring portion 131 is deformed in a contracting direction so that the electrolyte is pushed out in the direction of the first and second diaphragms 103, 104; thus, the stress (tension) of the first and second diaphragms 103, 104 is maintained within a constant range (in other words, the pressure of the fluid in the first and second pump chambers 107, 108 is maintained within a predetermined range). That is, since the elastic film portion 130 corresponding to one portion of the wall surface of the electrolyte chamber 109 is deformed in response to a change in the stress (tension) due to the deformation of the first and second diaphragms 103, 104, the stress (tension) of the first and second diaphragms 103, 104 is maintained within a constant range (in other words, the pressure of the inside of the electrolyte chamber 109 and the pressure of the fluid in the first and second pump chambers 107, 108 are respectively maintained within predetermined ranges). Moreover, since no securing point is formed in the center portions of the first and second diaphragms 103, 104 in this structure, the first and second diaphragms 103, 104 are maintained in an expanded convex shape by an appropriate tension, without being slackened, by the pressure difference between the first and second pumps 107, 108 and the electrolyte chamber 109; thus, the stress (tension) of the first and second diaphragms 103, 104 is maintained substantially at a uniform value over the entire face (in other words, the pressure of the fluid inside the first and second pump chambers 107, 108 is maintained within a predetermined range). Since this state is always kept during pump operations, work exerted by the expansion and contraction of the first and second diaphragms 103, 104 of the conductive polymer films is efficiently used for the discharge and suction of the fluid of the first and second pump chambers 107, 108. Supposing that a rate of work to be used by the pump to carry out discharging and sucking operations of the fluid in the first and second pumps 107 and 108 relative to electric energy given from the power supply 110*c* is referred to as work efficiency, the work efficiency of the pump can be improved in comparison with the conventional pump by the above-mentioned pressure-maintaining function.

Third Embodiment

Figure 15:
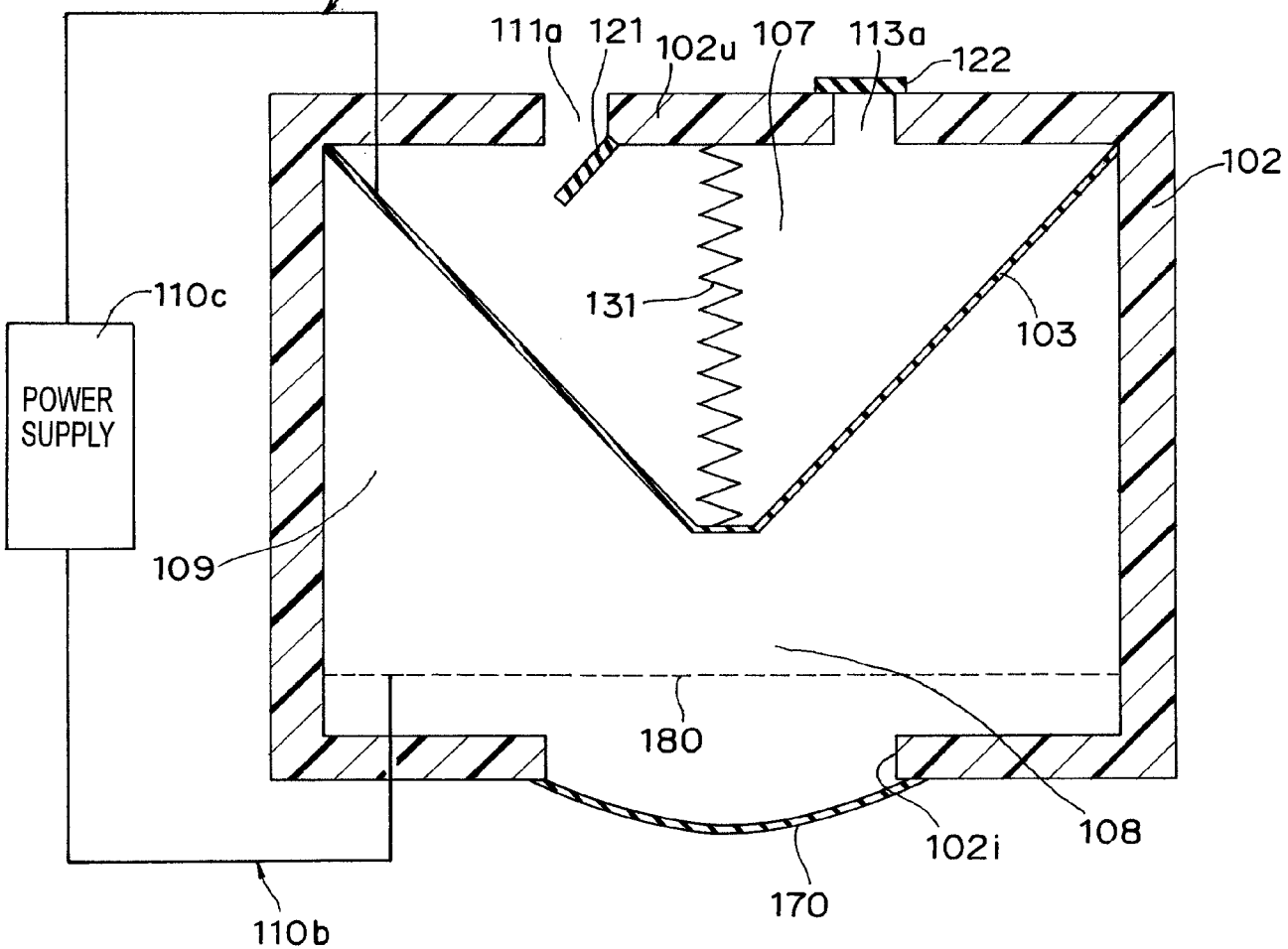
FIG. 15 is a block diagram that shows a fluid transporting device using a conductive polymer in accordance with a third embodiment of the present invention.

FIG. 15 is a cross-sectional view that shows a fluid transporting device using a conductive polymer in accordance with a third embodiment of the present invention.

The fluid transporting device of the third embodiment is provided with a casing unit 102, a first diaphragm 103, a pump chamber 107, an electrolyte chamber 109, wiring portions 110*a* and 110*b*, an inlet 111*a*, an outlet 113*a*, an inlet valve 121, an outlet valve 122, a spring portion 131 serving as one example of an elastic portion, an elastic film portion 130, a second elastic film portion 170 and an opposed electrode portion 180. The spring portion 131 and the second elastic film portion 170 serve as a pressure maintaining unit as will be described later.

The second elastic film portion 170 is secured to the outside edge of the opening of a through hole 102*i* formed on the bottom face on the lower side of the casing unit 102 so as to air-tightly close the inside of the casing unit 102.

The two ends of a coil spring forming the spring portion 131 are respectively connected to the center portion of the upper wall 102*u* of the casing unit 102 and the first diaphragm 103, and the spring portion 131 is placed in a contracted state from its normal state. One portion or the entire portion of the first diaphragm 103 is made of a conductive polymer film, and the electrolyte chamber 109 is filled with an electrolyte. By applying a voltage between the conductive polymer film forming the first diaphragm 103 and the opposed electrode portion 180 from a power supply 110*c*, the conductive polymer film forming the first diaphragm 103 is subjected to electrochemomechanical expansion and contraction so that the first diaphragm 103 is moved up and down in FIG. 15 to carry out the suction and discharge of the fluid. The opposed electrode portion 180 is formed by a mesh or the like, for example, made of platinum so that the electrolyte is allowed to move toward the two sides thereof.

In this case, by forming platinum into the mesh shape, the surface area of platinum becomes greater, and the capacitance of the electric double-layered capacitor formed on an interface between the platinum and the electrolyte becomes greater. As a result, the electric potential difference between the platinum and the electrolyte becomes smaller so that it becomes possible to carry out the electrochemomechanical expansion and contraction of the diaphragm efficiently by using a small power-supply voltage.

Figure 16:
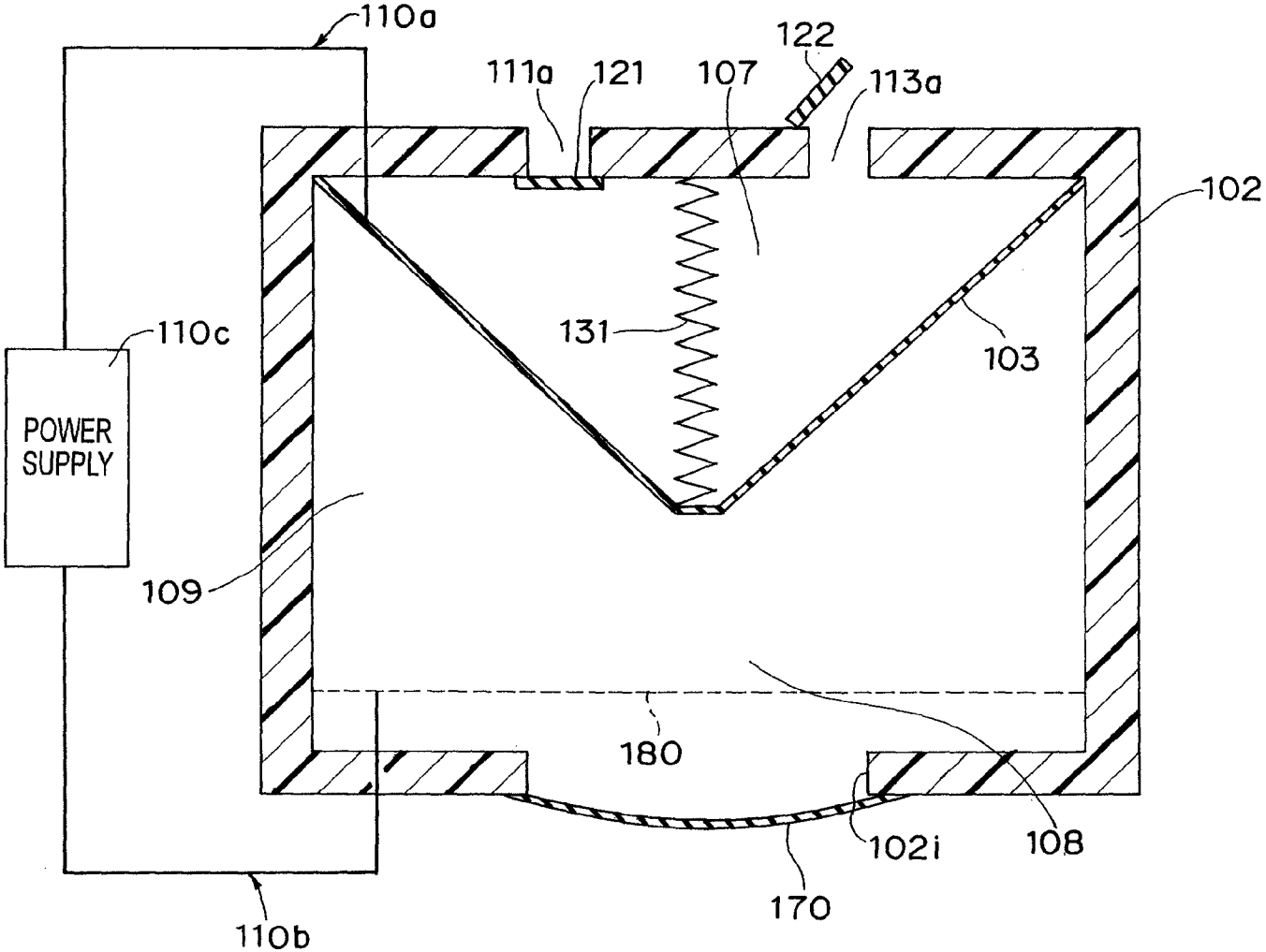
FIG. 16 is a view that shows a state of operations carried out in the fluid transporting device in accordance with the third embodiment of the present invention.

In the state of FIG. 15, the first diaphragm 103 is expanded due to the electrochemomechanical expansion and contraction, and in the state of FIG. 16, the first diaphragm 103 is contracted due to the electrochemomechanical expansion and contraction. With this arrangement, since the volume of the pump chamber 107 is increased and degreased, the suction and discharge of the fluid are carried out. In the state of FIG. 15, the fluid is sucked through the inlet 111*a*, and in the state of FIG. 16, the fluid is discharged from the outlet 113*a*. Since the electrolyte filled into the electrolyte chamber 107 is substantially regarded as a non-compressive fluid, its volume is kept substantially constant. For this reason, in accordance with the up and down movements of the first diaphragm 103 in FIG. 15, the second elastic film portion 170 also carries out up and down movements, with the volume of the electrolyte chamber 109 being kept substantially constant. In FIG. 15, the swelled convex shape of the second elastic film portion 170, viewed from the electrolyte chamber 109 toward the outside of the casing unit 102, becomes smaller, and in FIG. 16, the swelled convex shape of the second elastic film portion 170, viewed from the electrolyte chamber 109 toward the outside of the casing unit 102, becomes smaller.

Figure 17:
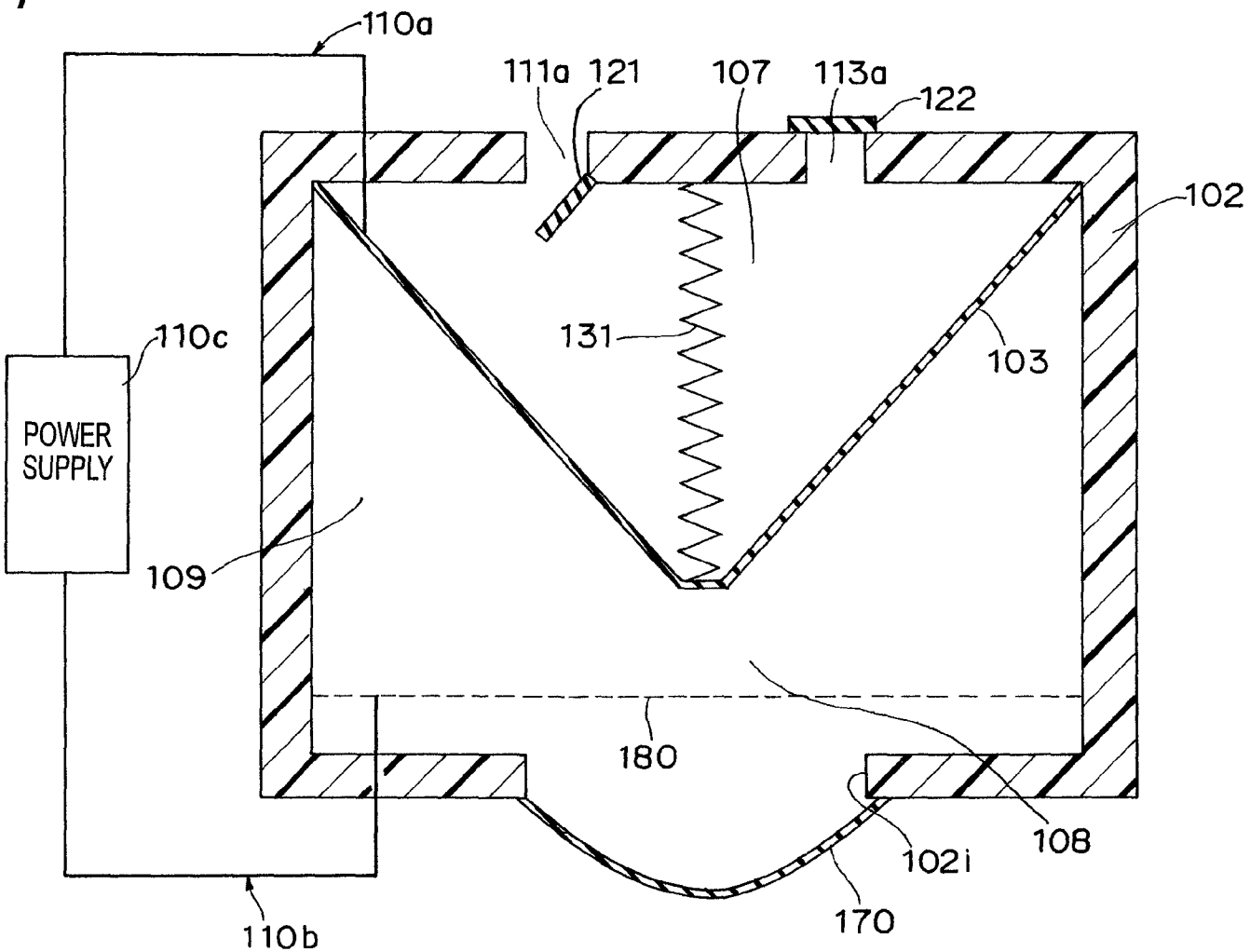
FIG. 17 is a view that shows a state in which the pressure to be applied to a diaphragm is maintained in the fluid transporting device in accordance with the third embodiment of the present invention.

The structures, operations or effects of the pressure maintaining unit constituted by the second elastic film portion 170 and the spring portion 131 are substantially the same as those of the elastic film portion 130 and the spring portion 131 of the second embodiment. That is, in response to a change in the volume of the pump chamber 107, the volume of the electrolyte chamber 109 is also changed. Accordingly, the shape of the second elastic film portion 170 is changed in a manner so as to maintain the volume of the electrolyte chamber 109 substantially constant. As shown in FIG. 17, in a case where the volume of the electrolyte chamber 109 is increased, since the pressure of the electrolyte is subsequently reduced, the balances between the elastic force of the second elastic film portion 170 and the elastic force of the spring portion 131 in the second elastic film portion 170, as well as between the pressure of the electrolyte and the pressure of the external atmosphere of the casing unit 102, are changed. As a result, the swelled convex shape of the second elastic film portion 170 becomes greater, when viewed from the electrolyte chamber 109 toward the outside of the casing unit 102. Consequently, the volume of the electrolyte chamber 109 is maintained substantially constant. In contrast, in a case where, as shown in FIG. 16, the volume of the electrolyte chamber 109 is reduced, since the pressure of the electrolyte increases accordingly, the balances between the elastic force of the second elastic film portion 170 and the elastic force of the spring portion 131 in the second elastic film portion 170, as well as between the pressure of the electrolyte and the pressure of the external atmosphere, are changed. As a result, the swelled convex shape of the elastic film portion 170, viewed from the electrolyte chamber 109 toward the outside of the casing unit 102, becomes smaller. Consequently, the volume of the electrolyte chamber 109 is maintained substantially constant. As a result of these operations, the volume of the electrolyte chamber 109 filled in the electrolyte chamber 109 is made substantially constant so that the pressure of the electrolyte is also maintained substantially constant.

FIGS. 15 and 16 show sucking and discharging operations of the fluid. In the third embodiment, as described earlier, the elastic film portion 170 carries out operations for pressure maintaining functions. FIG. 17 shows a state in which the diaphragm 103 is expanded for the reason described above. At this time, since the swelled convex shape of the elastic film portion 170 becomes larger, the volume of the electrolyte chamber 109 is maintained substantially constant so that the pressure of the electrolyte is also maintained within an appropriate range. Since the first diaphragm 103 always receives a downward force in FIG. 17 from the spring portion 131, it always maintains an appropriate stress (tension) without being slackened. In contrast, in a case where no elastic film portion 170 is placed, since the pressure of the electrolyte changes greatly even when the first diaphragm 103 moves slightly, the movement of the first diaphragm 103 is disturbed, with the result that the first diaphragm 103 is hardly allowed to move. In the third embodiment, since the stress (tension) of the first diaphragm 103 is maintained at an appropriate value (in other words, the pressure of the fluid inside the pump chamber 107 is maintained within a predetermined range), it is possible to carry out operations efficiently.

Additionally, in the structure in which only one pump chamber 107 is provided as in the case of the third embodiment, since the structure is made simpler, features such as easy production and easy maintenance can be obtained.

Fourth Embodiment

Figure 18:
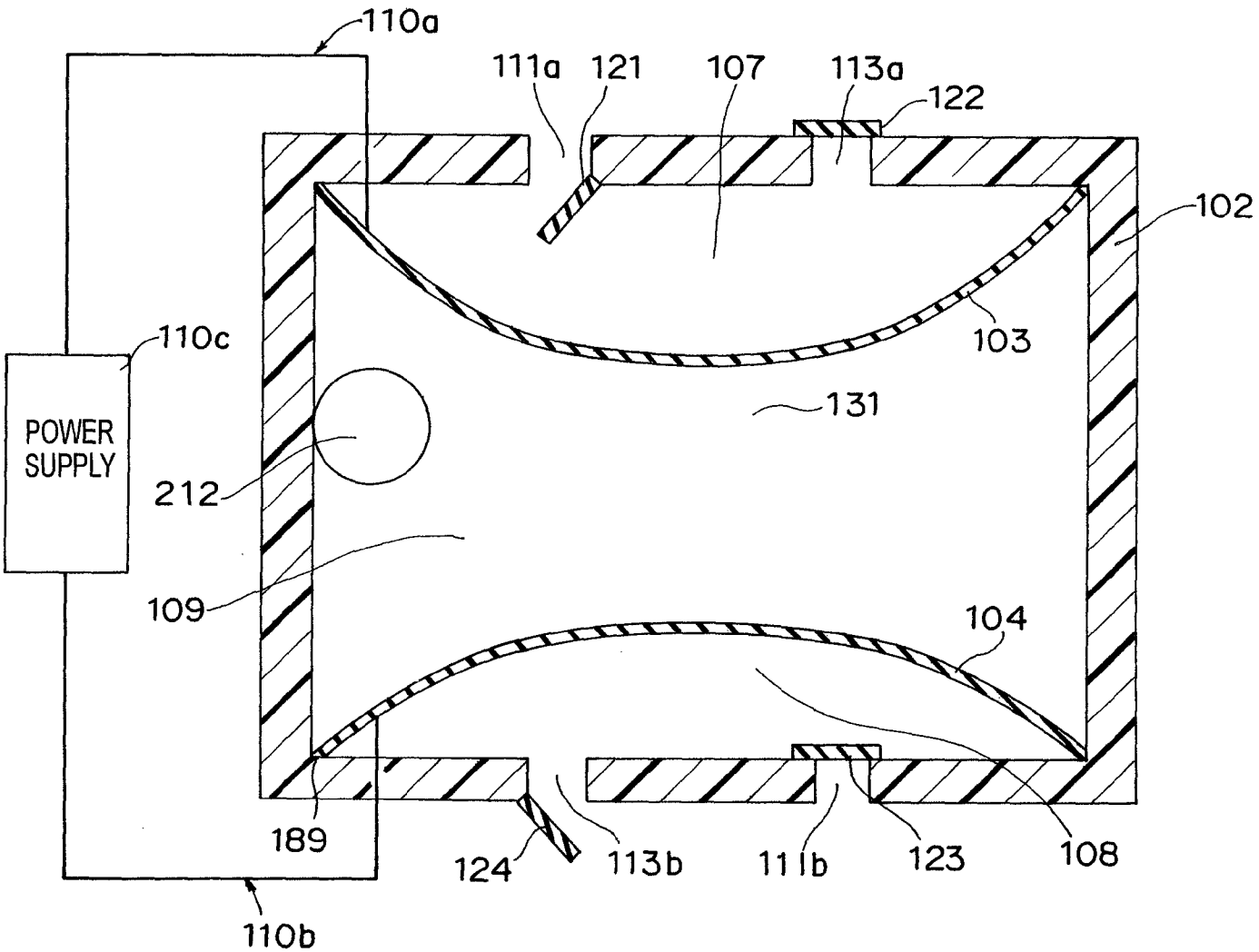
FIG. 18 is a block diagram that shows a fluid transporting device using a conductive polymer in accordance with a fourth embodiment of the present invention.

FIG. 18 shows the structure of a fluid transporting device using a conductive polymer in accordance with a fourth embodiment of the present invention.

The above description has mainly exemplified a structure in which the electrolyte chamber 109 is filled only with the electrolyte; however, one portion of the electrolyte chamber 109 may be filled with a gas. In this case, by utilizing the elasticity of the gas, the pressure to be applied to the first and second diaphragms 103, 104 may be maintained within a predetermined range. In FIG. 18, an electrolyte and a bubble are mixedly contained in the electrolyte chamber 109. The bubble forms a bubble portion 202 made of a gas such as air that does not chemically react with the electrolyte. The elasticity of the bubble in FIG. 18 exerts the same functions as those of the elastic film portion 130 and the spring portion 131 in FIG. 3, and can maintain the pressure to be applied to the first and second diaphragms 103, 104 within a predetermined range. This is explained as follows: In FIG. 18, the pressure of the electrolyte inside the electrolytic chamber 109 is set to be smaller than the pressure of the fluid in the first and second pump chambers 107, 108. By utilizing this pressure difference, the first and second diaphragms 103, 104 are maintained with a stress (tension) being applied to the first and second diaphragms 103, 104. For example, in a case where the pressure of the fluid in the first and second pump chambers 107, 108 is equal to the atmospheric pressure, since the electrolyte and the bubble portion 212 have a pressure smaller than that left under the atmospheric pressure, the bubble portion 212 is swelled. In this case, since the electrolyte is a substantially non-compressive fluid, the degree of swelling of the bubble portion 212 is extremely small. For example, in a case where the first and second diaphragms 103, 104 are expanded from this state, since the volume of the electrolyte chamber 109 is reduced, the pressures of the electrolyte and the bubble portion 212 are respectively increased. In a case where only the electrolyte is contained in the electrolyte chamber 109, since the electrolyte is a substantially non-compressive fluid and thus the pressure of the electrolyte is consequently increased abruptly, the pressure difference between the fluid inside the first and second pump chambers 107, 108 and the electrolyte inside the electrolyte chamber 109 becomes extremely small in such a manner that the stress (tension) of the first and second diaphragms 103, 104 is reduced to bring the first and second diaphragms 103, 104 into a slackened state, with the result that the pump operations are disturbed. In contrast, in the structure of FIG. 18, since the elastic modulus of the bubble portion 212 in the electrolyte chamber 109 is small, the change in pressure is small even when the volume is changed. That is, the bubble portion 212 functions so as to suck the pressure change inside the electrolyte chamber 109 due to the volume change of the electrolyte chamber 109 so that the pressure of the electrolyte and the bubble portion 212 inside the electrolyte chamber 109 is maintained at an appropriate value. For this reason, since the pressure difference between the fluid inside the first and second pump chambers 107, 108 and the electrolyte inside the electrolyte chamber 109 is also maintained within a constant range, the stress (tension) of the first and second diaphragms 103, 104 is maintained at an appropriate value (in other words, the pressure of the fluid inside the first and second pump chambers 107, 108 is maintained within a predetermined range). That is, the bubble portion 212 exerts a pressure maintaining function for the first and second diaphragms 103, 104. For this reason, in comparison with the structure having no pressure maintaining function for the first and second diaphragms 103, 104, the pressure to be applied to the diaphragm is maintained within an appropriate range even upon occurrence of a deformation or the like of the first and second diaphragms 103, 104 so that the operation efficiency of the pump is improved. In the case of the application of the bubble portion 212, it is possible to automatically maintain the pressure to be applied to the first and second diaphragms 103, 104 within an appropriate range by using a simple structure.

Now, suppose that the amount of discharge and amount of suction of the pump obtained by one cycle of the expansion and contraction of the first and second diaphragms 103, 104 are respectively set to $V_0$. In this case, the volume of the gas to be contained in the electrolyte chamber 109 is preferably set to 10% or more of the pump amount of discharge or amount of suction $V_0$. This can be understood, for example, by the following example.

Figure 26:
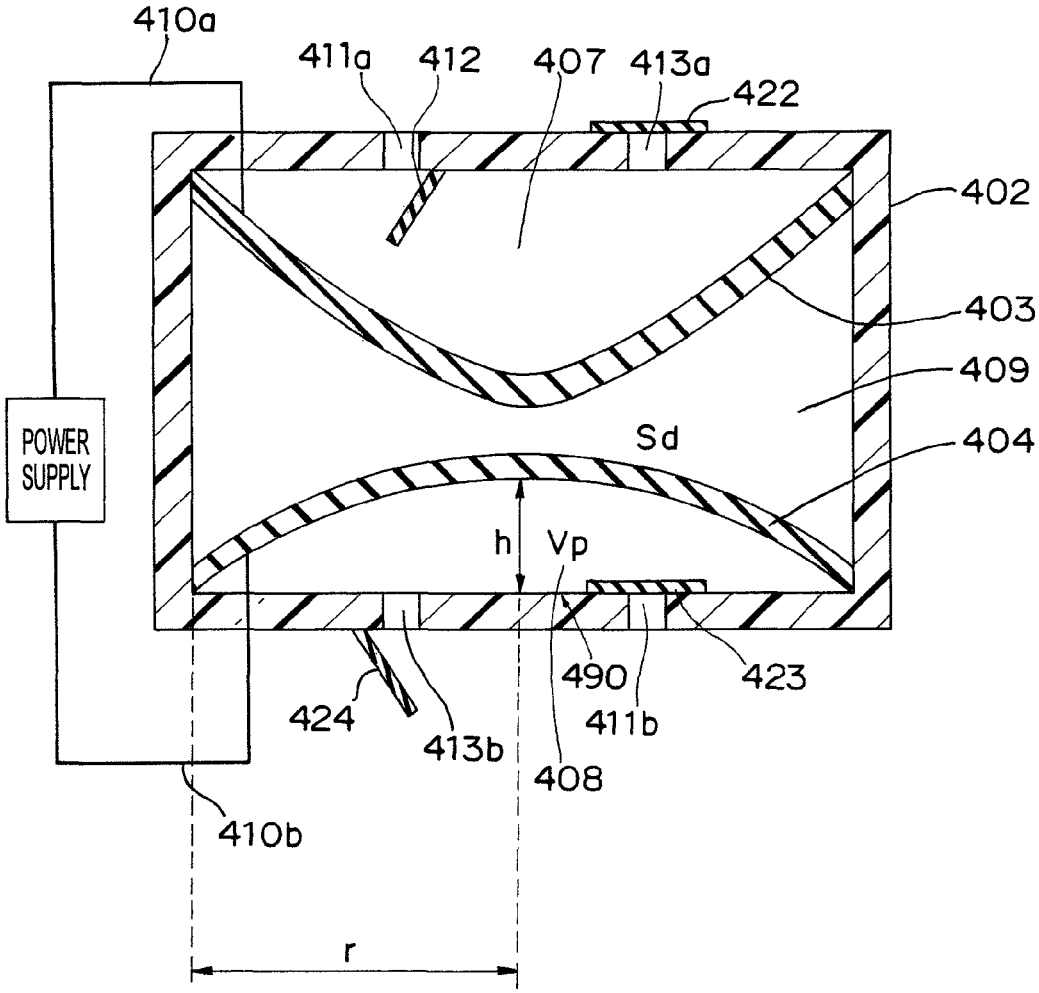
FIG. 26 is a view that explains the relationship between the area and volume of each of the portions of the pump.

The explanation will be given by exemplifying a pump shown in FIG. 22B. As shown in FIG. 26, attention is drawn to the second diaphragm 404. Moreover, suppose that the bottom face 490 of a casing unit 402 has a round shape. Suppose that the area of the second diaphragm 404 is $S_d$. Suppose that the volume of the second pump chamber 408 is $V_p$. Furthermore, suppose that a distance between the center portion of the second diaphragm 404 and the bottom face of the casing unit 402 is h. Suppose that a radius of the bottom face 490 is r. For convenience of explanation, the following assumptions are given. Suppose that the size of h at the time of the most contracted state of the second diaphragm 404 upon its electrochemomechanical expansion and contraction is 0. Moreover, as shown in FIG. 19, suppose that the shape of the second diaphragm 404 always includes a peripheral portion of the bottom face 490, and forms one portion of a spherical surface (spherical crown). FIG. 19 shows an example in which the second diaphragm 404 forms one portion of a spherical surface having a radius of $R_0$. The above-mentioned assumptions are obtained from approximation of the shape of the second diaphragm 404 in its expanded state without being slackened as the shape of the spherical crown.

At this time, the volume $V_p$ of the second pump chamber 408 is given by the following (relational expression 1).

$$V_p=\pi\times h/6\times(3\times r^2+h^2) \quad \text{(Relational Expression 1).}$$

Moreover, the area $S_d$ of the second diaphragm 404 is given by the following (relational expression 2).

$$S_d=\pi\times(r^2+h^2) \quad \text{(Relational Expression 2).}$$

Now, suppose that $V_i=2/3\times\pi\times r^3$. Moreover, suppose that $S_i=\pi\times r^2$. In this case, it represents the circular constant. In general, the size of periodic electrochemomechanical expansion and contraction of the area of the second diaphragm 404 of the conductive polymer film in the pump is 10% or less of the area of the second diaphragm 404 in the initial state. Under the above-mentioned assumptions, since the area of the second diaphragm 404 in the initial state is given as $S_i$, the area of the second diaphragm 404 is generally changed within the following range during pump operations.

$$S_i \leqq (\text{area of the second diaphragm } 404) \leqq S_i\times 1.1$$

In a case where the area of the second diaphragm 404 is represented by ($S_i\times 1.1$), the following relationship is obtained from the above-mentioned (relational expression 2): h 0.32×r. At this time, the volume of the second pump chamber 408 is given by $V_p\approx 0.2\times V_i$ from the above-mentioned (relational expression 1). The above-mentioned considerations indicate that, in a pump as shown in FIG. 22B, when the conductive polymer film forming the second diaphragm 404 carries out periodic electrochemomechanical expansion and contraction, the volume of the fluid to be discharged from the second pump chamber 408, that is, the volume $V_0$ of the fluid to be sucked into the second pump chamber 408, upon carrying out one cycle of the electrochemomechanical expansion and contraction, is set to a value of ($0.2\times V_i$) or less.

Figure 23:
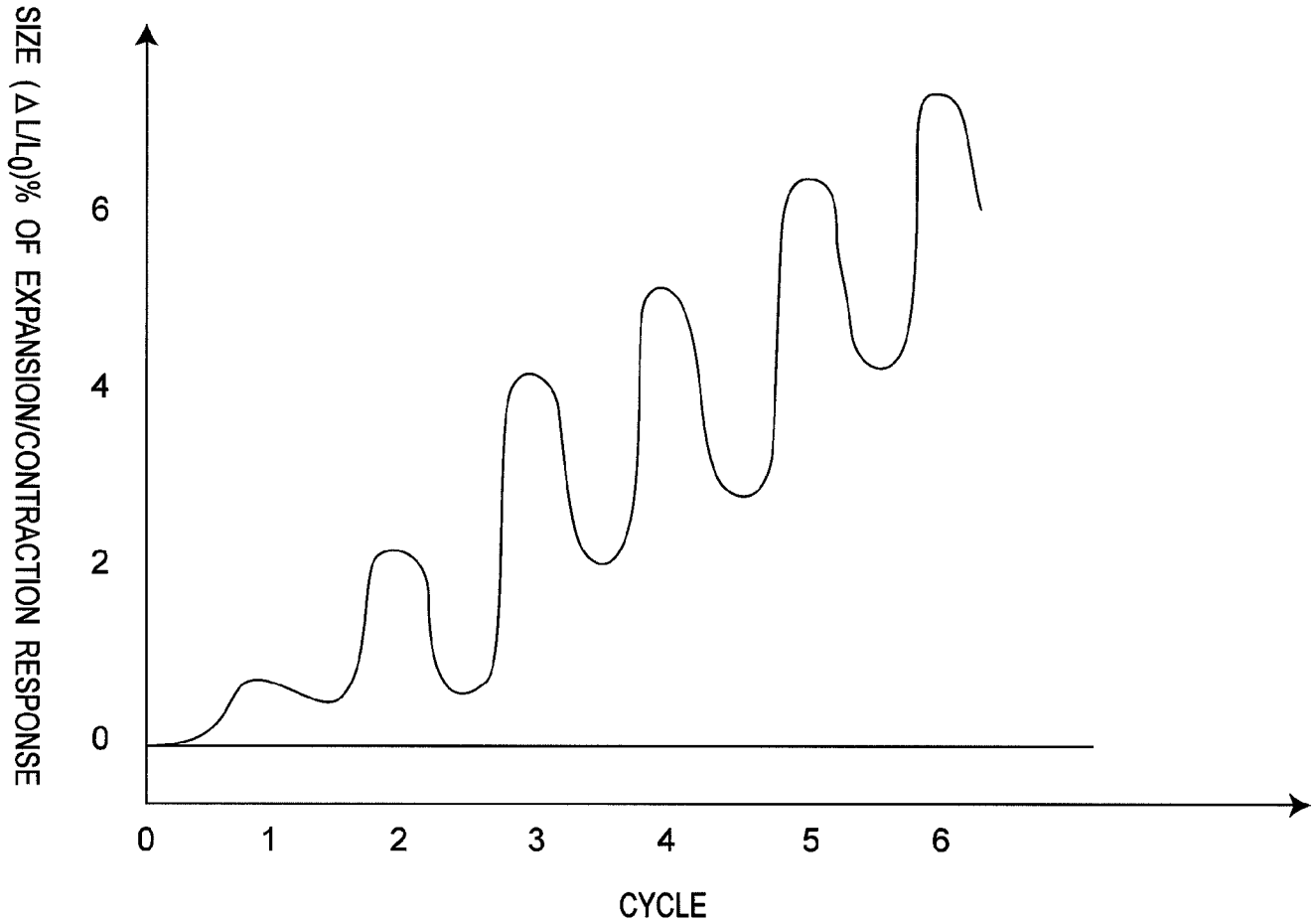
FIG. 23 is a view that shows a change in strain of a film due to electrochemomechanical expansion and contraction of a conductive polymer film.
Figure 24A:
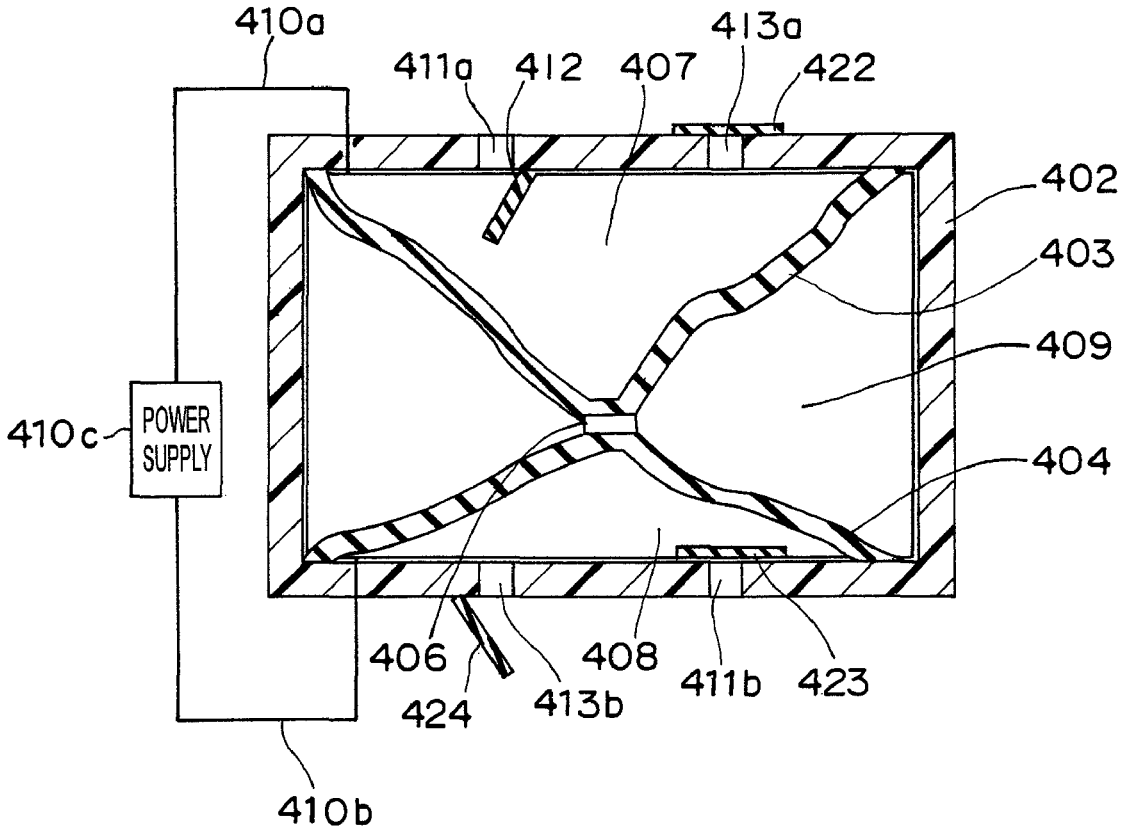
FIG. 24A is a view that shows a slackened state of the conductive polymer film in the pump of FIG. 22A.
Figure 24B:
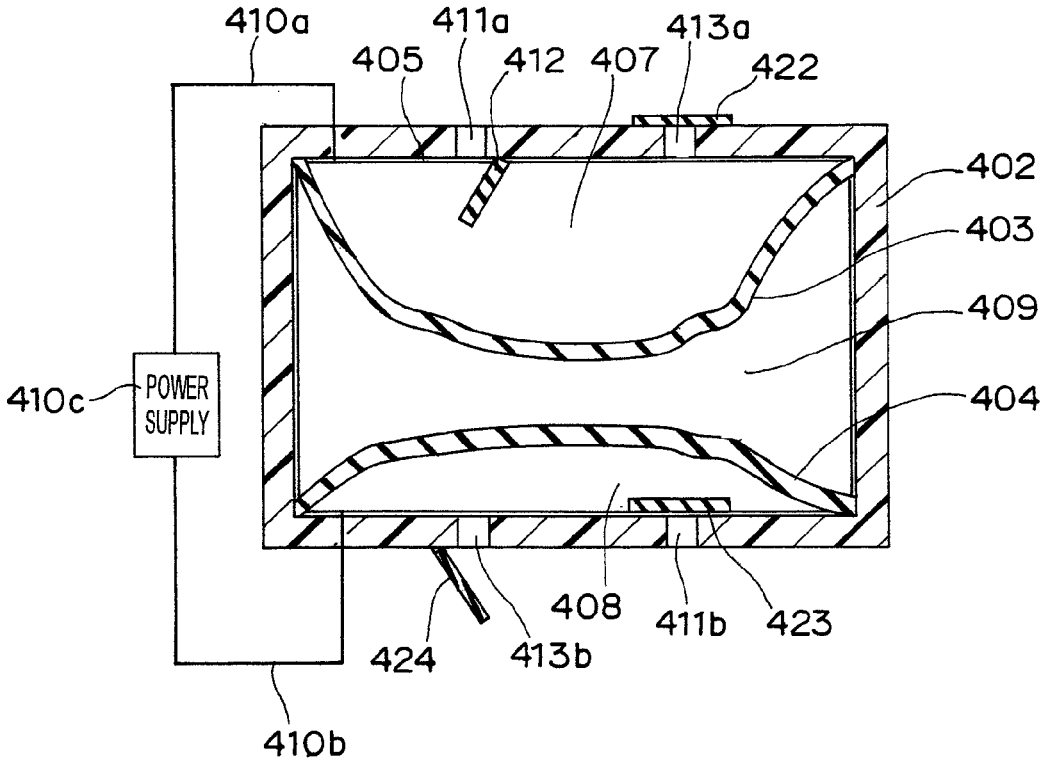
FIG. 24B is a view that shows a slackened state of the conductive polymer film in the pump of FIG. 22B.
Figure 24C:
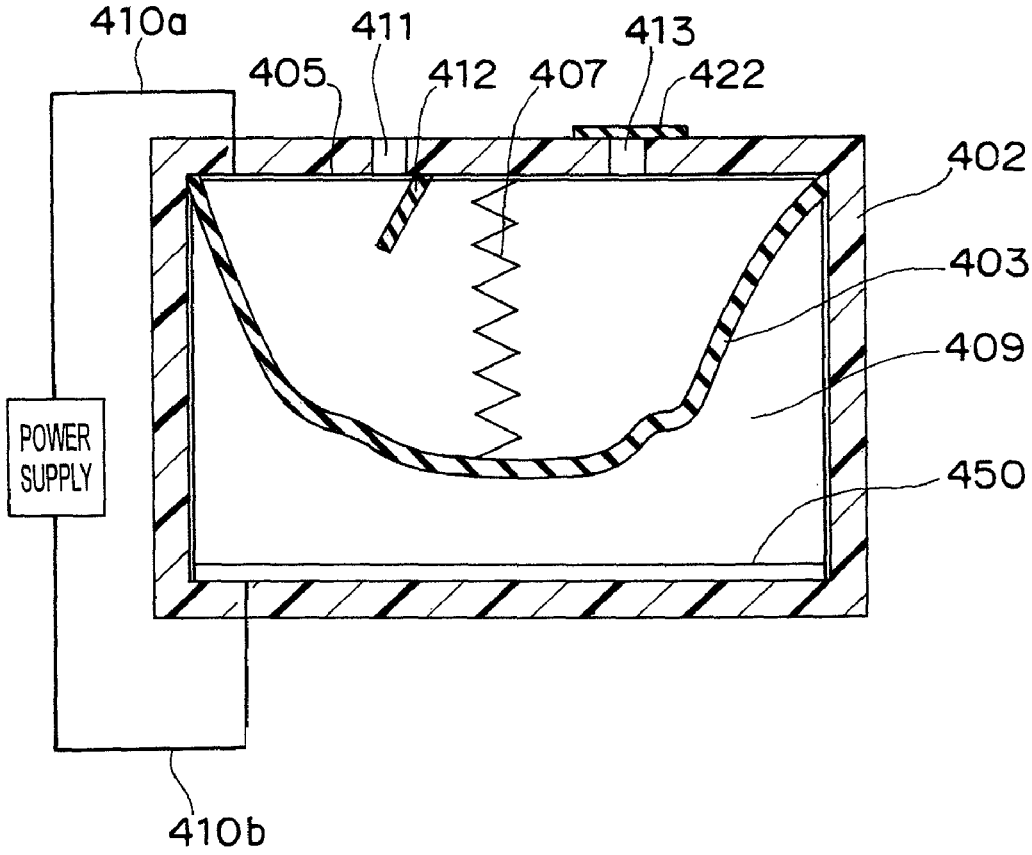
FIG. 24C is a view that shows a slackened state of the conductive polymer film in the pump of FIG. 22C.

On the other hand, in a case where the conductive polymer film carries out periodic electrochemomechanical expansion and contraction, as preliminarily explained by reference to FIG. 23, the second diaphragm 404 tends to be expanded to gradually cause a change in the center of the periodic change. The reason for this is presumably because, for example, the conductive polymer film is deformed by viscoelasticity. In general, the size of a change in the area of the second diaphragm 404 upon operation of the pump for a long period of time becomes a value of about 0.1% or more of the area of the second diaphragm 404 in the initial state. Supposing that the area $S_d$ of the second diaphragm 404 is represented by $S_d=0.001\times S_d$, an expression, $h\approx 0.032\times r$, holds under the aforementioned assumptions (relational expression 2). In this case, the volume of the second pump chamber 408 is given by $V_p\approx 0.02\times V_i$ from the aforementioned (relational expression 1). Supposing that the area of the second diaphragm 404 has changed from the initial state $S_i$ to $0.001\times S_i$ because of a deformation or the like due to the viscoelasticity of the conductive polymer film, the volume $V_p$ of the second pump 408 changes from about 0 to $0.02\times V_i$. That is, the volume $V_p$ of the second pump 408 is increased by $0.02\times V_i$. In the pump of FIG. 22B, the volume of the inside of casing unit is constant; therefore, supposing that the volume of the first pump chamber 407 has no change at this time, the volume of the electrolyte chamber 409 is reduced by $0.02\times V_1$. The above-mentioned considerations indicate that in a case where the area of the second diaphragm 404 increases because of the deformation or the like due to the viscoelasticity of the conductive polymer film, although the volume of the electrolyte chamber 409 decreases, the amount of a decease is generally set to a value of $0.02\times V_i$ or more. Since the electrolyte is a non-compressive fluid, the volume of the electrolyte chamber 409 is maintained constant in a case where only the electrolyte is contained in the electrolyte chamber 409. Therefore, upon increase of the area of the second diaphragm 404 because of the deformation or the like due to the viscoelasticity of the conductive polymer film, the aforementioned assumptions are not satisfied, with the result that the second diaphragm 404 is brought into a slackened state as shown in FIG. 24B. In a case where the second diaphragm 404 is in the slackened state, since the force of electrochemomechanical expansion and contraction of the conductive polymer film is not transmitted to the discharge and suction of the fluid, but is consequently released to escape, with the result that the pump efficiency is undesirably lowered.

In contrast, in accordance with the fourth embodiment, since a gas is contained in the electrolyte to form the bubble portion 212, the gas of the bubble portion 212 is allowed to change its volume so that the volume change of the electrolyte chamber 109 can be sucked by the volume change of the gas of the bubble portion 212; therefore, for example, it is possible to prevent the second diaphragm 104 from being slackened.

In general, in a case where, as described above, the area of the diaphragm increases because of the deformation or the like due to the viscoelasticity of the conductive polymer film, the volume of the electrolyte chamber is reduced; however, the amount of reduction of the electrolyte chamber when the pump is operated for a long period of time is set to a value of $(0.02\times V_i)$ or more. Therefore, in order to suck this volume change by the volume change of the gas contained in the electrolyte chamber, the volume of the gas in the initial state needs to be set to $(0.02\times V_i)$ or more.

As described above, in the pump shown in FIG. 22B, when the conductive polymer film forming the diaphragm carries out periodic electrochemomechanical expansion and contraction, the volume of the fluid to be discharged from the pump chamber, that is, the volume of the fluid to be sucked into the pump chamber, upon carrying out one cycle of the electrochemomechanical expansion and contraction, is set to a value of $(0.2\times V_i)$ or less.

Based upon these facts, in order to prevent the first or second diaphragm 103 or 104 from being slackened by sucking the volume change of the electrolyte chamber 109 by the volume change of the gas contained in the electrolyte chamber 109 even when the area of the first or second diaphragm 103 or 104 is increased because of the deformation or the like due to the viscoelasticity of the conductive polymer film, the volume of the gas needs to be set to 10% or more of the amount of discharge and amount of suction $V_0$ of the fluid transporting device obtained by one cycle of the expansion and contraction of the first or second diaphragm 103 or 104. Now, the amount of discharge and amount of suction obtained from the one cycle of the expansion and contraction of the first or second diaphragm 103 or 104 is set to $V_0$. For the reasons described above, in order to improve the operation efficiency of the pump, the volume of the gas to be contained in the electrolyte chamber 109 is preferably set to 10% or more of $V_0$.

Additionally, in the above-mentioned examples, the size of h at the time of the most contracted state of the second diaphragm 404 upon its electrochemomechanical contraction is assumed to be 0; however, in the case of h=0 in an actual pump, problems arise, for example, in that the second diaphragm 104 sticks to the casing unit 102 to disturb the operation of the second diaphragm 104 due to a surface tension of the fluid. However, by shifting a fixed portion 189 between the second diaphragm 104 and the casing unit 102 toward the upper side of FIG. 18, such a problem is not caused and in this structure, the above-mentioned arrangements can be applied.

In the above explanation, it is described that, in order to prevent the first or second diaphragm 103 or 104 from being slackened by sucking the volume change of the electrolyte chamber 109 by the volume change of the gas contained in the electrolyte chamber 109 even when the area of the first or second diaphragm 103 or 104 is increased because of the deformation or the like due to the viscoelasticity of the conductive polymer film, the volume of the gas needs to be set to 10% or more of the amount of discharge and amount of suction $V_0$ of the pump obtained by one cycle of the expansion and contraction of the first or second diaphragm 103 or 104; however, this is prerequisite, and, for example, in a case where $V_0$ is smaller than $0.2\times V_i$, or when the amount of volume reduction of the electrolyte chamber 109 upon increase of the area of the first or second diaphragm 103 or 104 because of the viscoelastic deformation or the like of the conductive polymer film is greater than $0.2\times V_i$, the volume of the gas needs to be a value greater than 10% of $V_0$ in order to prevent the first or second diaphragm 103 or 104 from being slackened. Moreover, also in a case where both of the two sheets of the first and second diaphragms 103, 104 are deformed so that the areas of these are increased, the volume of the gas needs to be a value greater than 10% of $V_0$ in order to prevent the first or second diaphragm 103 or 104 from being slackened.

Additionally, the above-mentioned pressure maintaining function caused by the elasticity of a gas may be used in combination with the aforementioned pressure maintaining function or the like formed by the elastic film portion 130, the spring portion 131 and the like.

When the volume of the gas to be contained in the electrolyte chamber 109 is greater than 20% of the volume of the electrolyte chamber 109, the gas is made in contact with the first and second diaphragms 103, 104 to cause a problem in that incoming and outgoing ions to and from the first and second diaphragms 103, 104 are disturbed. Therefore, the volume of the gas to be mixedly contained in the electrolyte chamber 109 is preferably set to a size of 20% or less of the volume of the electrolyte chamber 109.

Additionally, in the above explanation, the volume of the gas to be contained in the electrolyte chamber 109 refers to the volume of a gas in an operational state of the fluid transporting device.

Fifth Embodiment

Figure 20:
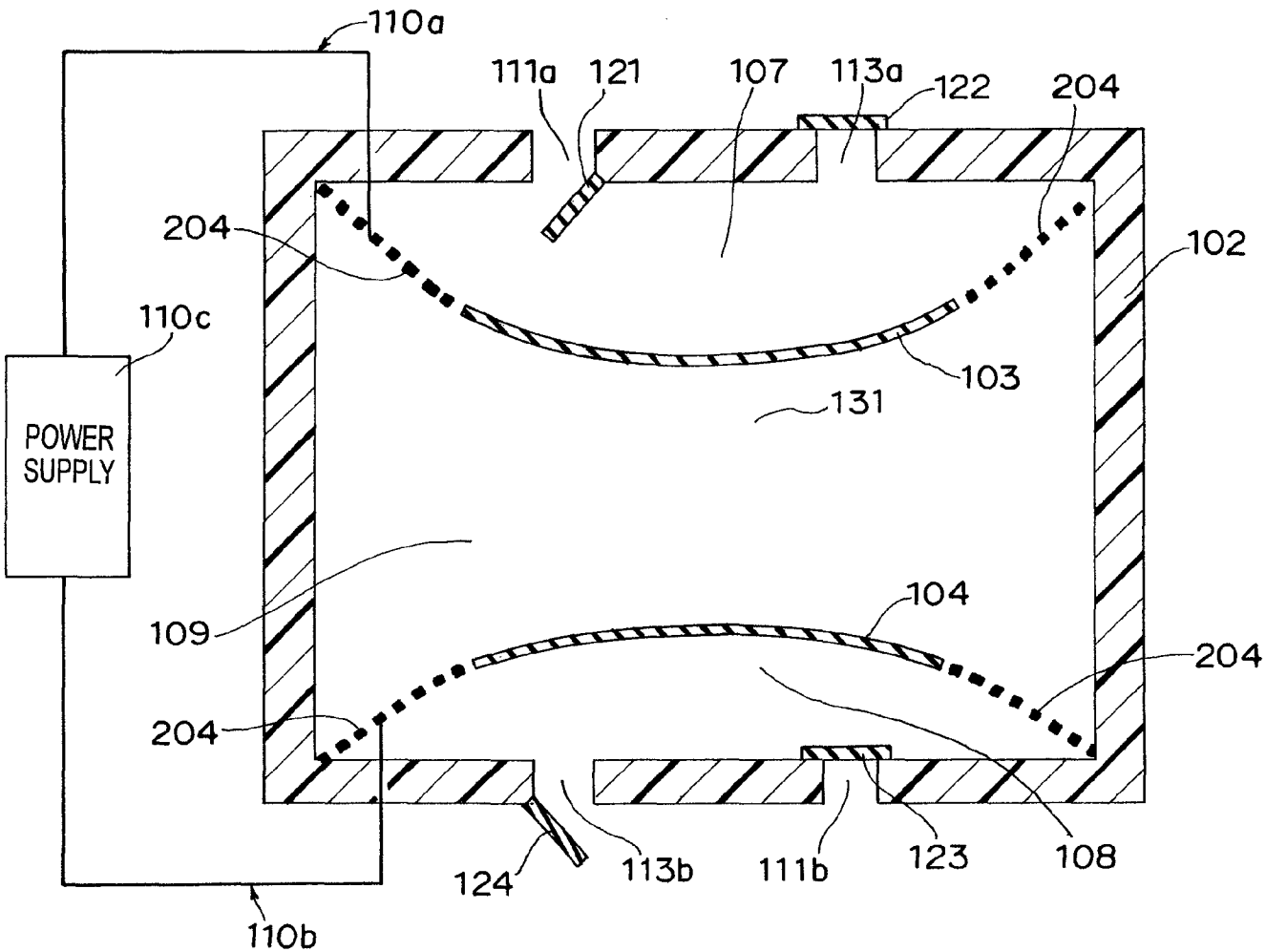
FIG. 20 is a block diagram that shows a fluid transporting device using a conductive polymer in accordance with a fifth embodiment of the present invention.

FIG. 20, which is a cross-sectional view of a fluid transporting device using a conductive polymer in accordance with a fifth embodiment of the present invention, shows an example in which one portion of each of the first and second diaphragms 103, 104 is formed by an elastic film 204. That is, in FIG. 20, the peripheral portion of each of the first and second diaphragms 103, 104 is formed by the diaphragm elastic film 204.

In the fifth embodiment, by forming one portion of each of the first and second diaphragms 103, 104 by using the elastic film 204, one portion of each of the first and second diaphragms 103, 104 is allowed to have a structure capable of being elastically deformed in a face direction of the first and second diaphragms 103, 104 so that a pressure to be applied to the first and second diaphragms 103, 104 can be properly maintained.

In accordance with the fifth embodiment, by the function of the elastic film 204 forming one portion of each of the first and second diaphragms 103, 104, the stress (tension) to be applied to the conductive polymer film forming each of the first and second diaphragms 103, 104 can be made uniform within the in-plane of each of the first and second diaphragms 103, 104. Moreover, in a case where one portion of each of the first and second diaphragms 103, 104 is formed by the elastic film 204, the elastic film 204 can be deformed into a convex shape protruding in the direction of the first or second pump chamber 107 or 108 or the electrolyte chamber 109 so that, by changing this convex shape, the volume of the electrolyte chamber 109 can be maintained substantially constant; thus, since the pressure of the electrolyte is maintained within an appropriate range, it is possible to maintain the pressure to be applied to the first and second diaphragms 103, 104 within an appropriate range (in other words, the pressure of the fluid inside the first and second pump chambers 107, 108 can be maintained within a predetermined range).

In order to make the size of the pump as small as possible, it is preferable to place the two sheets of diaphragms 103 and 104 as closely to each other as possible, within a range so as not to be made in contact with each other. For this reason, the area of the through hole 102*h* is desirably made as small as possible. Consequently, the area of the elastic film 204 is preferably made smaller than the area of each of the diaphragms 103 and 104.

In this case, as described above, upon occurrence of a change in the area of the diaphragms 103 and 104 due to expansion and contraction of the conductive polymer film, in order to maintain the tension of the diaphragms 103 and 104 at an appropriate value by utilizing the deformation of the elastic film 204, the volume change in the electrolyte chamber inner-casing unit portion 190 caused by expansion and contraction of the conductive polymer film needs to be sucked by the volume change in the elastic film inner-side space portion 192.

The above-mentioned considerations indicate that upon occurrence of a change in the area of each of the diaphragms 103 and 104 due to the expansion and contraction of the conductive polymer film, the subsequent change in the area of the elastic film is desirably made greater than the change in the area of each of the diaphragms 103 and 104. Therefore, Young's modulus of each of the diaphragms 103 and 104 is preferably made smaller than Young's modulus of the conductive polymer film. In general, since the value of Young's modulus of the conductive polymer film is about 1 GPa or more, Young's modulus of the elastic film is desirably set to a value less than 1 GPa.

Sixth Embodiment

Figure 21:
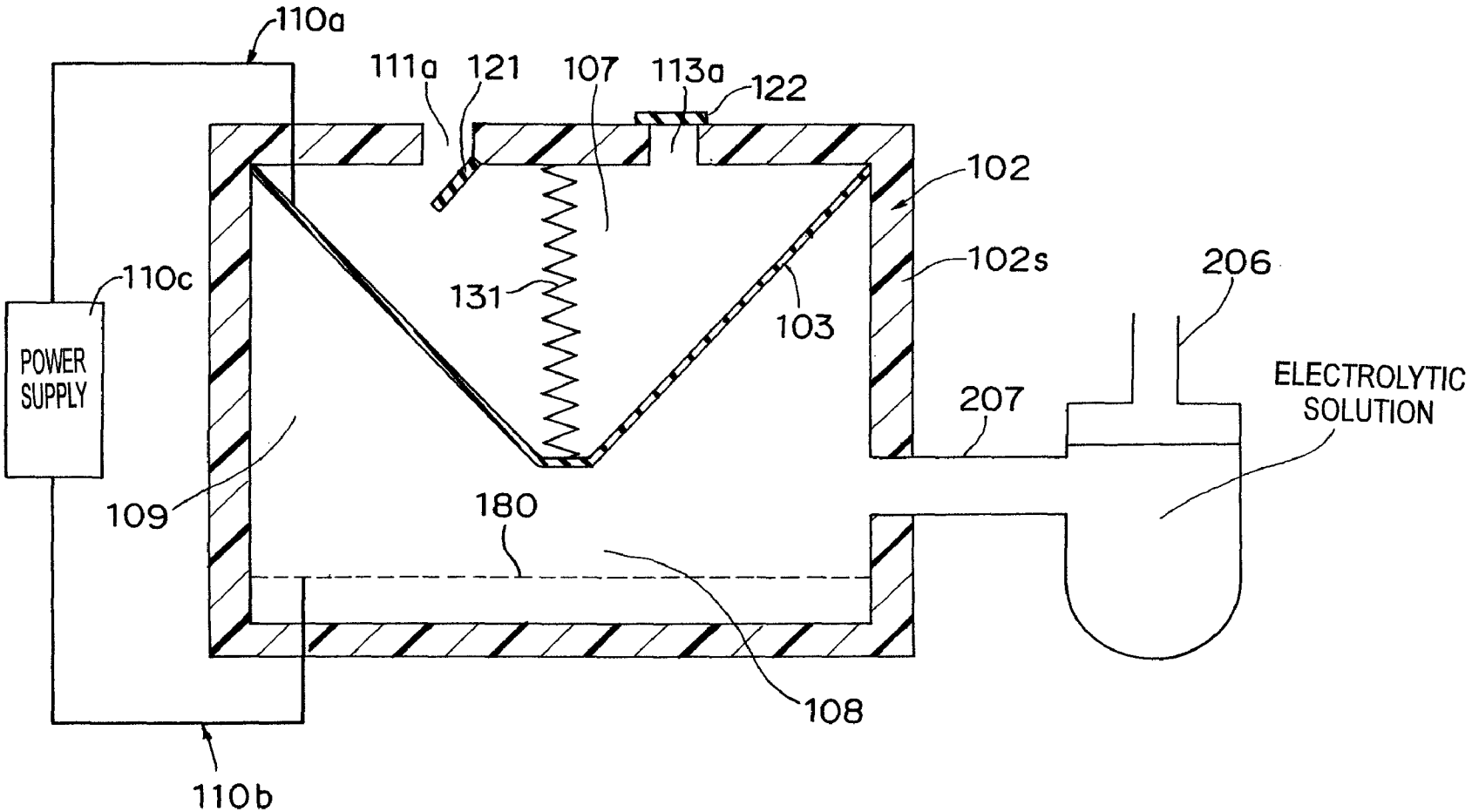
FIG. 21 is a block diagram that shows a fluid transporting device using a conductive polymer in accordance with a sixth embodiment of the present invention.

FIG. 21 is a cross-sectional view of a fluid transporting device using a conductive polymer in accordance with a sixth embodiment of the present invention, and in the structure of FIG. 21, the diaphragm 103 and the spring portion 131 are disposed in the same manner as in the first diaphragm 103 and the spring portion 131 of the fluid transporting device in accordance with the third embodiment of FIG. 15, and an electrolyte reservoir portion 206 is formed on the side of the electrolyte chamber 109. That is, onto a side wall 102*s* of the casing unit 102 forming the electrolyte chamber 109, a conductor portion 207 that penetrates one portion of the side wall 102*s* is attached, and the electrolyte chamber 109 inside the casing unit 102 is connected to the inside of the electrolyte reservoir portion 206 through the conductor portion 207 so as to allow the electrolyte to communicate with each other. The upper portion of the electrolyte reservoir portion 206 is released to the atmospheric pressure so that the volume and pressure of the electrolyte chamber 109 are maintained substantially constant. Consequently, the pressure received by the diaphragm 103 from the electrolyte can be kept substantially constant so that the pressure to be applied to the diaphragm 103 can be maintained substantially constant. The top face of the electrolyte reservoir portion 206 may be formed as a deaerating film or the like that permeates a gas, but does not permeate a liquid so that it is possible to prevent the electrolyte from leaking outside. Additionally, in the structure of FIG. 21, by allowing the liquid face of the electrolyte to move up and down inside the electrolyte reservoir portion 206, the weight of the electrolyte is transmitted, with the result that, although the pressure to be applied to the diaphragm is slightly changed, the size of the change tends to be smaller in most cases, in comparison with the pressure change caused by the volume change of the electrolytic chamber 109 in a case where the electrolyte chamber 109 is air-tightly closed.

Another Embodiment

A plurality of the fluid transporting devices in accordance with any one of the first to sixth embodiments or a plurality of the first to sixth embodiments are prepared, and by arranging these in parallel with one after another, with the flow-in side and flow-out side thereof being mutually connected to each other, it becomes possible to obtain a larger transporting flow rate.

Moreover, a plurality of the fluid transporting devices in accordance with any one of the first to sixth embodiments or a plurality of the first to sixth embodiments, which have the same structures as described earlier with a smaller size, are prepared, and by arranging these in parallel with one after another, with the flow-in side and flow-out side thereof being mutually connected to each other, it becomes possible to obtain a larger transporting flow rate. In this case, since the swelling portion of the convex shape of each of the first and second diaphragms 103, 104 or the diaphragm 103 becomes smaller in each of the fluid transporting devices, it becomes possible to miniaturize the device as a whole.

Figure 27:
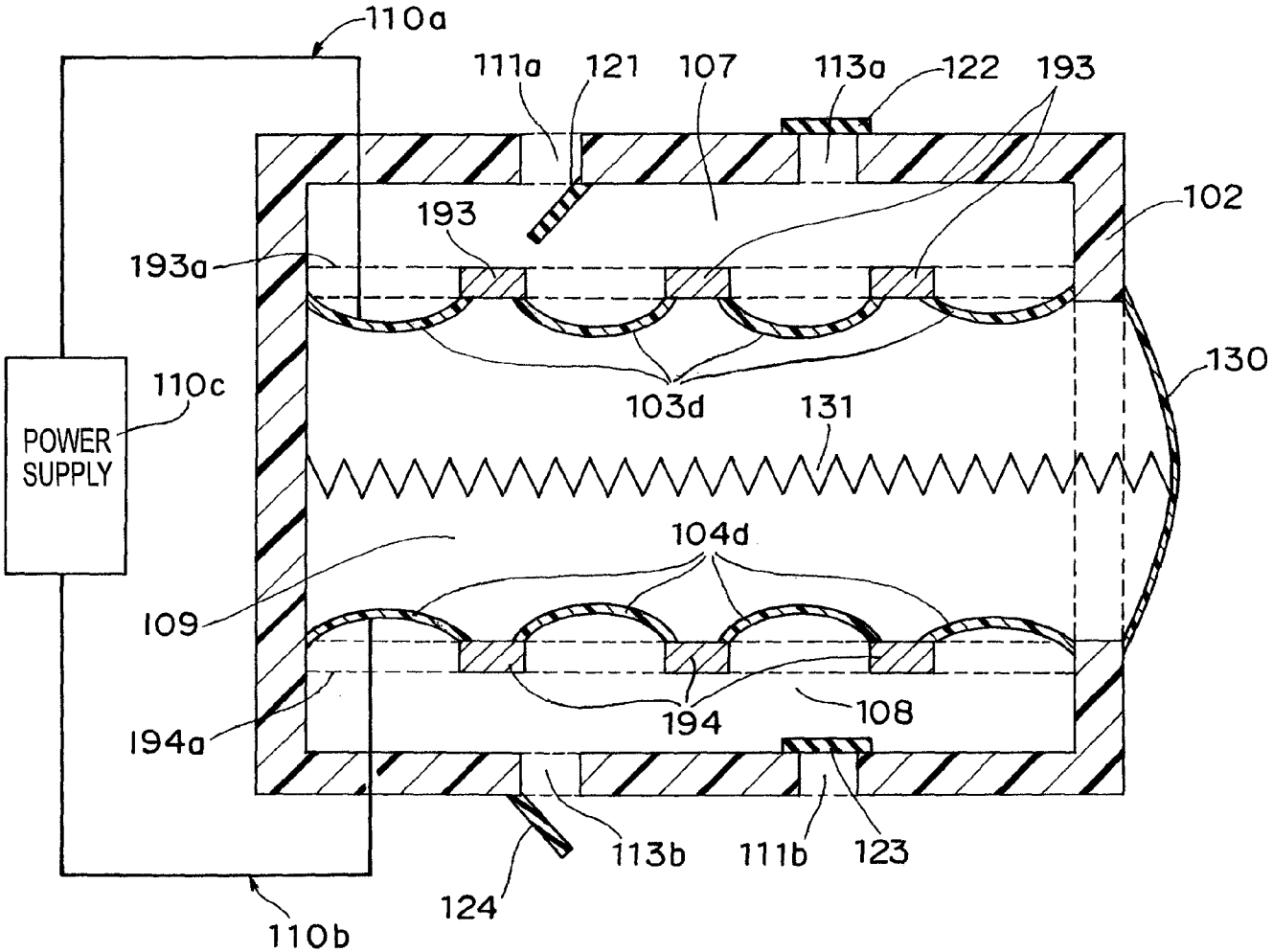
FIG. 27 is a block diagram that shows a fluid transporting device in accordance with another embodiment of the present invention.

Upon arranging a plurality of fluid transporting devices in parallel with one other as described above, instead of arranging each sheet of diaphragms 103 and 104, a plurality of diaphragms 103*d*, 104*d* may be respectively arranged on the same in-plane (see FIG. 27). In FIG. 27, each of a first barrier rib 193 and a second barrier rib 194 is made of metal such as platinum, and formed into a flat plate shape with a plurality of opening portions 193*a*. Moreover, the first barrier rib 193 and the second barrier rib 194 are disposed in the casing unit 102 so as to be positioned in parallel with each other. Furthermore, the first diaphragm 103*d* is placed on each of the opening portions 193*a* of the first barrier rib 193, and the second diaphragm 104*d* is placed on each of the opening portions 194*a* of the second barrier rib 194. Moreover, the first pump chamber 107 and the electrolyte chamber 109 are separated from each other by the first barrier rib 193 and the first diaphragms 103. Furthermore, the second pump chamber 107 and the electrolyte chamber 109 are separated from each other by the second barrier rib 194 and the second diaphragms 104. Since the first diaphragms 103*d* are mutually connected to one after another by the metal first barrier rib 193, they are mutually maintained at the same electric potential. Moreover, since the second diaphragms 104*d* are mutually connected to one after another by the metal second barrier rib 194, they are mutually maintained at the same electric potential. Furthermore, the first diaphragms 103*d* and the second diaphragms 104*d* are designed so as not to electrically conduct to one another. In this structure, by changing the electric potential between the first diaphragms 103*d* and the second diaphragms 104*d*, since the first diaphragms 103*d* and the second diaphragms 104*d* are respectively allowed to expand and contract in the same manner as in the aforementioned embodiments, it becomes possible to carry out pump operations.

Moreover, the structures of the fluid transporting devices may be aligned in a superposing direction of the diaphragms. That is, the structures of the fluid transporting devices may be aligned in a desired positional relationship.

The following description will discuss some other embodiments of the present invention.

In order to keep each of the diaphragms 103 and 104 in a convex shape protruding in the direction from each of the pump chambers 107 and 108 toward the electrolyte chamber 109, with an appropriate tension being possessed by each of the diaphragms 103 and 104 as described earlier, it is necessary to keep the pressure of the electrolyte smaller than the fluid pressure inside the pump chamber. For this reason, in still another embodiment of the present invention, one portion of the wall surface of the electrolyte chamber 109 is formed by an elastic member (for example, elastic film portion 130 in FIG. 3) so that by the elastic force of the elastic member or the elastic force by a spring (for example, spring portion 131 in FIG. 3) connected to the elastic member, the elastic member that forms one portion of the wall surface of the electrolyte chamber 109 is allowed to exert such a force as to deform itself from the inside of the electrolyte chamber 109 outward. The pressure of the electrolyte is kept smaller than the fluid pressure inside the pump chamber by this force.

Figure 28:
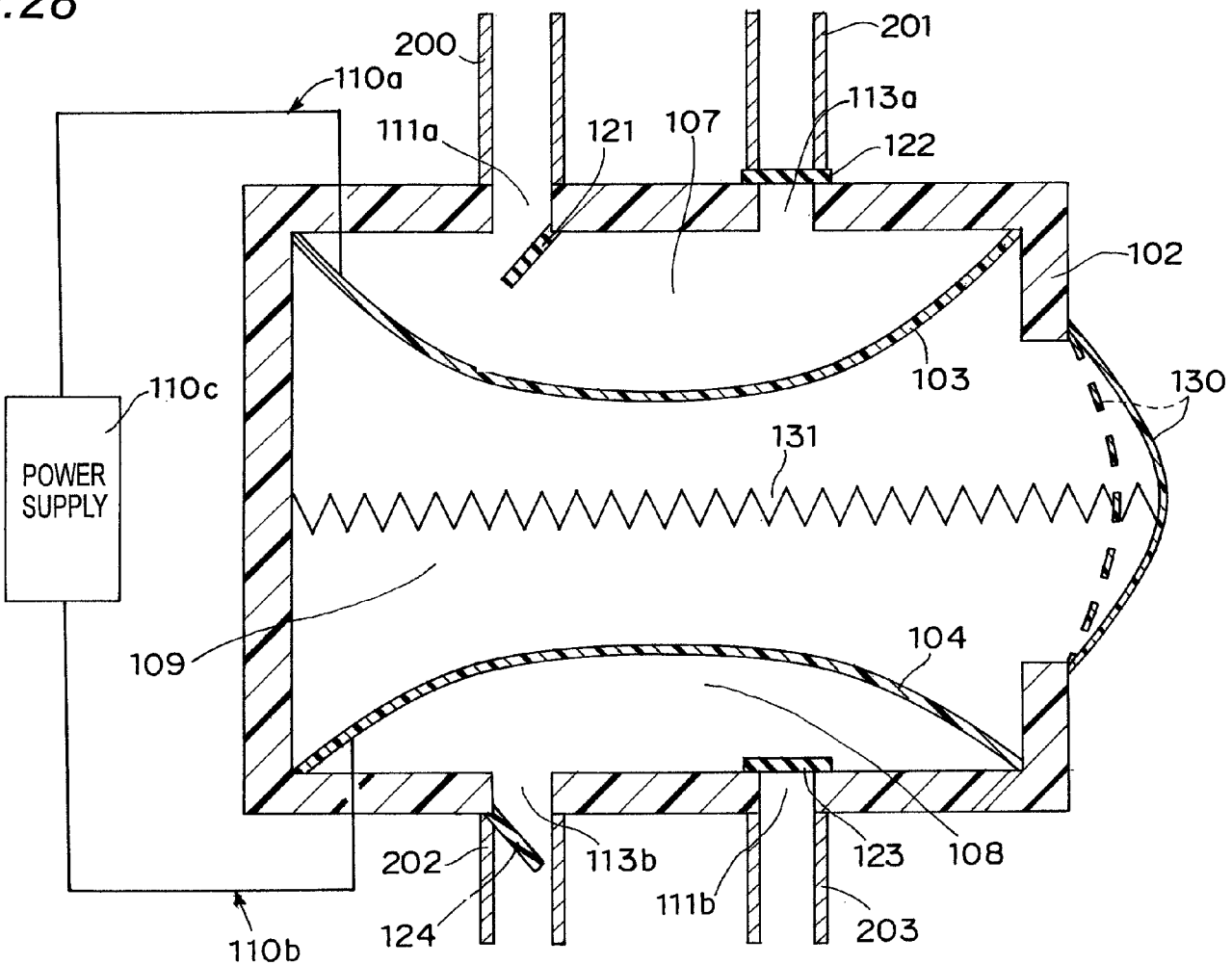
FIG. 28, which shows a fluid transporting device in accordance with still another embodiment of the present invention, is a block diagram that shows states of an elastic film portion and a spring portion in a case where, in the pump of FIG. 3 in the fluid transporting device of the first embodiment, the pressure of an electrolyte is set to the same value as that of the pressure of a fluid in a pump chamber.

FIG. 28 shows the states of the elastic film portion 130 and the spring portion 131 in a case where, in the pump of FIG. 3 in the fluid transporting device in accordance with the first embodiment, the pressure of the electrolyte is set to the same value as the pressure of the fluid in each of the pump chambers 107 and 108. In this case, the positions of the elastic film portion 130 and the spring portion 131 in FIG. 3 are indicated by dotted lines. In a case where the pressure of the electrolyte in the initial state is made smaller than the pressure of the fluid in each of the pump chambers 107 and 108, the elastic film portion 130 is located at a position indicated by FIG. 3; however, by the elastic force of the elastic film portion 130 and the spring portion 131, a force (restoring force) to allow the elastic film portion 130 to return to the state in FIG. 28 is generated therein. Since this force is always exerted during pump operations, the pressure of the electrolyte is kept at a value smaller than the pressure of the fluid in each of the pump chambers 107 and 108 so that by the difference between the pressure of the electrolyte and the pressure of the fluid in each of the pump chambers 107 and 108, it becomes possible to keep each of the diaphragms 103 and 104 in a convex shape protruding in the direction from each of the pump chambers 107 and 108 toward the electrolyte chamber 109, with an appropriate tension being possessed by each of the diaphragms 103 and 104. In a case where the diaphragms 103 and 104 are expanded or contracted so that the volume of the electrolyte chamber 109 is increased or reduced, the pressure of the electrolyte is subsequently reduced or increased, and in response to this, the elastic film portion 130 is deformed inward or outward, when viewed from the electrolyte chamber 109. With this arrangement, the volume and pressure of the electrolyte chamber 109 are always kept at substantially the same values as those in the initial state. As a result, the pressure of the electrolyte is always kept at a value smaller than the pressure of the fluid in each of the pump chambers 107 and 108 during pump operations so that by the difference between the pressure of the electrolyte and the pressure of the fluid in each of the pump chambers 107 and 108, it becomes possible to keep each of the diaphragms 103 and 104 in a convex shape protruding in the direction from each of the pump chambers 107 and 108 toward the electrolyte chamber 109, with an appropriate tension being possessed by each of the diaphragms 103 and 104.

Figure 29:
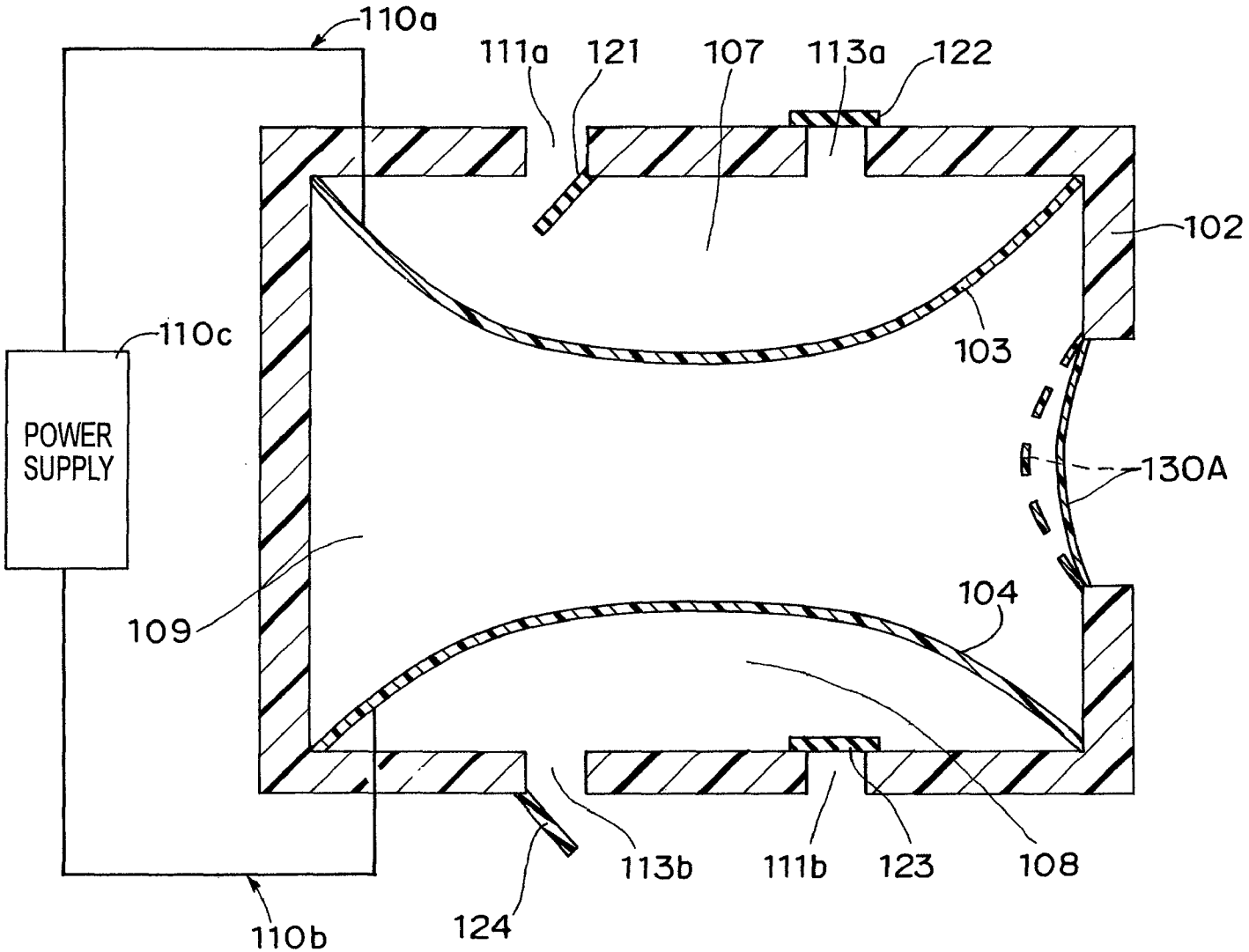
FIG. 29, which shows a fluid transporting device in accordance with still another embodiment of the present invention, is a block diagram that shows a state of an elastic film portion in a case where, in the pump of FIG. 10 in the fluid transporting device of the first modified example of the first embodiment of the present invention, the pressure of an electrolyte is set to the same value as that of the pressure of a fluid in a pump chamber.

As still another embodiment of the present invention, FIG. 29 shows a state of an elastic film portion 130A in which, in the pump of FIG. 10 in accordance with the first modified embodiment of the first embodiment of the present invention, the pressure of the electrolyte is set to the same value as that of the pressure of the fluid in each of the pump chambers 107 and 108. In this case, the position of the elastic film portion 130A in FIG. 10 is indicated by a dotted line. In the case of FIG. 10 also, in the same manner as in FIG. 3, by the elastic force of the elastic film portion 130A, a force (restoring force) to allow the elastic film portion 130A to return to the state in FIG. 29 is generated therein. Since this force is always exerted during pump operations, the pressure of the electrolyte is kept at a value smaller than the pressure of the fluid in each of the pump chambers 107 and 108 so that by the difference between the pressure of the electrolyte and the pressure of the fluid in each of the pump chambers 107 and 108, it becomes possible to keep each of the diaphragms 103 and 104 in a convex shape protruding in the direction from each of the pump chambers 107 and 108 toward the electrolyte chamber 109, with an appropriate tension being possessed by each of the diaphragms 103 and 104. In a case where the diaphragms 103 and 104 are expanded or contracted so that the volume of the electrolyte chamber 109 is increased or reduced, the pressure of the electrolyte is subsequently reduced or increased, and in response to this, the elastic film portion 130A is deformed inward or outward, when viewed from the electrolyte chamber 109. With this arrangement, the volume and pressure of the electrolyte chamber 109 are always kept at substantially the same values as those in the initial state. As a result, the pressure of the electrolyte is always kept at a value smaller than the pressure of the fluid in each of the pump chambers 107 and 108 during pump operations so that by the difference between the pressure of the electrolyte and the pressure of the fluid in each of the pump chambers 107 and 108, it becomes possible to keep each of the diaphragms 103 and 104 in a convex shape protruding in the direction from each of the pump chambers 107 and 108 toward the electrolyte chamber 109, with an appropriate tension being possessed by each of the diaphragms 103 and 104.

As can be clarified by the above explanation, in order to keep each of the diaphragms 103 and 104 in a convex shape protruding in the direction from each of the pump chambers 107 and 108 toward the electrolyte chamber 109, with an appropriate tension being possessed by each of the diaphragms 103 and 104, the position of the elastic film portion at the time when the pressure of the electrolyte in the initial state is set to be smaller than the pressure of the fluid in each of the pump chambers 107 and 108 is preferably set to be deviated in a direction from the outside of the electrolyte chamber 109 toward the inside thereof, in comparison with the position of the elastic film portion at the time when the pressure of the electrolyte is set to the same value as that of the pressure of the fluid in each of the pump chambers 107 and 108. As long as this condition is satisfied, the elastic film portion may have either a protruded convex shape in the direction from the outside of the electrolyte chamber 109 toward the inside thereof, or a protruded convex shape in the direction from the inside of the electrolyte chamber 109 toward the outside thereof. Moreover, the spring portion may be connected to the elastic film portion, or need not be connected thereto.

Moreover, in contrast to the above explanation, in order to keep each of the diaphragms 103 and 104 in a convex shape protruding in the direction from each of the pump chambers 107 and 108 toward the electrolyte chamber 109, with an appropriate tension being possessed by each of the diaphragms 103 and 104, it is necessary to keep the pressure of the electrolyte greater than the fluid pressure inside the pump chamber. For this reason, in still another embodiment of the present invention, one portion of a wall surface of the electrolyte chamber 109 is formed as an elastic member (for example, an elastic film portion 130) so that, by using the elastic force of the elastic member or the elastic force by a spring (for example, a spring portion 131) connected to the elastic member, a force to allow the elastic member forming one portion of the wall surface of the electrolyte chamber 109 to be deformed from the outside of the electrolyte chamber 109 toward the inside thereof is generated.

Figure 30:
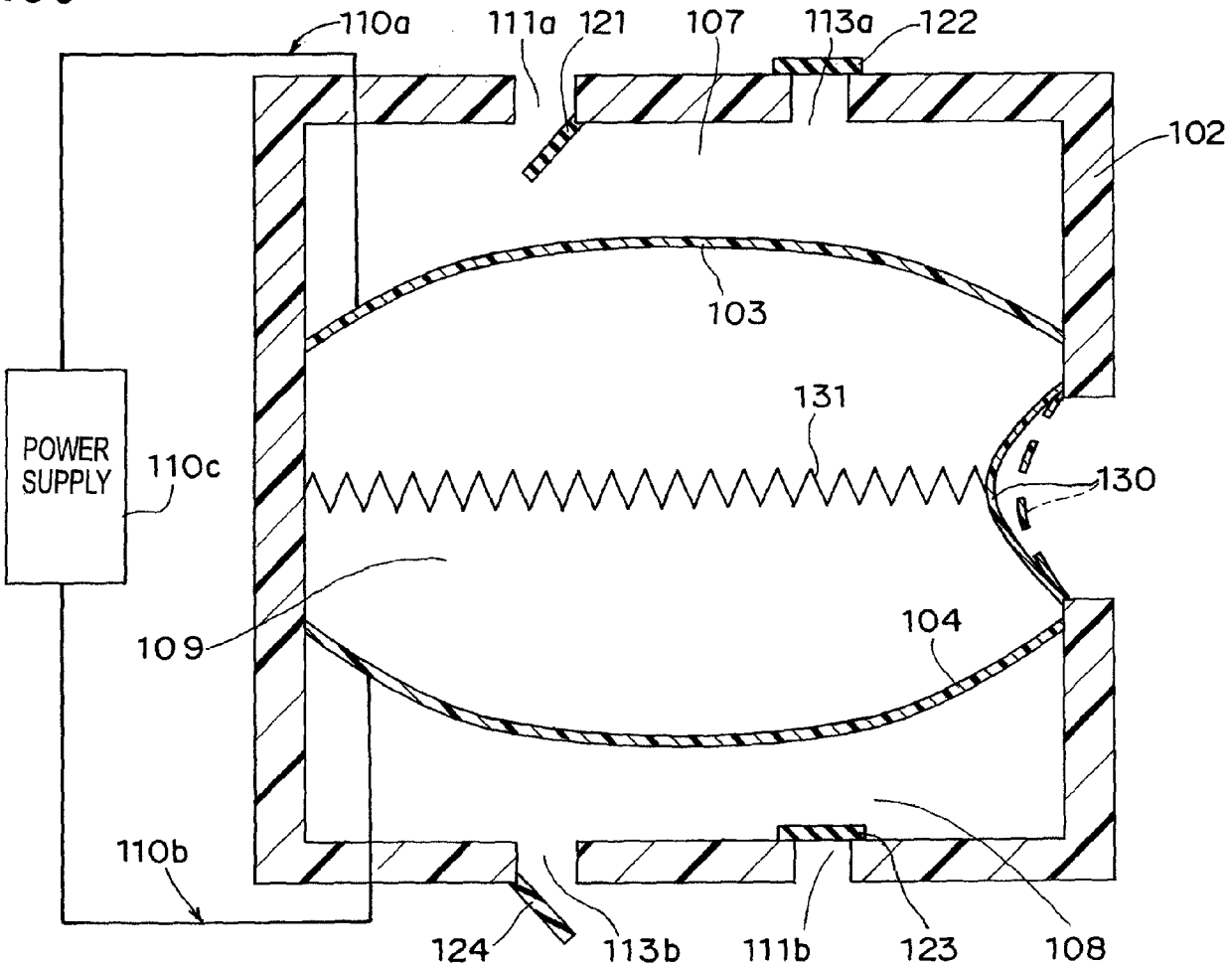
FIG. 30, which shows a fluid transporting device in accordance with still another embodiment of the present invention, is a block diagram that shows a state of an elastic film portion in a case where, in the pump of FIG. 13 in the fluid transporting device of the second embodiment of the present invention, the pressure of an electrolyte is set to the same value as that of the pressure of a fluid in a pump chamber.

FIG. 30 shows the state of the elastic film portion 130 in a case where, in the pump of FIG. 13, the pressure of the electrolyte is set to the same value as the pressure of the fluid in each of the pump chambers 107 and 108. In this case, the position of the elastic film portion 130 in FIG. 13 is indicated by a dotted line. In the structure of FIG. 13, by the elastic force of the elastic film portion 130, a force (restoring force) to allow the elastic film portion 130 to return to the state in FIG. 30 is generated therein. Since this force is always exerted during pump operations, the pressure of the electrolyte is kept at a value greater than the pressure of the fluid in each of the pump chambers 107 and 108 so that by the difference between the pressure of the electrolyte and the pressure of the fluid in each of the pump chambers 107 and 108, it becomes possible to keep each of the diaphragms 103 and 104 in a convex shape protruding in the direction from the electrolyte chamber toward each of the pump chambers 107 and 108, with an appropriate tension being possessed by each of the diaphragms 103 and 104. In a case where the diaphragms 103 and 104 are expanded or contracted so that the volume of the electrolyte chamber 109 is increased or reduced, the pressure of the electrolyte is subsequently reduced or increased, and in response to this, the elastic film portion 130 is deformed inward or outward, when viewed from the electrolyte chamber 109. With this arrangement, the volume and pressure of the electrolyte chamber 109 are always kept at substantially the same values as those in the initial state. As a result, the pressure of the electrolyte is always kept at a value greater than the pressure of the fluid in each of the pump chambers 107 and 108 during pump operations so that by the difference between the pressure of the electrolyte and the pressure of the fluid in each of the pump chambers 107 and 108, it becomes possible to keep each of the diaphragms 103 and 104 in a convex shape protruding in the direction from the electrolyte chamber 109 toward each of the pump chambers 107 and 108, with an appropriate tension being possessed by each of the diaphragms 103 and 104.

As can be clarified by the above explanation, in order to keep each of the diaphragms 103 and 104 in a convex shape protruding in the direction from the electrolyte chamber 109 toward each of the pump chambers 107 and 108, with an appropriate tension being possessed by each of the diaphragms 103 and 104, the position of the elastic film portion 130 at the time when the pressure of the electrolyte in the initial state is set to be greater than the pressure of the fluid in each of the pump chambers 107 and 108 is preferably set to be deviated in a direction from the inside of the electrolyte chamber 109 toward the outside thereof, in comparison with the position of the elastic film portion 130 at the time when the pressure of the electrolyte is set to the same value as that of the pressure of the fluid in each of the pump chambers 107 and 108. As long as this condition is satisfied, the elastic film portion 130 may have either a protruded convex shape in the direction from the outside of the electrolyte chamber 109 toward the inside thereof, or a protruded convex shape in the direction from the inside of the electrolyte chamber 109 toward the outside thereof. Moreover, the spring portion 131 may be connected to the elastic film portion 130, or need not be connected thereto.

Moreover, by allowing the electrolytic to contain a gas, the same functions as described above may be obtained by the elastic force of the gas.

Figure 31:
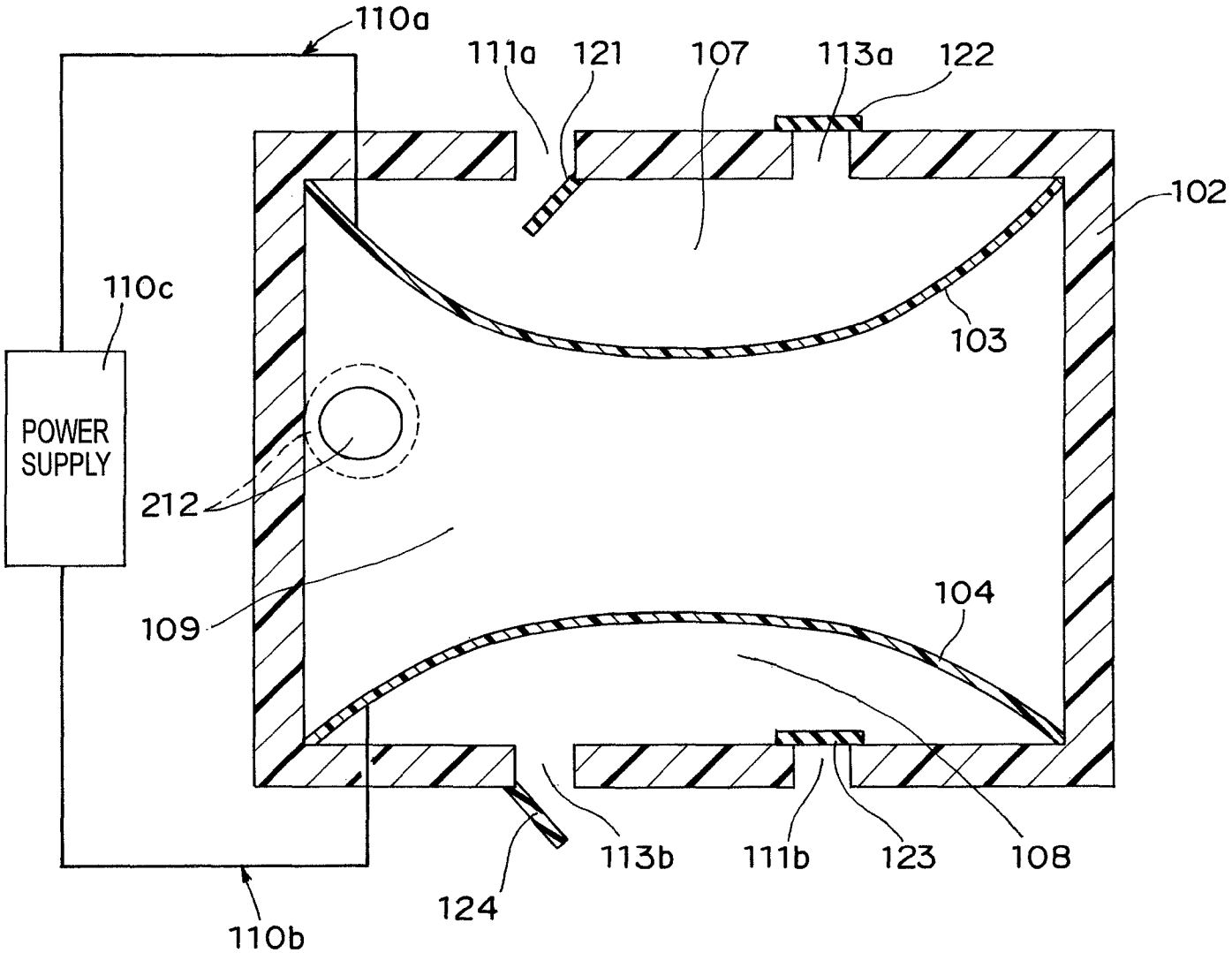
FIG. 31, which shows a fluid transporting device in accordance with still another embodiment of the present invention, is a block diagram that shows a size of a bubble portion in a case where, in the pump of FIG. 18 in the fluid transporting device of the fourth embodiment of the present invention, the pressure of an electrolyte is set to the same value as that of the pressure of a fluid in a pump chamber.

FIG. 31 shows the size of a bubble portion 212 in a case where, in the pump of FIG. 18, the pressure of the electrolyte is set to the same value as that of the pressure of the fluid in each of the pump chambers 107 and 108. In this case, the size of the bubble portion 212 in FIG. 18 is indicated by a dotted line. In a case where the pressure of the electrolyte in the initial state is made smaller than the pressure of the fluid in each of the pump chambers 107 and 108, the bubble portion 212 has a size as shown in FIG. 18; however, by the elastic force of the gas of the bubble portion 212, a force (restoring force) that tries to allow the size of the bubble portion 212 to return to the state shown in FIG. 31 is generated. Since this force is always exerted during pump operations, the pressure of the electrolyte is kept at a value smaller than the pressure of the fluid in each of the pump chambers 107 and 108 so that by the difference between the pressure of the electrolyte and the pressure of the fluid in each of the pump chambers 107 and 108, it becomes possible to keep each of the diaphragms 103 and 104 in a convex shape protruding in the direction from each of the pump chambers 107 and 108 toward the electrolyte chamber 109, with an appropriate tension being possessed by each of the diaphragms 103 and 104. In a case where the diaphragms 103 and 104 are expanded or contracted so that the volume of the electrolyte chamber 109 is increased or reduced, the pressure of the electrolyte is subsequently reduced or increased, and in response to this, the size of the bubble portion 212 is subsequently reduced or increased. With this arrangement, the volume and pressure of the electrolyte are always kept at substantially the same values as those in the initial state. As a result, the pressure of the electrolyte is always kept at a value smaller than the pressure of the fluid in each of the pump chambers 107 and 108 during pump operations so that by the difference between the pressure of the electrolyte and the pressure of the fluid in each of the pump chambers 107 and 108, it becomes possible to keep each of the diaphragms 103 and 104 in a convex shape protruding in the direction from each of the pump chambers 107 and 108 toward the electrolyte chamber 109, with an appropriate tension being possessed by each of the diaphragms 103 and 104.

In FIGS. 28 to 31, for convenience of explanation, the positional change of the elastic film 130 or the size change of the bubble portion 212 due to a pressure change of the electrolyte are indicated in an enlarged manner. Actually, since the electrolyte is a non-compressive fluid, the positional change of the elastic film 130 or the size change of the bubble portion 212 due to the pressure change of the electrolyte is very small.

Additionally, examples of the elastic portion include: an elastic member, a spring portion or a bubble portion. Among these, the elastic member is a member by which the surface of the elastic member is allowed to move or deform by its own elastic force, and for example, an elastic film or a bulk-state elastic member may be used.

Figure 32:
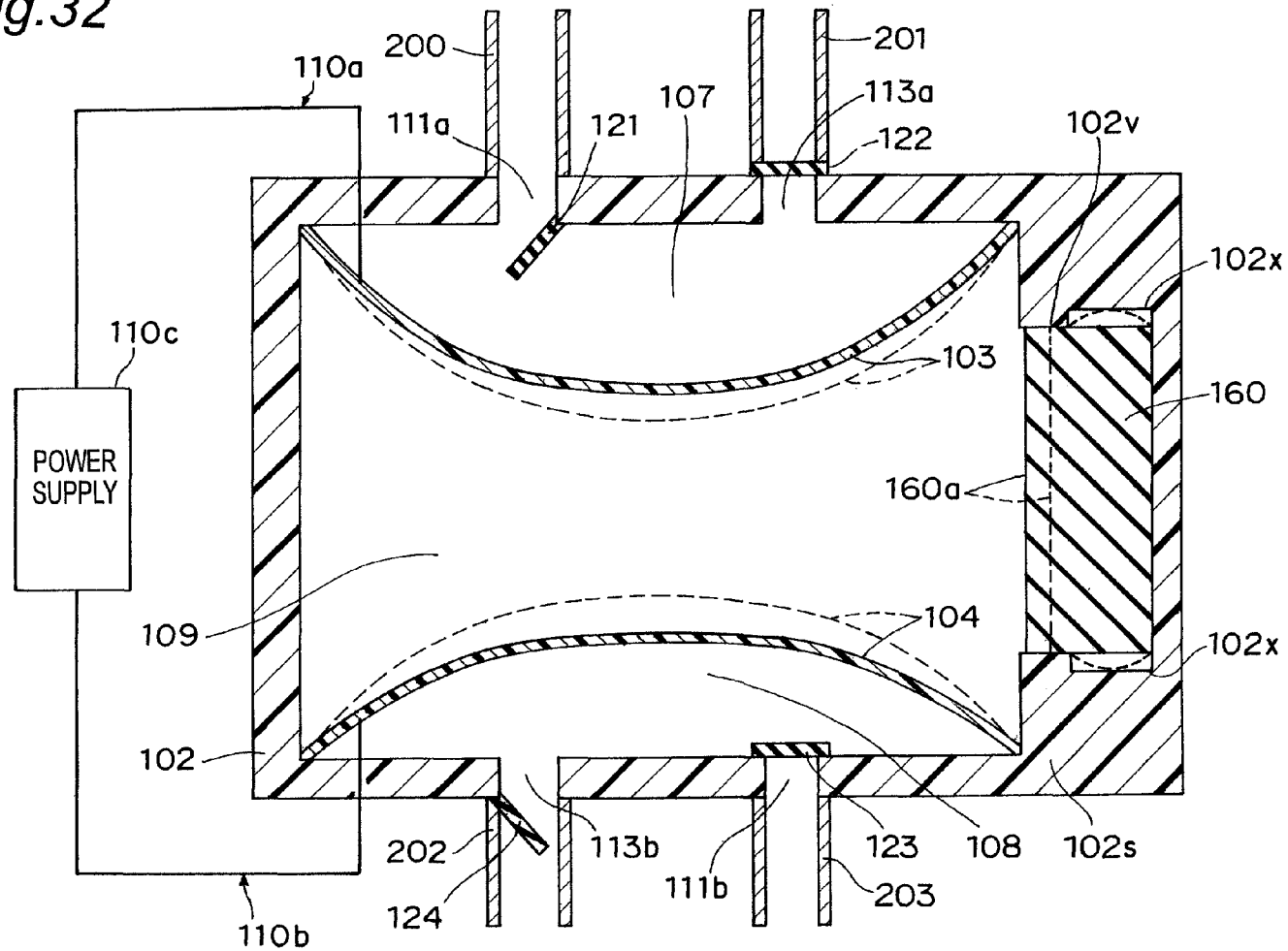
FIG. 32, which shows a fluid transporting device in accordance with still another embodiment of the present invention, is a block diagram that shows an example in which a bulk-state elastic member is used.

FIG. 32, which shows a fluid transporting device in accordance with still another embodiment of the present invention, is a block diagram that shows an example in which a bulk-state elastic member is used. In FIG. 32, a concave portion **102*v* is formed on one of side walls 102*s* of the casing unit 102, and a bulk-state elastic member 160 is fitted into the concave portion 102*v*. The bulk-state elastic member 160 is a member whose surface 160*a* is shifted or deformed by its own elastic force, and the surface 160*a* of the bulk-state elastic member 160 is shifted to advance or retreat by its own elastic force of the bulk-state elastic member 160 inside the concave portion 102*v* so that by deforming an interface between the electrolyte and a portion other than the electrolyte, the pressure to be exerted on the diaphragms 103 and 104 can be maintained within a predetermined range. That is, by allowing the elastic force of the bulk-state elastic member 160 to exert as the elastic force of the elastic portion, a force to try to deform the electrolyte chamber 109 from the inside toward the outside is generated, and by the force thus generated, the pressure of the electrolyte is maintained at a value smaller than the pressure of the fluid in each of the pump chambers 107 and 108 so that by the tension of the diaphragms 103 and 104 exerted by the difference between the pressure of the electrolyte and the pressure of the fluid in each of pump chambers 107 and 108, each of the diaphragms 103 and 104 is kept in a convex shape protruding in the direction from each of the pump chambers 107 and 108 toward the electrolyte chamber 109. Alternatively, by allowing the elastic force of the bulk-state elastic member 160 to exert as the elastic force of the elastic portion, a force to try to deform the electrolyte chamber 109 from the outside toward the inside is generated, and by the force thus generated, the pressure of the electrolyte is maintained at a value greater than the pressure of the fluid in each of the pump chambers 107 and 108 so that by the tension of the diaphragms 103 and 104 exerted by the difference between the pressure of the electrolyte and the pressure of the fluid in each of pump chambers 107 and 108, each of the diaphragms 103 and 104 is kept in a convex shape protruding in the direction from the electrolyte chamber 109 toward each of the pump chambers 107 and 108. As a result, the example of FIG. 32 also makes it possible to provide the same functions and effects as those of the other embodiments. Moreover, in FIG. 32, reference numeral 102***x* represents a concave portion formed on the bottom of the concave portion 102*v*, and in a case where the surface of the bulk-state elastic member 160 is shifted or deformed so that the bulk-state elastic member 160 itself is elastically deformed as indicated by a dotted line of FIG. 32 to enter the inside of the concave portion 102*v*, the concave portion 102*x* ensures a space that one portion of the bulk-state elastic member 160 enters.

Figure 33:
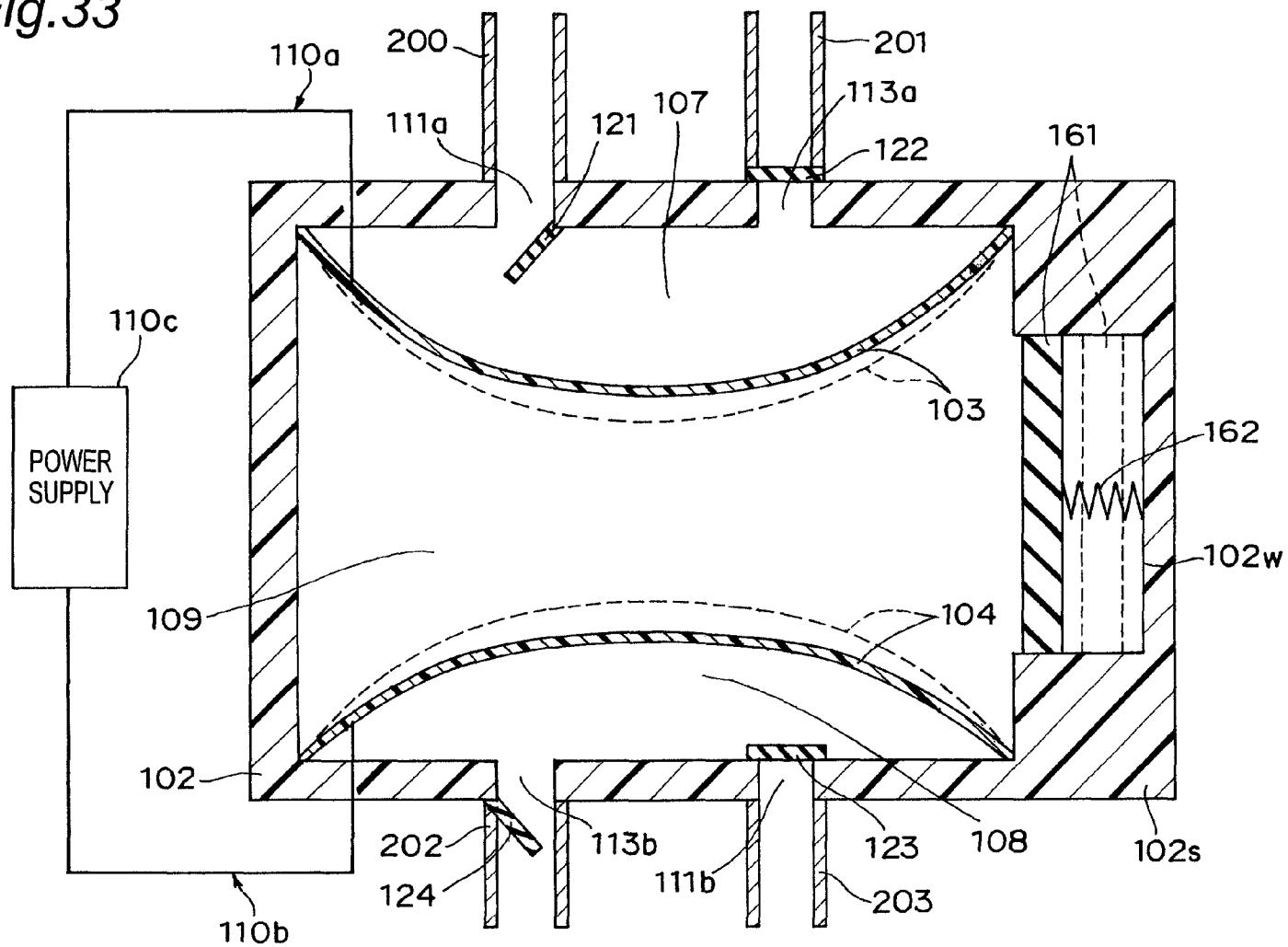
FIG. 33, which shows a fluid transporting device in accordance with the other embodiment of the present invention, is a block diagram that shows an example in which only the spring portion is used as the elastic portion.

Moreover, FIG. 33, which shows a fluid transporting device in accordance with still another embodiment of the present invention, is a block diagram that shows one example in which only the spring portion is used as the elastic portion. In FIG. 33, a concave portion 102*w* is formed on one of side walls 102*s* of the casing unit 102, and inside the concave portion 102*w*, a movable wall member 161 that can be shifted and a spring portion 162 that applies an elastic force to the movable wall member 161 are disposed. The movable wall member 161 is allowed to advance and retreat by the elastic force of the spring portion 162 within the concave portion 102*w* so that by deforming an interface between the electrolyte and a portion other than the electrolyte, the pressure to be exerted on the diaphragms 103 and 104 can be maintained within a predetermined range. That is, by allowing the elastic force of the spring portion 162 to exert as the elastic force of the elastic portion, a force to try to deform the electrolyte chamber 109 from the inside toward the outside is generated, and by the force thus generated, the pressure of the electrolyte is maintained at a value smaller than the pressure of the fluid in each of the pump chambers 107 and 108 so that by the tension of the diaphragms 103 and 104 exerted by the difference between the pressure of the electrolyte and the pressure of the fluid in each of the pump chambers 107 and 108, each of the diaphragms 103 and 104 is kept in a convex shape protruding in the direction from each of the pump chambers 107 and 108 toward the electrolyte chamber 109. Alternatively, by allowing the elastic force of the spring portion 162 to exert as the elastic force of the elastic portion, a force to try to deform the electrolyte chamber 109 from the outside toward the inside is generated, and by the force thus generated, the pressure of the electrolyte is maintained at a value greater than the pressure of the fluid in each of the pump chambers 107 and 108 so that by the tension of the diaphragms 103 and 104 exerted by the difference between the pressure of the electrolyte and the pressure of the fluid in each of the pump chambers 107 and 108, each of the diaphragms 103 and 104 is kept in a convex shape protruding in the direction from the electrolyte chamber 109 toward each of the pump chambers 107 and 108. As a result, the example of FIG. 33 also makes it possible to provide the same functions and effects as those of the other embodiments.

Additionally, among the above-mentioned various embodiments and modified examples, desired embodiments or modified examples may be combined with one another on demand so that the respective effects can be obtained.

The fluid transporting device of the present invention may be used for a supply device for a fuel such as, in particular, methanol or the like in a fuel battery, or a water-cooling circulator or the like for cooling electronic apparatuses including CPU's, and is desirably utilized as a fluid transporting device capable of sucking and discharging a fluid with high efficiency.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The invention claimed is:

1. A fluid transporting device using a conductive polymer, and capable of sucking and discharging a fluid, said fluid transporting device comprising:

a pump chamber configured to be filled with the fluid;

a casing unit having said pump chamber formed therein, and forming one portion of a wall surface of said pump chamber;

a diaphragm, supported inside said casing unit, at least one portion of said diaphragm being formed by a conductive polymer film that is subjected to electrochemomechanical expansion and contraction, and said portion of said diaphragm forming said wall surface of said pump chamber together with said casing unit;

a first opening configured and arranged to guide the fluid to said pump chamber and a second opening configured and arranged to discharge pressurized fluid from said pump chamber;

an electrolyte chamber surrounded by said casing unit and said diaphragm, and containing an electrolyte therein, a portion of said diaphragm being configured and arranged to contact the electrolyte;

a power supply configured to apply a voltage to said conductive polymer film;

a wiring portion electrically connecting said conductive polymer film to said power supply; and a pressure maintaining unit having an elastic member located inside said electrolyte chamber and on one portion of the wall surface of said electrolyte chamber, and configured to maintain a pressure applied to the diaphragm within a predetermined range by generating a pressure change in the electrolyte by using said elastic member.

2. A fluid transporting device using a conductive polymer, and capable of sucking and discharging a fluid, said fluid transporting device comprising:

a pump chamber configured to be filled with the fluid;

a casing unit having said pump chamber formed therein, and forming one portion of a wall surface of said pump chamber;

a diaphragm, supported inside said casing unit, at least one portion of said diaphragm being formed by a conductive polymer film that is subjected to electrochemomechanical expansion and contraction, and said portion of said diaphragm forming said wall surface of said pump chamber together with said casing unit;

a first opening configured and arranged to guide the fluid to said pump chamber and a second opening configured and arranged to discharge pressurized fluid from said pump chamber;

an electrolyte chamber surrounded by said casing unit and said diaphragm, and containing an electrolyte therein, a portion of said diaphragm being configured and arranged to contact the electrolyte;

a power supply configured to apply a voltage to said conductive polymer film;

a wiring portion electrically connecting said conductive polymer film to said power supply; and a pressure maintaining unit having an elastic member located inside said electrolyte chamber and on one portion of the wall surface of said electrolyte chamber, and configured to maintain a pressure applied to the diaphragm within a predetermined range by generating a pressure change in the electrolyte by using said elastic member, wherein by using an elastic force of said elastic member of said pressure maintaining unit, an interface between the electrolyte and said portion of said diaphragm configured and arranged to contact the electrolyte is deformed so that the pressure to be exerted on said diaphragm is maintained within the predetermined range, said elastic member of said pressure maintaining unit is capable of expanding and contracting, and a spring portion connecting said elastic member to said casing unit, and said elastic member being capable of generating an elastic force so that by the generated elastic force, a pressure of the electrolyte is maintained at a value smaller than a pressure of the fluid in said pump chamber, with said diaphragm being maintained in a convex shape protruding in a direction from said pump chamber toward said electrolyte chamber by a tension of said diaphragm generated by a difference between the pressure of the electrolyte and the pressure of the fluid in said pump chamber.

3. The fluid transporting device using a conductive polymer according to claim 1, wherein by using an elastic force of said elastic member of said pressure maintaining unit, an interface between the electrolyte and said portion of said diaphragm configured and arranged to contact the electrolyte is deformed so that the pressure to be exerted on said diaphragm is maintained within the predetermined range, said elastic member of the pressure maintaining unit is capable of expanding and contracting, and said elastic member being capable of generating an elastic force so that by the generated elastic force, a pressure of the electrolyte is maintained at a value smaller than a pressure of the fluid in said pump chamber, with said diaphragm being maintained in a convex shape protruding in a direction from said pump chamber toward said electrolyte chamber by a tension of said diaphragm generated by a difference between the pressure of the electrolyte and the pressure of the fluid in the pump chamber.

4. The fluid transporting device using a conductive polymer according to claim 1, wherein by using an elastic force of the elastic member of said pressure maintaining unit, an interface between the electrolyte and said portion of said diaphragm configured and arranged to contact the electrolyte is deformed so that the pressure to be exerted on said diaphragm is maintained within the predetermined range, said elastic member of said pressure maintaining unit is capable of expanding and contracting, and a spring portion connecting said elastic member to said casing unit, and said elastic member being capable of generating an elastic force so that by the generated elastic force, a pressure of the electrolyte is maintained at a value greater than a pressure of the fluid in said pump chamber, with said diaphragm being maintained in a convex shape protruding in a direction from said electrolyte chamber toward said pump chamber by a tension of said diaphragm generated by a difference between the pressure of the electrolyte and the pressure of the fluid in said pump chamber.

5. The fluid transporting device using a conductive polymer according to claim 1, wherein by using an elastic force of said elastic member of said pressure maintaining unit, an interface between the electrolyte and said portion of said diaphragm configured and arranged to contact the electrolyte is deformed so that the pressure to be exerted on said diaphragm is maintained within the predetermined range, said elastic member of said pressure maintaining unit is capable of expanding and contracting, and said elastic member being capable of generating an elastic force so that by the generated elastic force, a pressure of the electrolyte is maintained at a value greater than a pressure of the fluid in said pump chamber, with said diaphragm being maintained in a convex shape protruding in a direction from said electrolyte chamber toward said pump chamber by a tension of said diaphragm generated by a difference between the pressure of the electrolyte and the pressure of the fluid in said pump chamber.

6. A fluid transporting device using a conductive polymer, and capable of sucking and discharging a fluid, said fluid transporting device comprising:

a pump chamber configured to be filled with the fluid;

a casing unit having said pump chamber formed therein, and forming one portion of a wall surface of said pump chamber;

a diaphragm, supported inside said casing unit, at least one portion of said diaphragm being formed by a conductive polymer film that is subjected to electrochemomechanical expansion and contraction, and said portion of said diaphragm forming said wall surface of said pump chamber together with said casing unit;

a first opening configured and arranged to guide the fluid to said pump chamber and a second opening configured and arranged to discharge pressurized fluid from said pump chamber;

an electrolyte chamber surrounded by said casing unit and said diaphragm, and containing an electrolyte therein, a portion of said diaphragm being configured and arranged to contact the electrolyte;

a power supply configured to apply a voltage to said conductive polymer film;

a wiring portion electrically connecting said conductive polymer film to said power supply; and a pressure maintaining unit having an elastic member located inside said electrolyte chamber and on one portion of the wall surface of said electrolyte chamber, and configured to maintain a pressure applied to the diaphragm within a predetermined range by generating a pressure change in the electrolyte by using said elastic member, wherein said pressure maintaining unit includes a spring, and a first end of said spring is connected to said elastic member and a second end of said spring is connected to said electrolyte chamber.

* * * * *